United States Patent [19]

Masui et al.

[11] Patent Number: 4,745,741

[45] Date of Patent: May 24, 1988

[54] DOUBLE AIR-FUEL RATIO SENSOR SYSTEM HAVING IMPROVED RESPONSE CHARACTERISTICS

[75] Inventors: Takatoshi Masui, Mishima; Toshinari Nagai; Toshiyasu Katsuno, both of Susono; Yoshiki Chujo, Mishima; Nobuaki Kayanuma, Gotenba; Hironori Bessho, Susono; Yasushi Sato, Mishima; Toshio Tanahashi, Susono, all of Japan

[73] Assignee: Toyota Jidosha Kabushiki Kaisha, Aichi, Japan

[21] Appl. No.: 847,304

[22] Filed: Apr. 2, 1986

[30] Foreign Application Priority Data

| | | | |
|---|---|---|---|
| Apr. 4, 1985 | [JP] | Japan | 60-69930 |
| Apr. 5, 1985 | [JP] | Japan | 60-71175 |
| Apr. 13, 1985 | [JP] | Japan | 60-77553 |
| May 22, 1985 | [JP] | Japan | 60-108330 |

[51] Int. Cl.[4] ..... F02D 41/14

[52] U.S. Cl. ..... 60/274; 60/276; 60/285; 123/489; 123/492; 123/493

[58] Field of Search ..... 123/440, 489, 589, 492, 123/493; 60/276, 285, 274; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,126,107 | 11/1978 | Harada et al. | 123/492 |
| 4,130,095 | 12/1978 | Bowler et al. | 123/440 |
| 4,235,204 | 11/1980 | Rice | 123/440 |
| 4,392,471 | 7/1983 | Miyagi et al. | 123/489 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,561,403 | 12/1985 | Oyama et al. | 123/492 |
| 4,571,683 | 2/1986 | Kobayashi et al. | 364/431.05 |
| 4,616,619 | 10/1986 | Saito et al. | 123/492 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-53661 | 3/1983 | Japan . |
| 58-48755 | 3/1983 | Japan . |
| 58-48756 | 3/1983 | Japan . |
| 58-72646 | 4/1983 | Japan . |
| 58-72647 | 4/1983 | Japan . |
| 58-135343 | 8/1983 | Japan . |
| 59-152147 | 9/1983 | Japan . |
| 58-150038 | 9/1983 | Japan . |
| 58-150039 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Parkhurst & Oliff

[57] ABSTRACT

In a double air-fuel sensor system including two air-fuel ratio sensors upstream and downstream of a catalyst converter provided in an exhaust gas passage, an actual air-fuel ratio is adjusted in accordance with the outputs of the upstream-side air-fuel ratio sensor and the downstream-side air-fuel ratio sensor. The adjustment of the air-fuel ratio by the downstream-side air-fuel ratio sensor is stopped when the engine is in a predetermined state.

144 Claims, 39 Drawing Sheets

LEAN
RICH
A/F
TDR1
CDLY1

0
t1
t2
t3
t4
t5
t6
t7
t8
TDL1

TDR1
TDL1
F1
LEAN
RICH
TDR1

KIR1
FAF1
RSL1
RSR1
KIL1

V1
VR1
RICH
LEAN
TDR1
TDL1
F1
KIR
FAF1
RSL1
RSR1
KIL
V2
VR2
LEAN
RICH
TDR2
TDL2
F2
KIR
RSL1
RSR1
KIL1
LEAN REQ. TERM
LEAN REQ. TERM
FAF2

V1
VR1
RICH
LEAN
TDR1
TDL1
F1
KIR1
FAF1
RSL1
RSR1
KIL1
V2
VR2
LEAN
RICH
TDR2
TDL2
F2
MAX
RSRP
MIN
MAX
RSLP
MIN
LEAN REQ. TERM
LEAN REQ. TERM

TA (%)
100
0

LL
"1"
"0"

C
α
0
t1
t2
t3

A/F
RICH
λ=1
LEAN

FAF 2
1.0
PRESENT INVENTION
PRIOR ART

SPD

V1 VR1

V1 VR1
(PRESENT INVENTION)

V2 VR2
PRIOR ART
PRESENT INVENTION
LEAN

A/F
λ=1
RICH
PRESENT INVENTION
PRIOR ART
RICH

FAF2
1.0
LEAN
PRIOR ART
PRESENT INVENTION

CO
(HC)
PRIOR ART
t1
t2
PRESENT INVENTION

SPD, TEMP
SPD
TEMP

V1
VR1

V1
VR1
(PRESENT INVENTION)

V2
VR2
PRIOR ART
PRESENT INVENTION

A/F
LEAN
λ=1
RICH
PRESENT INVENTION

FAF2
RICH
1.0
LEAN
PRIOR ART
PRESENT INVENTION

CO (HC)
PRIOR ART
t1
t2
t3
PRESENT INVENTION

SPD, TEMP
SPD
TEMP

V1
VR1

V1
VR1
(PRESENT INVENTION)

V2
VR2

A/F
LEAN
λ=1
RICH
PRESENT INVENTION
PRESENT INVENTION

FAF2
RICH
1.0
LEAN
PRIOR ART
PRESENT INVENTION

CO (HC)
PRIOR ART
t1
t2
t3
PRESENT INVENTION

SPD, TEMP
SPD
TEMP

V1
VR1

V1
VR1
(PRESENT INVENTION)
PRESENT INVENTION

V2
VR2
PRIOR ART
LEAN

A/F
λ=1
PRESENT INVENTION
RICH
RICH
PRESENT INVENTION

FAF2
1.0
PRIOR ART
LEAN

NOx
t1
t2
t3
PRESENT INVENTION

SPD, TEMP
SPD
TEMP

V1
VR1

V1
VR1
(PRESENT INVENTION)

V2
VR2
PRESENT INVENTION

A/F
LEAN
λ=1
RICH
PRIOR ART
PRESENT INVENTION

FAF2
RICH
LEAN
PRESENT INVENTION

NOx
PRIOR ART
t1
t2
t3
PRESENT INVENTION

LEAN
RICH
A/F1

TDL1
CDLY1
0
t1 t2 t3 t4 t5 t6 t7 t8
TDR1

TDR1
LEAN
RICH
TDL1
TDR1
F1

KIR1
KIL1
FAF1
RSL1
RSR1

DOUBLE AIR-FUEL RATIO SENSOR SYSTEM HAVING IMPROVED RESPONSE CHARACTERISTICS

BACKGROUND OF THE INVENTION

1. Field of the Invention

The present invention relates to a method and apparatus for feedback control of an air-fuel ratio in an internal combustion engine having two air-fuel ratio sensors upstream and downstream of a catalyst converter disposed within an exhaust gas passage.

2. Description of the Related Art

Generally, in feedback control of the air-fuel ratio in a single air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output signal of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio. According to this feedback control, the center of the controlled air-fuel ratio can be within a very samll range of air-fuel ratios around the stoichometric ratio required for three-way reducing and oxidizing catalysts (catalyst converter) which can remove three pollutants CO, HC, and $NO_x$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio correction amount FAF is also fluctuated, thereby causing fluftuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, and 4,235,204). In such a double $O_2$ sensor system, another $O_2$ sensor is provided downstream of the catalyst converter, and thus another air-fuel ratio operation is carried out by correcting delay time parameters of an air-fuel ratio operation of the upstream-side $O_2$ sensor with the output of the downstream-side $O_2$ sensor. That is, in a single $O_2$ sensor system, the switching of the output of the upstream-side $O_2$ sensor from the rich side to the lean side or vice versa is delayed for a definite time period thereby stabilizing the feedback control, but such a definite time period is variable in the above-mentioned double $O_2$ sensor system. In this double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream-side $O_2$ sensor.

(3) On the downstream side of the catalyst converter, the exhaust gas is mixed so that the concentration of oxygen in the echaust gas is approximately in the equilibrium state.

Therefore, according to the double $O_2$ sensor system, the fluctuation of the output of the upstreamside $O_2$ sensor is compensated for by a feedback control using the output of the downstream-side $O_2$ sensor. That is, even when the upstream-side $O_2$ sensor is deteriorated, the emissions such as HC, CO, and $NO_x$ can be minimized by the correction of the delay time parameters by the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, even when the engine is in a special state, such as a lean air-fuel ratio requesting state, a transient state, a deceleration state, or an idling state, the air-fuel feedback control by the downstream-side $O_2$ sensor is not suspended, thereby deteriorating the fuel consumption, the drivability, and the exhaust emission characteristics.

For example, in a reductive atmosphere, components such as hydrogen sulfide ($H_2S$) are generated by the catalyst to generate an unpleasant odor. This odor is not a problem at a relatively high speed, but, at a relatively low speed, it becomes a problem for passengers in cars following behind. For this purpose, in the prior art, at a relatively low speed such as in an idling state or a low load state, the air-fuel ratio is forcibly made lean, thereby reducing this unpleasant odor (see: Japanese Unexamined Patent Publication (Kokai) No. 59-103941). However, even when such a forcible lean air-fuel control is carried out by a air-fuel ratio feedback control by the upstream side $O_2$ sensor, a fuel increment is carried out by the air-fuel ratio feedback control by the downstream-side $O_2$ sensor, so that it is impossible to obtain a lean air-fuel ratio, thus generating the above-mentioned unpleasant odor. Also, when the controlled air-fuel ratio by the feedback of the upstream-side $O_2$ sensor is changed rapidly from a lean air-fuel ratio to a stoichimetric air-fuel ratio, the feedback by the downstream-side $O_2$ sensor may not follow the change of the air-fuel ratio, thereby making the air-fuel ratio rich, and thus deterioratig the fuel consumption, the drivability, and the exhaust emission characteristics.

Also, in a transient state, such as a rapid acceleration/deceleration state, a gear-switchover state, or a take-off state, the controlled air-fuel ratio is greatly changed due to asynchronous fuel injection, the delay of the response speed of the feedback control by the upstream-side $O_2$ sensor, and the like. Therefore, in a transient state, when the feedback control by the downstream-side $O_2$ sensor is carried out, the air-fuel ratio is overcorrected. As a result, immedietely after the engine leaves such a transient state, the controlled air-fuel ratio is overrich or overlean, thereby deteriorating the fuel consumption the drivability, and the exhaust emission characteristics.

Further, when an idling state of the engine continues for a long time, the activity of the downstream-side $O_2$ sensor is reduced compared with that the upstream-side $O_2$ sensor, due to the difference therebetween in location, heat mass, and the like. When the activity of the downstream-side $O_2$ sensor is lost, a flow-out type $O_2$ sensor output processing circuit (see: FIG.3A) generates a lean sir-fuel ratio output, and a flow-in type $O_2$ sensor output processing circuit (see: FIG. 3B) generates a rich air-fuel ratio output. Therefore, when the base air-fuel ratio is lean and an idling state continues, the air-fuel ratio is first brought to the rich side by the feedback control of the downstream-side $O_2$ sensor. Then, in the case of a flow-out type circuit, correction is performed upon the rich air-fuel ratio, thus making it overrich, while in the case of a flow-in type circuit, correction is performed upon the rich air-fuel ratio, thus moving it towards the lean side, until finally, the air-fuel ratio becomes overlean.

On the other hand, when the base air-fuel ratio is rich and an idling state continues, the air-fuel ratio is first brought to the lean side by the feedback control of the downstream-side $O_2$ sensor. Then, in the case of a flow-in type circuit, correction is performed upon the lean air-fuel ratio, thus making it overlean, while in the case of a flow-out type circuit, correction is performed upon the lean air-fuel ratio, thus moving it towards the rich side, finally, the air-fuel ratio is overrich. Accordingly, in a long duration idling state and thereafter, the controlled air-fuel ratio is overrich or overlean, thus deteriorating the fuel consumption the drivability, and the exhaust emission characteristics.

SUMMARY OF THE INVENTION

It is an object of the present invention to provide a double air-fuel ratio sensor system in an internal combustion engine with which the fuel consumption, the drivability, and the exhaust emission characteristics are improved even when the downstream-side $O_2$ sensor is in a special state, such as a lean air-fuel ratio requesting state, a transient state, a deceleration state, or an idling state.

According to the present invention, in a double air-fuel sensor system including two air-fuel ratio sensors upstream and downstream of a catalyst converter provided in an exhaust gas passage, an actual air-fuel ratio is adjusted in accordance with the outputs of the upstream-side air-fuel ratio sensor and the downstream-side air-fuel ratio sensor, and the adjustment of the air-fuel ratio by the downstream-side air-fuel ratio sensor is stopped when the engine is in a predetermined state. Thus, since the feedback control by the downstream-side air-fuel ratio sensor is stopped, an overrich or overlean air-fuel is avoided.

BRIEF DESCRIPTION OF THE DRAWINGS

The present invention will be more clearly understood from the description as set forth below with reference to the accompanying drawings, wherein:

FIGS. 31A through 31D are timing diagrams explaining the flow chart of FIG. 29.

DESCRIPTION OF THE PREFERRED EMBODIMENTS

Figure 1:
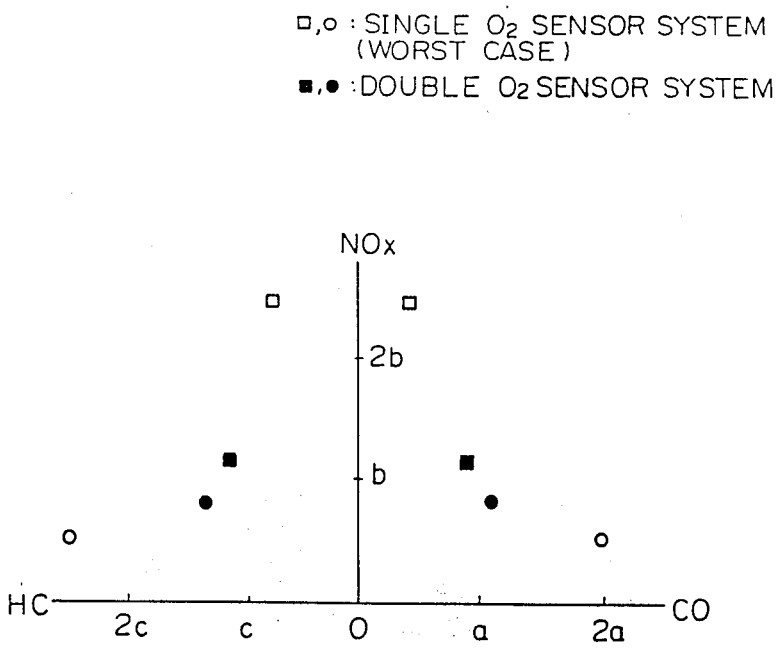
FIG. 1 is a graph showing the emission characteristics of a single $O_2$ sensor system (worst case) and a double $O_2$ sensor system.
Figure 2:
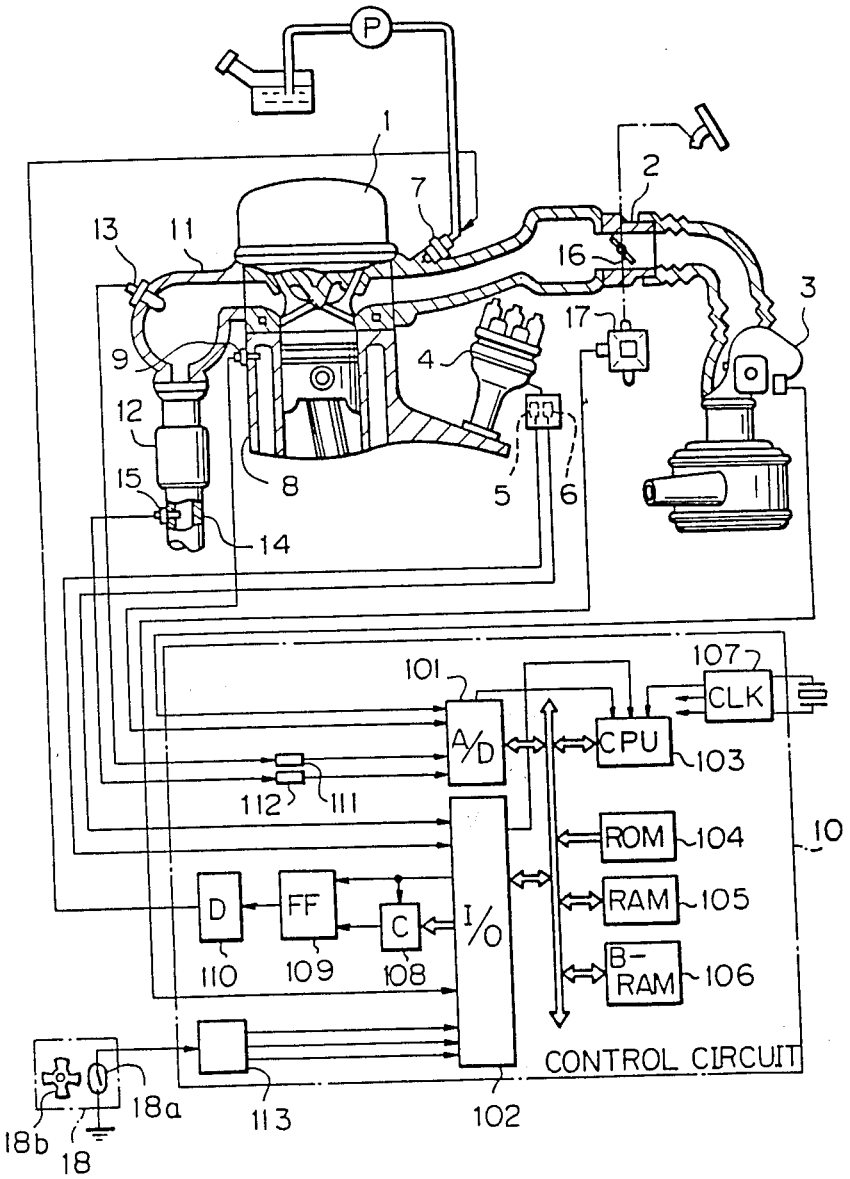
FIG. 2 is a schematic view of an internal combustion engine according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometertype airflow meter 3 for detecting the amount of air taken into the engine 1 to generate an analog voltage signal in proportion to the amount of air flowing therethrough. The signal of the airflow meter 3 is transmitted to a multiplexcer-incorporating analog-to-digital (A/D) converter 101 of a control circuit 10.

Disposed in a distributor 4 are crank angle sensors 5 and 6 for detecting the angle of the crankshaft (not shwon) of the engine 1. In this case, the crank-angle sensor 5 generates a pulse signal at every 720° crank angle (CA) while the crank-angle sensor 6 generates a pulse signal at every 30° CA. The pluse signals of the crank angle sensors 5 and 6 are supplied to an input/output (I/O) interface 102 of the control circuit 10. In addition, the pulse signal of the crank angle sensor 6 is then supplied to an interruption terminal of a centeral processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, though not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature of the coolant and transmits it to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_x$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst coverter 12 is a second $O_2$ sensor 15 for detecting the concentration of oxygen composition in the exhaust gas. The $O_2$ sensors 13 and 15 generate output voltage signals and transmit them via signal processing circuits 111 and 112 to the A/D converter 101 of the control circuit 10.

Provided in the intake air passage 2 is a throttle valve 16 arbitrarily operated by a driver. Also, fixed to the throttle valve 16 is an idle switch 17 which detects when the throttle valve 16 is completely closed. The output LL of the idle switch 17 is supplied to the I/O interface 102 of the control circuit 10.

Reference numeral 18 designates a vehicle speed sensor formed by a lead switch **18*a* and a permanent magnet 18*b*. In the vehicle speed sensor 18, when the permanent magnet 18*b* is rotated by the speed meter cable (not shown), the lead switch 18*a* is switched on and off, to generate a pulse signal having a frequency in proportion to the vehicle speed SPD. The pulse signal is transmitted via a vehicle speed generating circuit 113 to the I/O interface 102 of the control circuit 10**.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content therof is never erased even when the ignition switch (not shown) is turned off.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103, when the A/D converter 101 completes an A/D conversion and generates an interrupt signal; when the crank angle sensor 6 generates a pulse signal; and when the clock generator 109 generates a special clock signal.

The intake air amount data Q of the airflow meter 3 and the coolant temperature data THW of the coolant sensor 9, are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA., i.e., at every pulse signal of the crank angle sensor 6, and is then stored in the RAM 105.

Figure 3A:
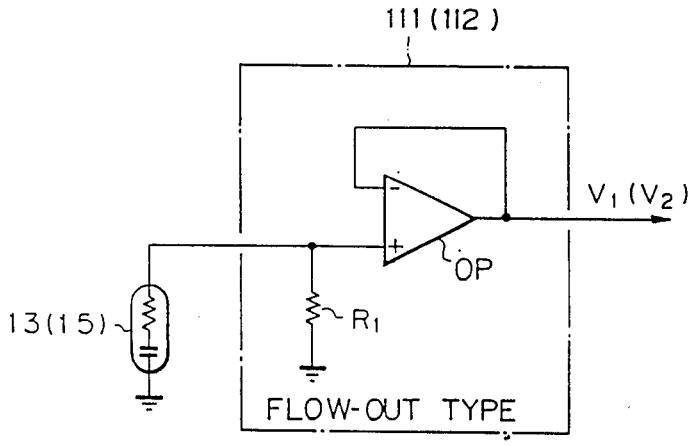
FIGS. 3A and 3B are circuit diagrams of the signal processing circuits of FIG. 2.
Figure 3B:
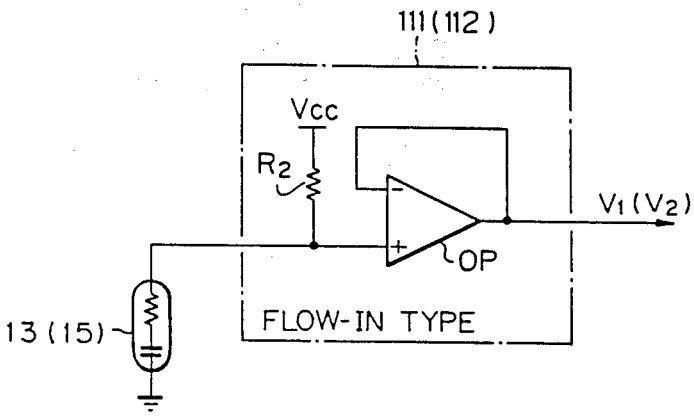
Figure 4A:
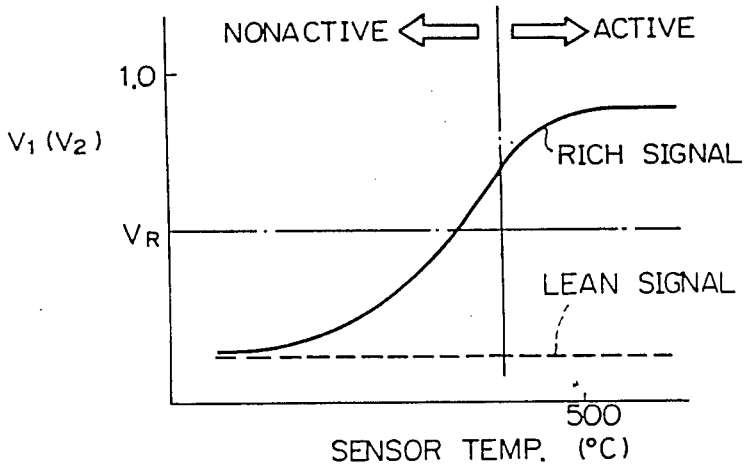
FIG. 4A and 4B are graphs showing the output characteristics of the signal processing circuits of FIGS. 3A and 3B, respectively.
Figure 4B:
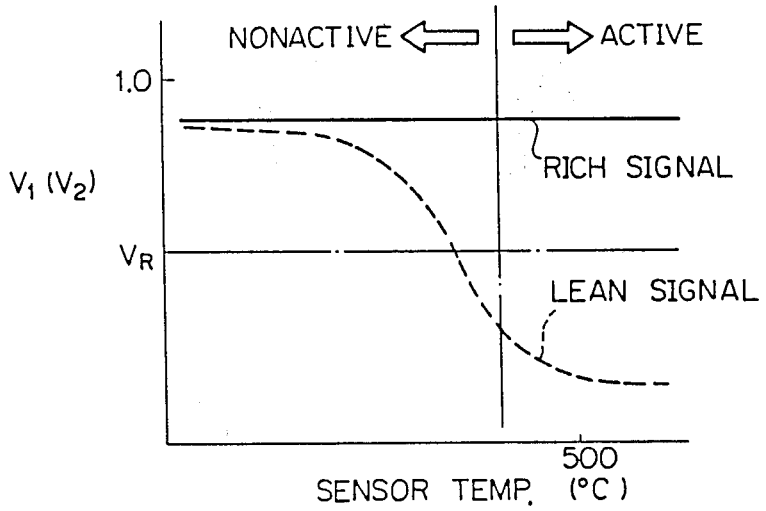

There are two types of signal processing circuits 111 and 112, i.e., the flow-out type and the flow-in type. As illustrated in FIG. 3A, the flow-out type signal processing circuit comprises a grounded resistor $R_1$ and a voltage buffer OP. Therefore, as shown in FIG. 4A, when the temperature of the $O_2$ sensor 13 (or 15) is low and the $O_2$ sensor 13 (or 15) is in a nonactive state, the output of the signal processing sircuit 111 (or 112) is low, due to sink currents by the resistor $R_1$, regardless of the rich or lean state of the $O_2$ sensor 13 (or 15). Contrary to this, when the $O_2$ sensor 13 (or 15) is activated by an increase of the temperature of the signal processing circuit 111 (or 112) generates a rich signal which has a high potential or a lean signal which has a low potential. Therefore, in this case, the activation/deactivation state of the $O_2$ sensor 13 (or 15) can be determined by whether a rich signal is low or high. On the other hand, as illustrated in FIG. 3B, the flow-in type signal processing circuit comprises a resistor $R_2$ connected to a power supply $V_{CC}$ and a voltage buffer OP. Therefore, when the temperature of the $O_2$ sensor 13 (or 15) is low and the $O_2$ sensor 13 (or 15) is in a nonactive state, the output of the signal processing circuit 111 (or 112) is high, due to source currents by the resistor $R_2$, regardless of the rich or lean stage of the $O_2$ sensor 13 (or 15). Contrary to this, when the $O_2$ sensor 13 (or 15) is activated by an increase of the temperature thereof, the signal processing circuit 111 (or 112) generates a high potential rich signal or a low potential lean signal. Therefore, in this case, the activation/deactivation state of the $O_2$ sensor 13 (or 15) can be determined by whether a lean signal is low or high.

Note that, hereinafter, the signal processing circuits 111 and 112 are the flow-out type.

The output characteristics of the $O_2$ sensors 13 and 15 will be explained with reference to FIGS. 5, 6, and 7.

Figure 5:
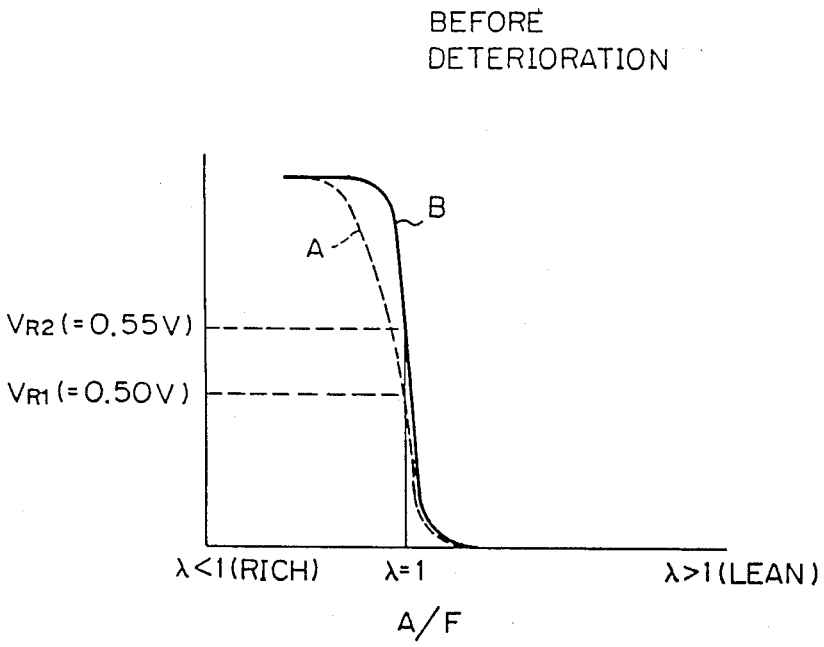
FIGS. 5, 6, and 7 are graphs showing the output characteristics of $O_2$ sensors.

In FIG. 5, curve A shows the output characteristics of the upstream-side $O_2$ sensor 13 before deterioration, and curve B shows the output characteristics of the downstream-side $O_2$ sensor 15 before deterioration. Even before their deterioration, since the exhaust gas is sufficiently mixed on the downstream-side of the catalyst converter 12, compared with on the upstream-side therof, the output characteristics of the downstream-side $O_2$ sensor 15 are superior to those of the upstream-side $O_2$ sensor 13. That is, if each reference voltage for the determination of the output of the $O_2$ sensors 13 and 15 is defined at the stoichiometric air-fuel ratio ($\lambda=1$), the reference voltage $V_{R1}$ and $V_{R2}$ for the output of the $O_2$ sensors 13 and 15, respectively, have the following relationship:

$$V_{R2}>V_{R1}$$

In this case, the reference voltage $V_{R1}$ is, for example, about 0.50 V, and the reference voltage $V_{R2}$ is, for example, about 0.55 V.

Figure 6:
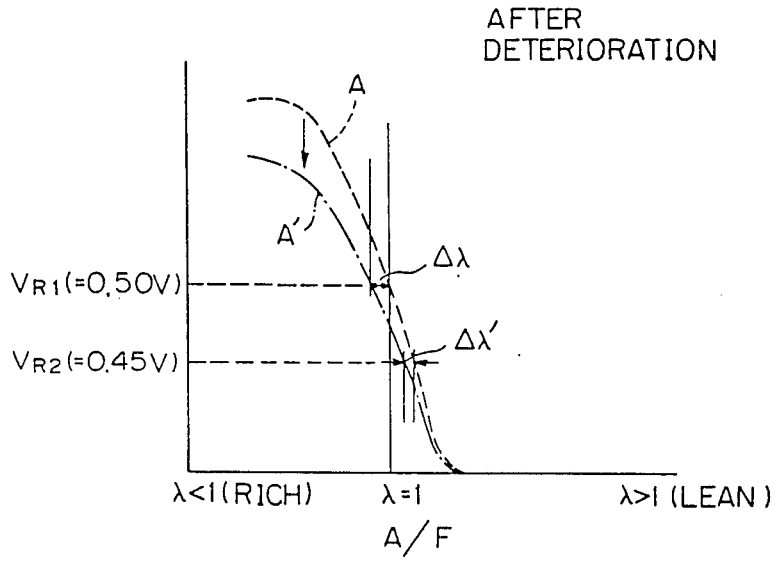

In FIG. 6, curve A shows the output characteristics of the upstream-side $O_2$ sensor 13 before deterioration and 'curve A' shows the output characteristics of the upstream-side $O_2$ sensor 13 after deterioration. As shown in FIG. 6, if the reference volta $V_{R1}$ is set at about 0.50 V, which corresponds to the stoichiometric air-fuel ratio ($\lambda=1$) before its deterioration, the controlled air-fuel ratio after the deterioration of the upstream-side $O_2$ sensor 15 is greatly deviated by $\Delta\lambda$ on the rich side from the stoichiometric air-fuel ratio ($\lambda=1$). In order to reduce such a large deviation $\Delta\lambda$ of the controlled air-fuel ratio, the reference voltage $V_{R1}$ is set at a relatively low level such as 0.45 V. In this case, the deviation of the controlled air-fuel ratio after its deterioration is reduced from $\Delta\lambda$ to $\Delta\lambda'$. In this case, although the controlled air-fuel ratio is on the lean side before and after the deterioration of the $O_2$ sensor 13, the controlled air-fuel ratio on the lean side can be moved to the stoichiometric air-fuel ratio by adjusting air-fuel ratio feedback control parometers such as delay time periods, skip amounts, or integration amounts. For example, a rich delay time period is caused to be larger than a lean delay delay time period. Note that the rich delay time period is used for delaying the determination of the upstream-side $O_2$ sensor 13 switched from the lean side to the rich side, and the lean delay time period is used for delaying the determination of the upstream-side $O_2$ sensor 13 switched from the rich side to the lean side. Thus, the reference voltage $V_{R1}$ for the output of the upstream-side $O_2$ sensor 13 is actually set at about 0.45 V corresponding to a lean air-fuel ratio.

Figure 7:
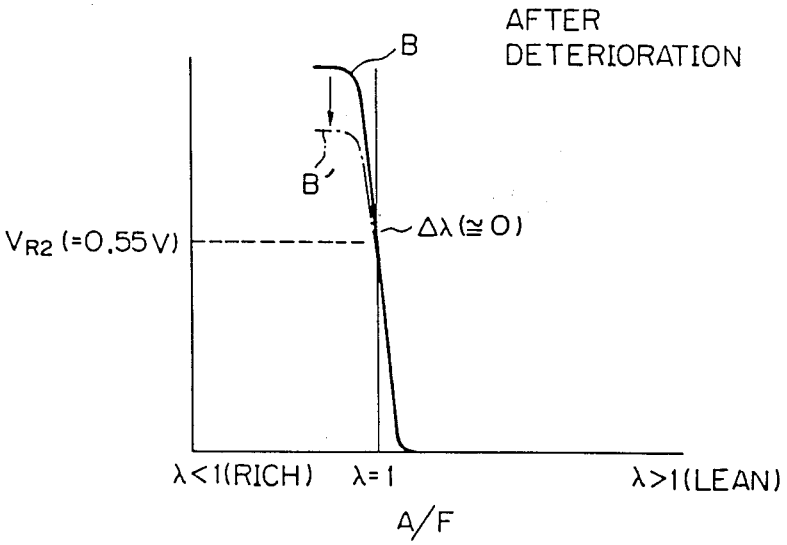

In FIG. 7, curve B shows the output characteristics of the downstream-side $O_2$ sensor 15 before deterioration 'curve B' and shows the output characteristics of the downstream-side $O_2$ sensor 15 after deterioration. As shown in FIG. 7, the reference voltage $V_{R2}$ set at the stoichiometric air-fuel ratio ($\lambda=1$) is almost unchanged evenafter the deterioration of the downstream-side $O_2$ sensor 15. In other words, when the reference voltage $V_{R2}$ is set at about 0.55 V, corresponding to the stoichimetric air-fuel ratio ($\lambda=1$) before its deterioration, the controlled air-fuel ratio after the deterioration of the downstream-side $O_2$ sensor 15 is still at the stoichiometric air-fuel ratio ($\Delta\lambda\simeq0$). Thus, the reference voltage $V_{R2}$ is actually set at about 0.55 V.

As explained above, the reference voltage $V_{R1}$ is always set at a level corresponding to a lean air-fuel ratio, while the reference voltage $V_{R2}$ is always set at a level corresponding to the stoichiometric air-fuel ratio.

The operation of the control circuit 2 of FIG. 2 will be now explained.

Figure 8A:
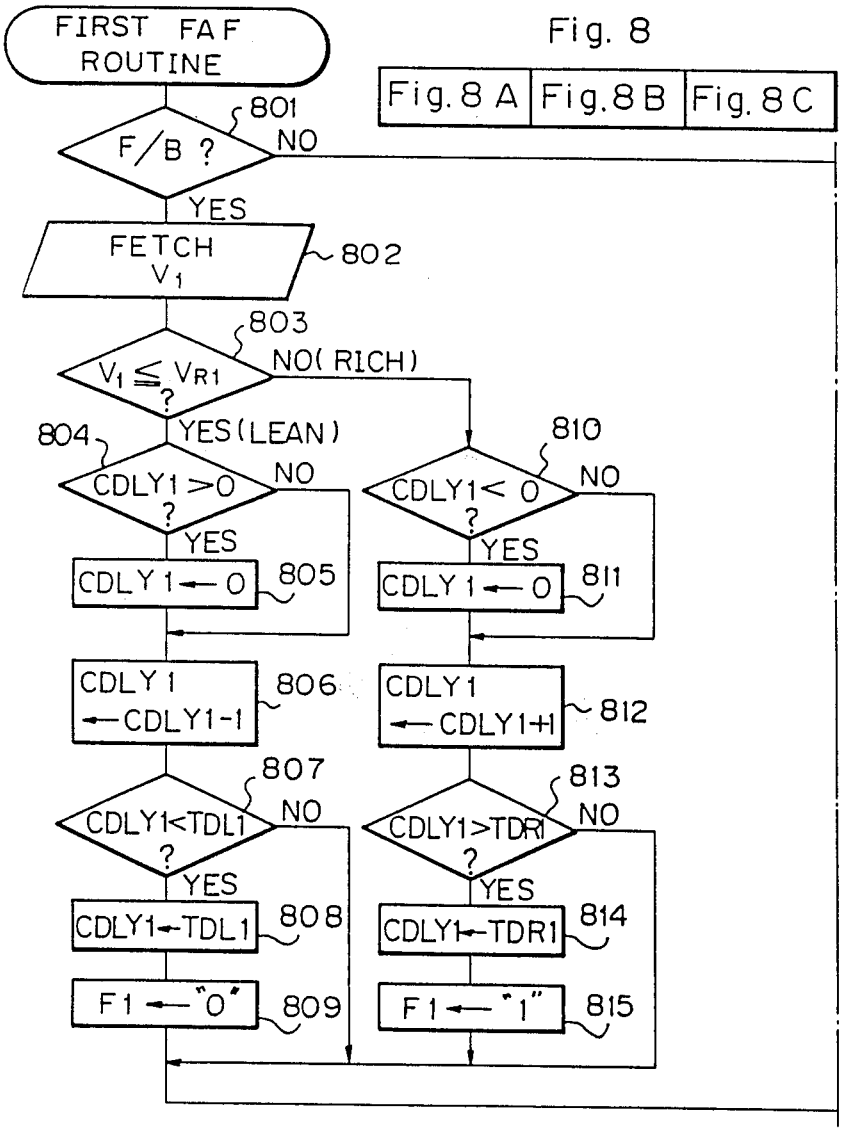
FIGS. 8A–8C, 11, 12A–12C, 13, 15A, 15B, 16, 18, 19, 19A–19D, 21, 23, 28, 29, 30, and 31A–31D are flow charts showing the operation of the control circuit of FIG. 2.
Figure 8B:
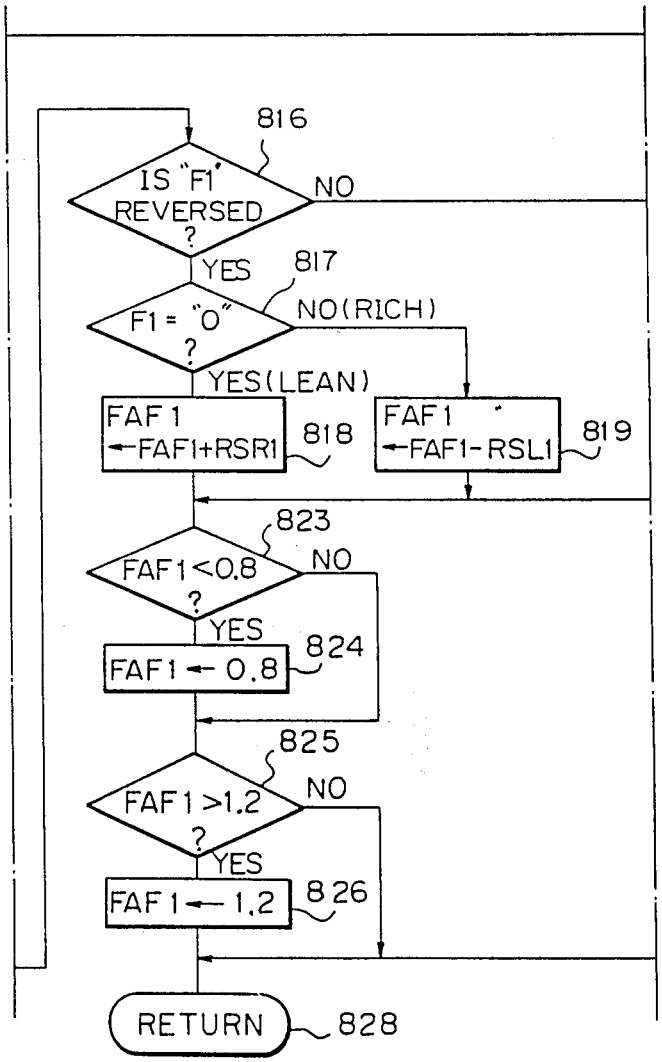
Figure 8C:
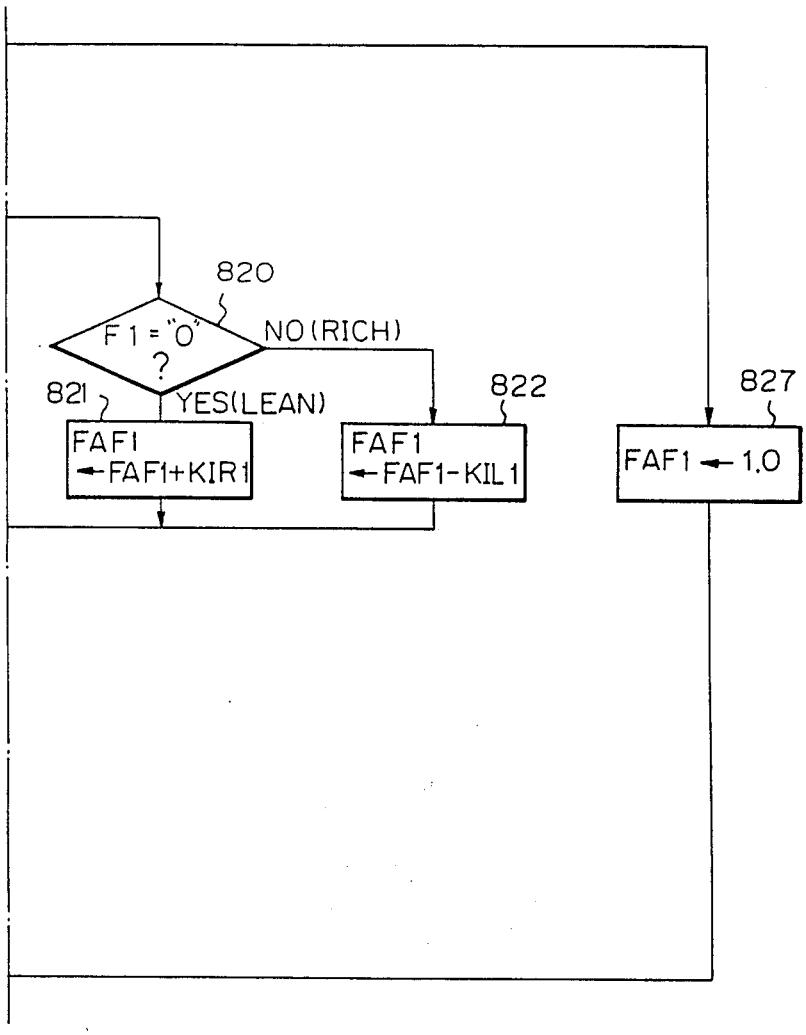

FIG. 8 is a routine for calculating a first air-fuel ratio feedback correction amount FAF1 in accordance with the output of the upstream-side $O_2$ sensor 13 executed at every predetermined time period such as 4 ms.

At step 801, it is determined whether or not all the feedback control (closed-loop control) conditions by the upstream-side $O_2$ sensor 13 are satisfied. The feedback control conditions are as follows:

(i) the engine is not in a starting state;
(ii) the coolant temperature THW is higher than 50° C.;
(iii) the power fuel incremental amount FPOWER is O; and
(iv) the upstream-side $O_2$ sensor 13 is not in an activated state.

Note that the determination of activation/nonactivation of the upstream-side $O_2$ sensor 13 is carried out by determining whether or not the coolant temperature THW≧70° C., or by whether or not the output of the upstream-side $O_2$ sensor 13 is once swung from the lean side to the rich side, or vice versa. Of course, other feedback control conditions are introduced as occasion demands. However, an explanation of such other feedback control conditions is omitted.

If one or more of the feedback control conditions is not satisfied, the control proceeds to step 827, in which the correction amount FAF is caused to be 1.0 (FAF1=1.0), thereby carrying out an open-loop control operation. Note that, in this case, the correction amount FAF1 can be a learning value or a value immediately before the feedback control by the upstream-side $O_2$ sensor 13 is stopped.

Contrary to the above, at step 801, if all of the feedback control conditions are satisfied, the control proceeds to step 802.

At step 802, an A/D conversion is performed upon the output voltage $V_1$ of the upstream-side $O_2$ sensor 13, and the A/D coverted value thereof is then fetched from the A/D converter 101. Then, at step 803, the voltage $V_1$ is compared with the reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 804, which determines whether or not the value of a first delay counter CDLY1 is positive. If CDLY1>0, the control proceeds to step 805, which clears the first delay counter CDLY1, and then proceeds to step 806. If CDLY1 ≦0, the control proceeds directly to step 806. At step 806, the first delay counter CDLY1 is counted down by 1, and at step 807, it is determined whether or not CDLY1<TDL1. Note that TDL1 is a lean delay time period for which a rich state is maintained even after the output of the upstream-side $O_2$ sensor 13 is changed from the rich side to the lean side, and is defined by a negative value. Therefore, at step 807, only when CDLY1<TDL1 does the control proceed to step 808, which causes CDLY1 to be TDL1, and then to step 809, which causes a first air-fuel ratio flag F1 to be "0 "(lean state). On the other hand, if $V_{1>VR1}$, which means that the current air-fuel ratio is rich, the control proceeds to step 810, which determines whether or not the value of the first delay counter CDLY1 is negative. If CDLY1<0, the control proceeds to step 811, which clears the first delay counter CDLY1, and then proceeds to step 812. If CDLY1>0, the control directly proceeds to 812. At step 812, the first delay counter CDLY1 is counted up by 1, and at step 813, it is determined whether or not CDLY1>TDR1. Note that TDR1 is a rich delay time period for which a lean state is maintained even after the output of the upstream-side $O_2$ sensor 13 is changed from the lean side to the rich side, and is defined by a positive value. Therefore, at step 813, only when CDLY1>TDR1 does the control proceed to step 814, which causes CDLY1 to be TDR1, and then to step 815, which causes the first air-fuel ratio flag F1 to be "1" (rich state).

Next, at step 816, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 819, which carry out a skip operation. That is, if the flag F1 is "0" (lean) at step 817, the control proceeds to step 818, which remarkably increases the correction amount FAF1 by a skip amount RSR1. Also, if the flag F1 is "1" (rich) at step 817, the control proceeds to step 819, which remarkably decreases the correction amount FAF1 by the skip amount RSL1. On the other hand, if the first air-fuel ratio flag F1 is not reversed at step 816, the control proceeds to steps 820 to 822, which carries out an integration operation. That is, if the flag F1 is "0" (lean) at step 820, the control proceeds to step 821, which gradually increases the correction amount FAF1 by a rich integration amount KIR1. Also, if the flag F1 is "1" (rich) at step 820, the control proceeds to step 822, which gradually decreases the correction amount FAF1 by a lean integration amount KIL1.

Note that the skip amount RSR1(RSL1) is larger than the integration amount KIR1(KIL1).

The correction amount FAF1 is guarded by a minimum value 0.8 at steps 823 and 824, and by a maximum value 1.2 at steps 825 and 826, thereby also preventing the controlled air-fuel ratio from becoming overrich or overlean.

The correction amount FAF1 is then stored in the RAM 105, thus completing this routine of FIG. 8 at step 828.

Figures 9A, 9B, 9C, 9D:
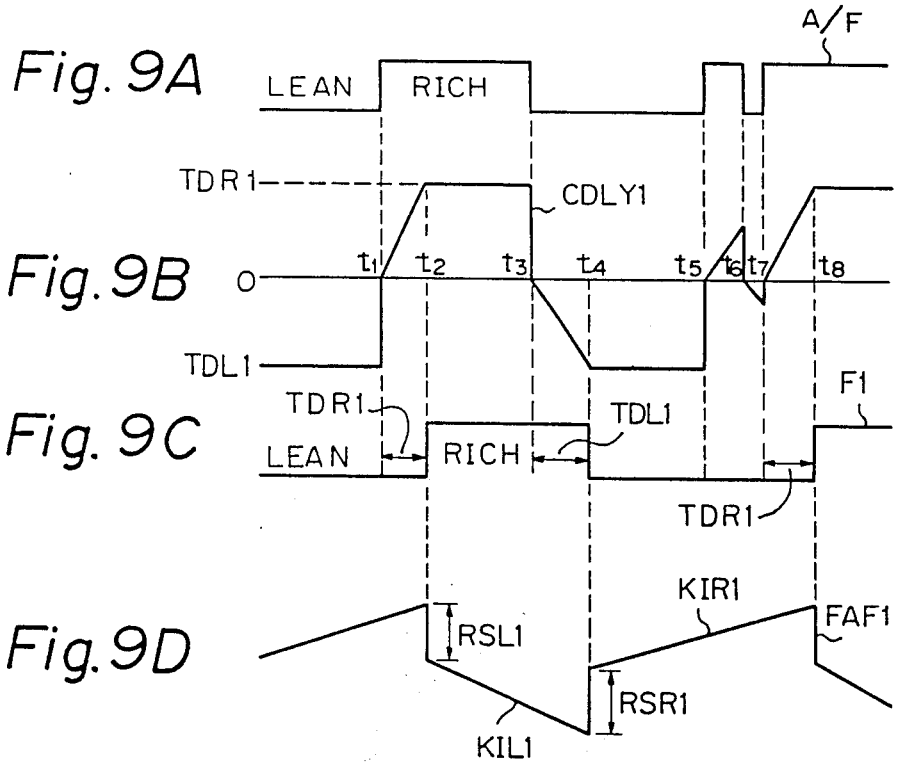
FIGS. 9A through 9D are timing diagrams explaining the flow charts of FIG. 8.

The operation by the flow chart of FIG. 8 will be further explained with reference to FIGS. 9A through 9D. As illustrated in FIG. 9A, when the air-fuel ratio A/F is obtained by the output of the upstream-side $O_2$ sensor 13, the first delay counter CDLY1 is counted up during a rich state, and is counted down during a lean state, as illustrated in FIG. 9B. As a result, a delayed air-fuel ratio corresponding to the first air-fuel ratio flag F1 is obtained as illustrated in FIG. 9C. For example, at time $t_1$, even when the air-fuel ratio A/F is changed from the lean side to the rich side, the delayed air-fuel ratio F1 is changed at time $t_2$ after the rich delay time period TDR1. Similarly, at time $t_3$, even when the air-fuel ratio A/F is changed from the rich side to the lean side, the delayed air-fuel ratio F1 is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio F1 is reversed at time $t_8$. That is, the delayed air-fuel ratio F1 is stable when compared with the air-fuel ratio A/F. Further, as illustrated in FIG. 9D, at every change of the delayed air-fuel ratio F1 from the rich side to the lean side, or vice versa, the correction amount FAF1 is skipped by the skip amount RSR1 or RSL1, and also, the correction amount FAF1 is gradually increased or decreased in accordance with the delayed air-fuel ratio F1.

Figure 10A:
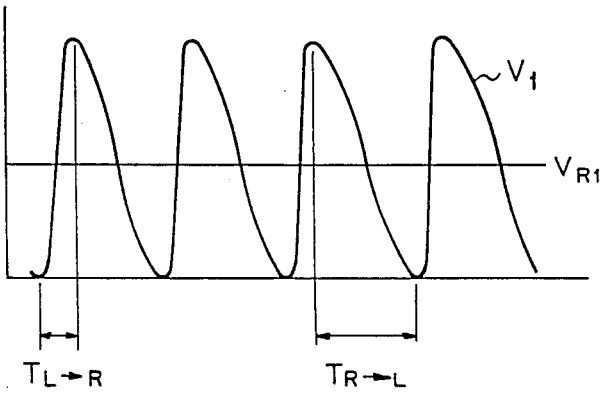
FIGS. 10A and 10B are timing diagrams explaining the output characteristics of the upstream-side $O_2$ sensor of FIG. 2.
Figure 10B:
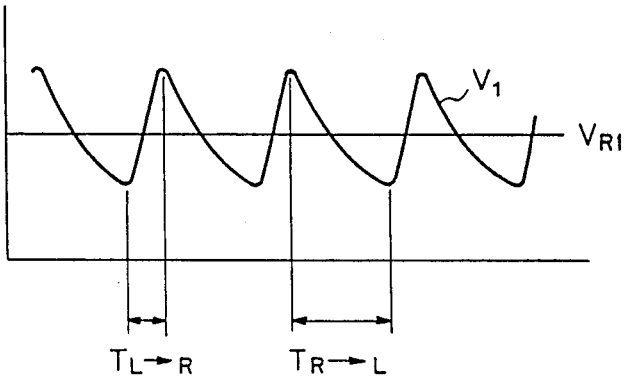

As explained above, the reference voltage $V_{R1}$ for the output $V_1$ of the upstream-side $O_2$ sensor 13 is set at a level such as 0.45 on the lean side. Therefore, to enable a stoichiometric air-fuel ratio control ($\lambda=1$), the output $V_1$ of the upstream-side $O_2$ sensor 13 before its deterioration is changed as shown in FIG. 10A, and the output $V_1$ of the upstream-side $O_2$ sensor 13 is changed as shown in FIG. 10B. In any case, a duration $T_{R\rightarrow L}$ from the rich side to the lean side is larger than a duration $T_{L\rightarrow R}$ from the lean side to rich side. For this purpose, the delay time periods. TDR1 and TDL1 generally satisfy the following relationship:

$$TDR1>(-TDL1).$$

On the other hand, if a lean requesting state occurs, the delay time periods TDR1 and TDL1 are changed to satisfy the following relationship:

$$TDR1<(-TDL1).$$

Figure 11:
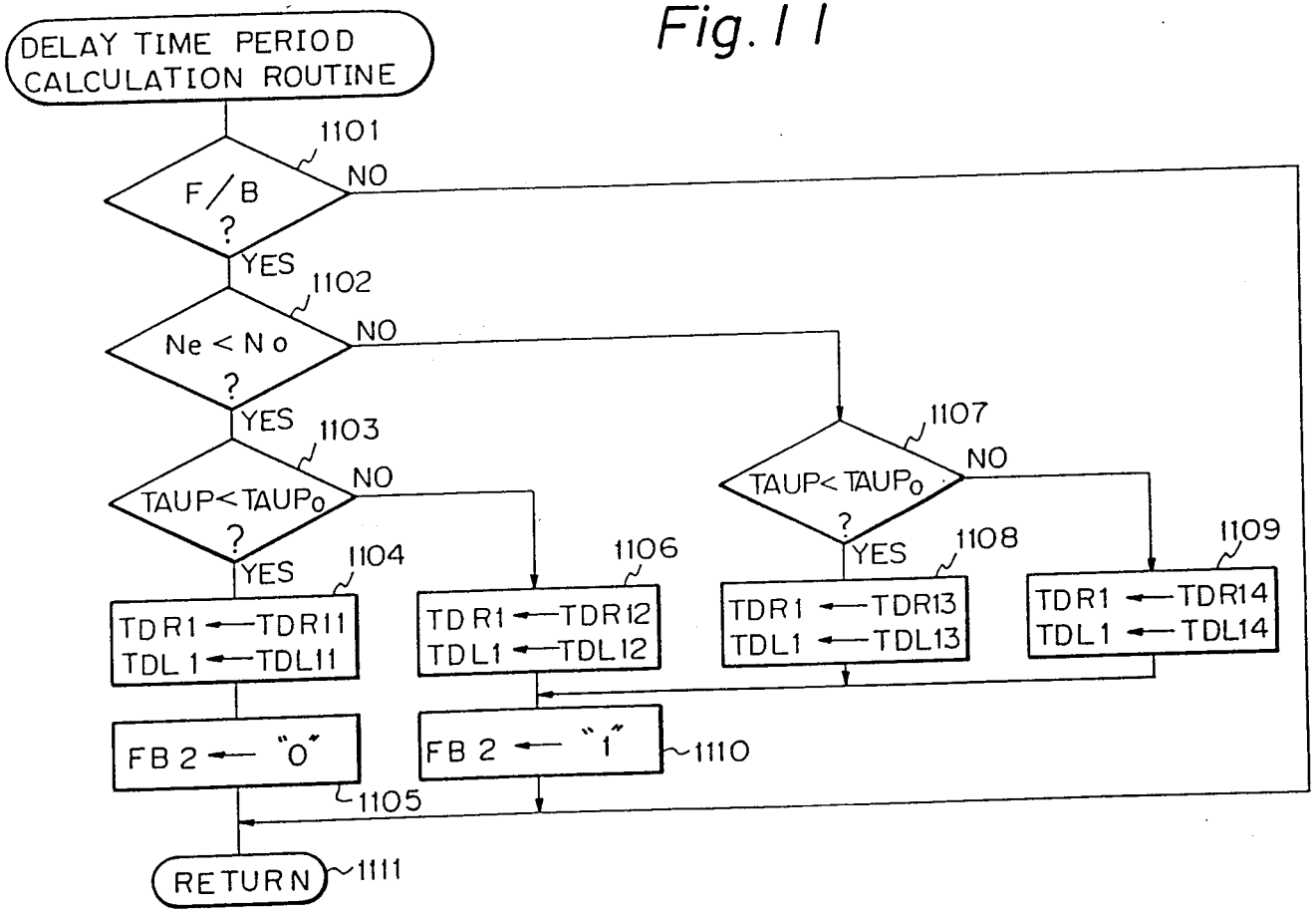

The delay time priods TDR1 and TDL1 are calculated by a routine of FIG. 11, which is carried out at every predetermined crank angle or time period. That is, at step 1101, it is determined whether or not all of the feedback control conditions are satisfied, in the same way as at step 801 of FIG. 8. If at least one of the feedback control conditions is not satisfied, the control proceeds directly to step 1111, thus completing the routine of FIG. 11, while if all of the feedback control conditions are satisfied, the control proceeds to step 1102, which determines whether or not the engine speed $N_e$ is smaller than a predetermined value $N_o$ such as 1200 rpm. Further, at steps 1103 and 1107, it is determined whether or not a base fuel injection TAUP (see: step 1301 of FIG. 13) is smaller than a predetermined value $TAUP_0$ such as 2 ms. The control proceeds to step 1104, 1106, 1108, or 1109 in accordance with the det-ermination at steps 1102, 1103, and 1107. In this case, the delay time periods TDRI are determined as follows:

| | TDR 1 | | TDL 1 | |
|---|---|---|---|---|
| | TAUP < $TAUP_0$ | TAUP ≧ $TAUP_0$ | TAUP < $TAUP_0$ | TAUP ≧ $TAUP_0$ |
| $N_e < N_o$ | TDR 11 | TDR 12 | TDL 11 | TDL 12 |
| $N_e \geqq N_o$ | TDR 13 | TDR 14 | TDL 13 | TDL 14 |

For example, TDR11=2(8 ms), TDR12=3(12 ms), TDR13=8(32 ms), TDR14=16(64 ms), TDL11=−16(64 ms), TDL12=−2(8 ms), TDL13=−2(8 ms), and TDL14=−2(8 ms).

That is, $$TDR11<(-TDL11)$$

$$TDR12>(-TDL12)$$

$$TDR13>(-TDL13)$$

$$TDR14>(-TDL14).$$

Thus, only when $N_e<N_o$ and $TAUP<TAUP_o$, is the air-fuel ratio caused to be lean, thereby eliminating any unpleasant odor due to $H_2S$ or the like.

Further, only when $N_e<N_o$ and $TAUP<TAUP_o$, does the control proceed to step 1105, which clears an air-fuel ratio feedback flag FB2. Otherwise, at step 1110, the air-fuel ratio feedback flag FB2 is set. Note that the air-fuel ratio feedback flag FB2 (="1") is used for carrying out a second air-fuel ratio feedback control operation which will be later explained.

The calculated values TDR1, TDL1, and FB2 are stored in the RAM 105, thereby completing this routnine at step 1111.

Note that, during an open-loop operation, the delay time periods TDR1 and TDL1 can be definite values such as 12 (corresponding to 48 ms) and −6 (corresponding to 24 ms), respectively. Also, a lean air-fuel ratio request can be obtained by changing other air-fuel feedback control parameters, such as the skip amounts RSR1 and RSL1, the integration amounts KIR1 and KIL1, and the reference voltage $V_{R1}$.

Air-fuel ratio feedback control operation by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio fedback control operation by the upstream-side $O_2$ sensor 13 is variable. Further, as the air fuel ratio feedback control parameter, there are nominated a delay time period TD (in more detail, the rich delay time period TDR1 and the lean delay time period TDL1), a skip amount RS (in more detail, the rich skip amount RSR1 and the lean skip amount RSL1), and an integration amount KI (in more detail, the rich integration amount KIR1 and the lean integration amount KIL1).

For example, if the rich delay time period becomes larger than the lean delay time period (TDR1>(−TDL1)), the controlled air-fuel ratio becomes richer, and if the lean delay time period becomes larger than the rich delay time period ((−TDL1)>TDR1), the controlled air-fuel ratio becomes leaner. Thus, the air-fuel ratio becomes richer, and if the lean skip amount RSL is increased or if the rich skip amount RSR is decreased, the controlled air-fuel ratio can be controlled by changing the rich delay time period TDR1 and the lean delay time period TDL1 in accordance with the output of the downstream-side $O_2$ sensor 15. Also, if the rich skip amount RSR1 is increased or if the lean skip amount RSL is decreased, the controlled air-fule ratio becomes leaner. Thus, the air-fuel ratio can be controlled by changing the rich skip amount RSR1 and the lean skip amount RSL1 in accordance with the output of the downstream-side $O_2$ sensor 15. Further, if the rich integration amount KIR1 is increased or if the lean integration amount KIL1 is decreased, the controlled air-fuel ratio becomes richer, and if the lean integration amount KIL is increased or if the rich integration amount KIR is decreased, the controlled air-fuel ratio becoms leaner. Thus, the air-fuel ratio can be controlled by changing the rich integration amount KIR1 and the lean integration amount KIL1 in accordance with the output of the downsteam-side $O_2$ sensor 15. Still further, if the reference voltage $V_{R1}$ is incresed, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

A double $O_2$ sensor system into which a second air-fuel ratio correction amount FAF2 is introduced will be explained with reference to FIGS. 12 and 13.

Figure 12A:
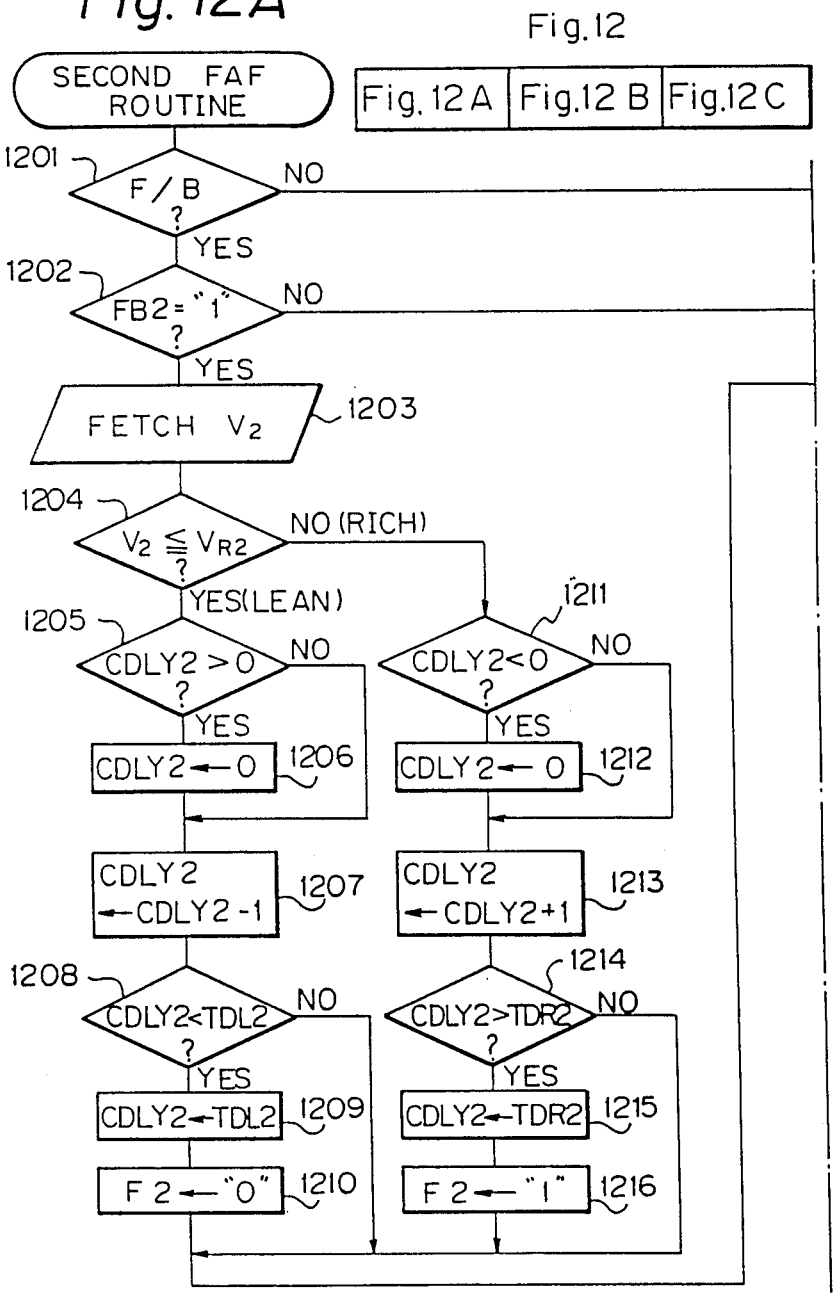
Figure 12B:
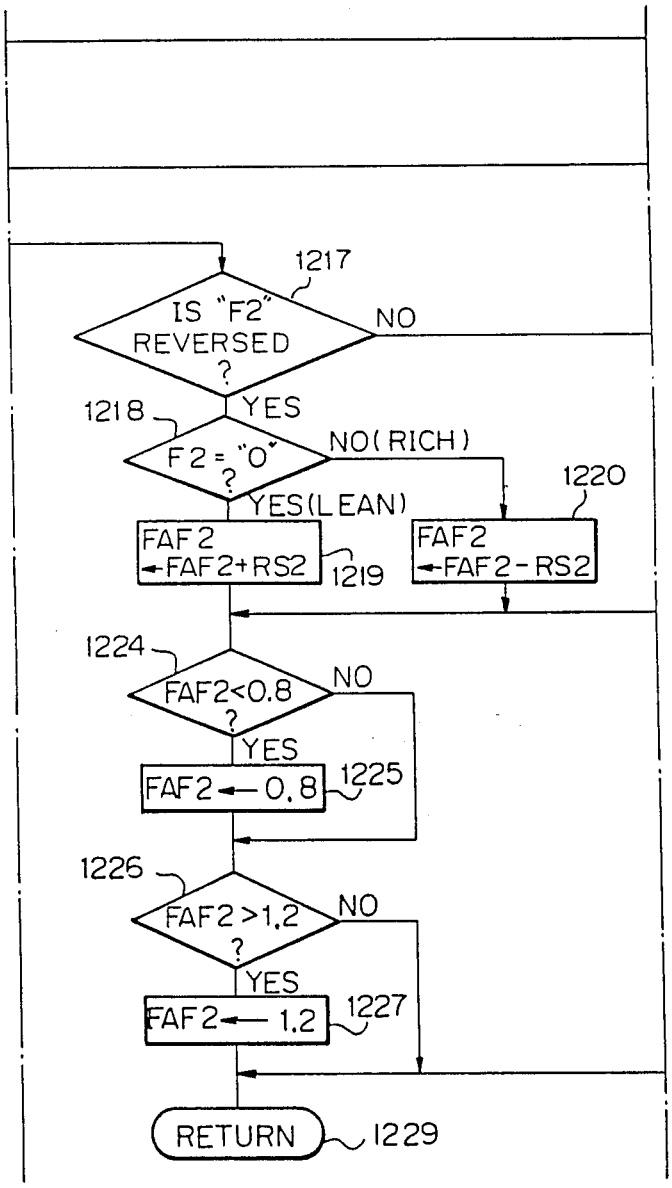
Figure 12C:
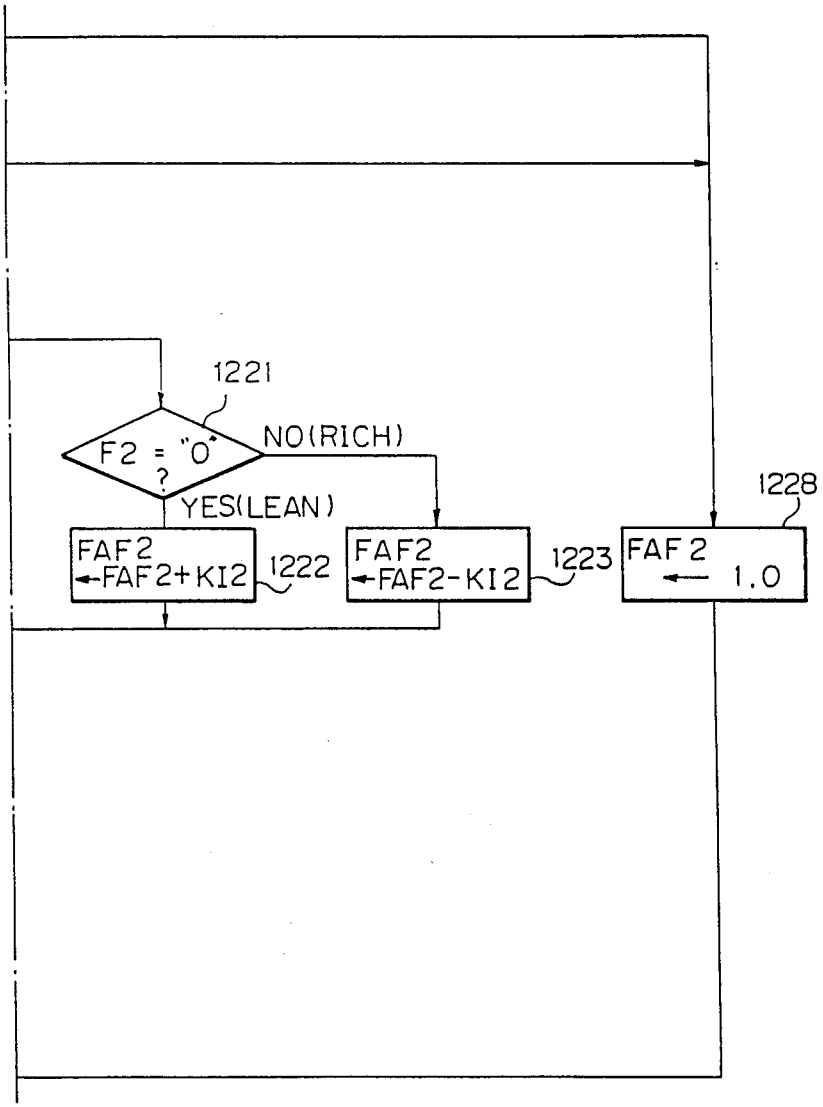

FIG. 12 is a routine for calculating a second air-fuel ratio feedback correction amount FAF2 in accordance with the output of the downstream-side $O_2$ sensor 15 executed at every predetermined time period such as 1 s.

At step 1201, it is determined whether or not all the feedback control (closed-loop control) conditions by the downstream-side $O_2$ sensor 15 are satisfied. The feedback control conditions are as follows:

(i) the engine is not in a starting state;
(ii) the coolant temperature THW is higher than 50° C.;
(iii) the power fuel increment FPOWER is 0; and
(iv) the second $O_2$ sensor 15 is not in an activated state.

Note that the determination of activation/nonactivation of the second $O_2$ sensor 15 is carried out by determining whether or not the coolant temperature THW ≧70° C., or by whether or not the output of the downstream-side $O_2$ sensor 15 is once swung from the lean side to the rich side, or vice versa. Of course, other feedback control conditions are introduced as occasion demands. However, an explanation of such other feedback control conditions is omitted.

If one or more of the feedback control conditions is not satisfied, the control proceeds to step 1228 in which the correction amount FAF2 is caused to be 1.0 (FAF2=1.0), thereby carrying out an open-loop control operation. Note that, also in this case, the correction amount FAF2 can be a learning value or a value immediately before the feedback control by the downstream-side $O_2$ sensor 15 is stopped.

Contrary to the above, at step 1201, if all of the feedback control conditions are satisfied, the control proceeds to step 1202. That is, when the engine is switched from an open-loop control to a closed-loop control, the flow at step 1201 proceeds to step 1202.

At step 1202, it is determined whether or not the air-fuel ratio feedback flag FB2 is "1", i.e., a lean air-fuel ratio request has occurred. As a result, when a lean air-fuel ratio request occurs (FB2="1"), the control proceeds to step 1228, thereby carrying out an open loop control. On the other hand, if a lean air-fuel ratio request does not occur, the control proceeds to step 1203.

At step 1203, an A/D conversion is performed upon the output voltage $V_2$ of the downstream-side $O_2$ sensor 15, and the A/D converted value thereof is then fetched from the A/D converter 101. Then, at step 1204, the voltage $V_2$ is compared with the reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio.

Steps 1205 through 1216 correspond to steps 804 through 815, respectively, of FIG. 8, thereby performing a delay operation upon the determination at step 1204. Here, a rich delay time period is defined by TDR2, and a lean delay time period is defined by TDL2. As a result of the delayed determination, if the air-fuel ratio is rich, a second air-fuel ratio flag F2 is caused to be "1", and if the air-fuel ratio is lean, a second air-fuel ratio flag F2 is caused to be "0".

Next, at step 1211, it is determined whether or not the second air-fuel ratio flag F2 is reversed, i.e., whether or not the delayed air-fuel ratio detected by the downstream-side $O_2$ sensor 15 is reversed. If the second air-fuel ratio flag F2 is reversed, the control proceeds to steps 1218 to 1220 which carry out a skip operation. That is, if the flag F2 is "0" (lean) at step 1218, the control proceeds to step 1219, which remarkably increases the second correction amount FAF2 by a skip amount RS2. Also, if the flag F2 is "1" (rich) at step 1218, the control proceeds to step 1220, which remarkably decreases the second correction amount FAF2 by the skip amount RS2. On the other hand, if the second air-fuel ratio flag F2 is not reversed at step 1217, the control proceeds to steps 1221 to 1222, which carries out an integration operation. That is, if the flag F2 is "0" (lean) at step 1221, the control proceeds to step 1222, which gradually increases the second correction amount FAF2 by an integration amount KI2. Also, if the flag F2 is "1" (rich) at step 1221, the control proceeds to step 1223, which gradually decreases the second correction amount FAF2 by the integration amount KI2.

Note that the skip amount RS2 is larger than the integration amount KI2.

The second correction amount FAF2 is guarded by a minimum value 0.8 at steps 1224 and 1225, and by a maximum value 1.2 at steps 1226 and 1227, thereby also preventing the controlled air-fuel ratio from becoming overrich or overlean.

The correction amount FAF2 is then stored in the RAM 105, thus completing this routine of FIG. 12 at step 1229.

Figure 13:
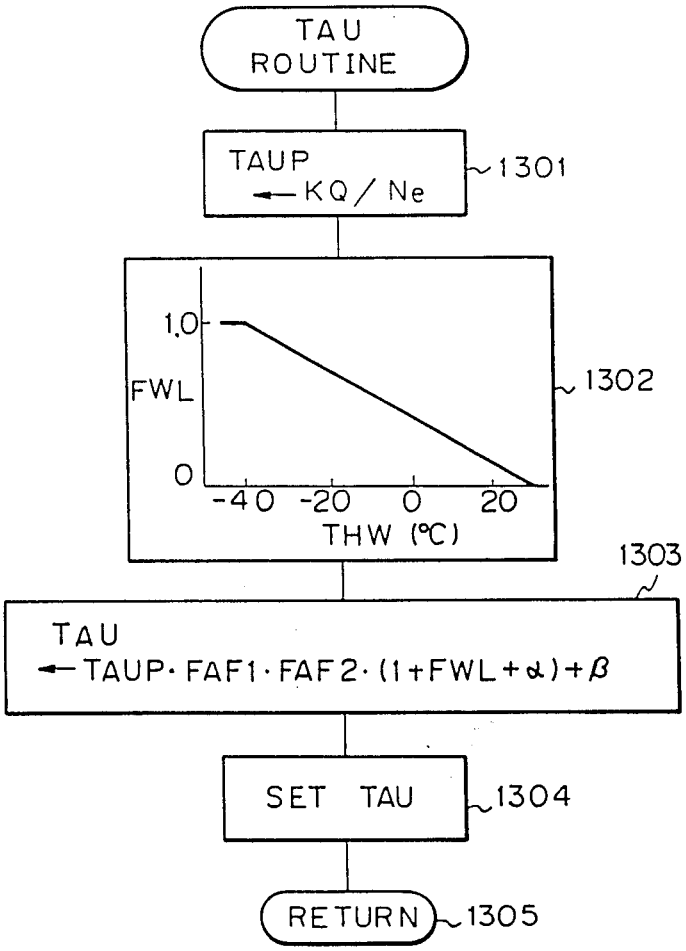

FIG. 13 is a routine for calculating a fuel injection amount TAU executed at every predetermined crank angle such as 360° CA. At step 1301, a base fuel injection amount TAUP is calculated by using the intake air amount data Q and the engine speed data $N_e$ stored in the RAM 105. That is, $$TAUP \leftarrow KQ/N_e$$

where $\alpha$ and $\beta$ are correction factors determined by other parameters such as the voltage of the battery and the temperature of the intake air.

At step 304, the final fuel injection smount TAU is set in the down counter 108, and in addition, the flip-flop 109 is set to initiate the activation of the fuel injection valve 7. Then, this routine is completed by step 1305. Note that, as explained above, when a time period corresponding to the amount TAU passes, the flip-flop 109 is reset by the carry-out signal of the down counter 108 to stop the activation of the fuel injection valve 7.

Figures 14A, 14B, 14C, 14D, 14E, 14F, 14G, 14H:
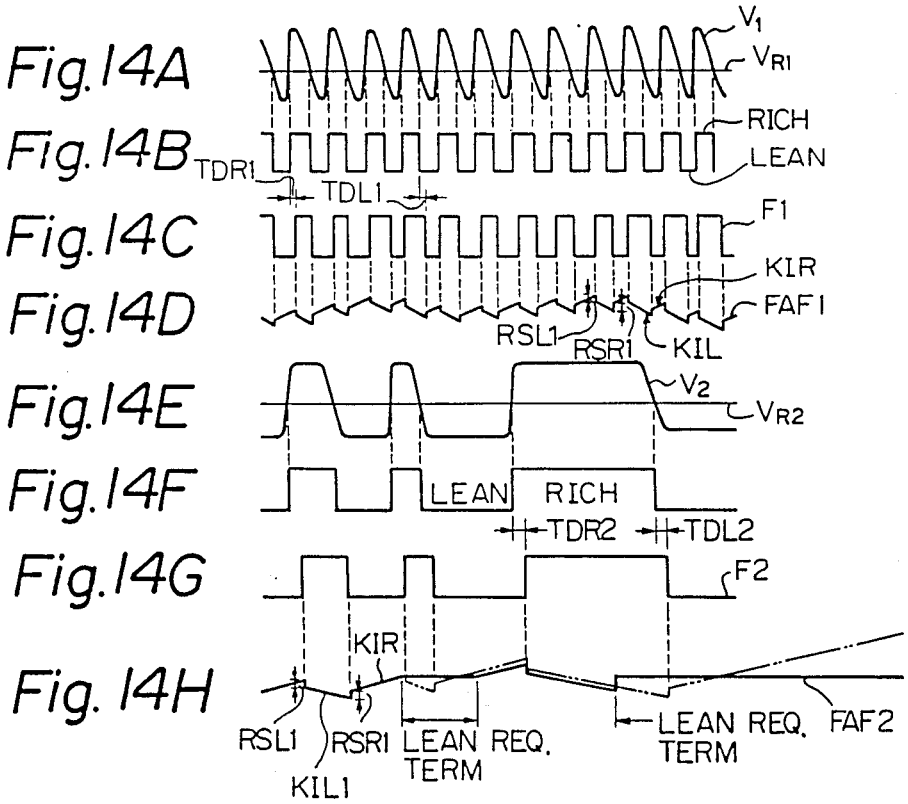
FIGS. 14A through 14H are timing diagrams explaining the flow chart of FIGS. 8, 11, 12, and 13.

FIGS. 14A through 14H are timing diagrams for explaining the two air-fuel ratio correction amounts FAF1 and FAF2 obtained by the flow charts of FIGS. 8, 11, 12, and 13. When the output of the upstream-side $O_2$ sensor 13 is changed as illustrated in FIG. 14A, the determination at step 803 of FIG. 8 is shown in FIG. 14B, and a delayed determination thereof corresponding to the first air-fuel ratio flag F1 is shown in FIG. 14C. As a result, as is changed from the rich side to the lean side, or vice versa, the first air-fuel ratio correction amount FAF1 is skipped by the skip amount RAR or RSL. On the other hand, when the output of the downstream-side $O_2$ sensor 15 is changed as illustrated in FIG. 14F, the determination at step 1204 of FIG. 12 is shown in FIG. 14F and the delayed determination thereof corresponding to the second air-fuel ratio flag F2 is shown in FIG. 14G. As a result, as shown in FIG. 141H, every time the delayed determination is changed from the rich side to the lean side, or vice versa, the second air-fuel ratio correction amount FAF2 is skipped by the skip amount RS2. In this case, when a lean air-fuel ratio request occurs, the second air-fuel ratio feedback control by the downstream-side $O_2$ sensor 15 is suspended and the second air-fuel ratio correction amount FAF2 is caused to be a predetermined value such as 1.0. Note, that, if the second air-fuel ratio feedback control by the downstream-side $O_2$ sensor 15 is carried out even in a lean air-fuel requesting term, the second air-fuel ratio correction amount FAF2 is changed as indicated by a solid-dot line in FIG. 14H, and accordingly, it is impossible to obtain a lean air-fuel ratio.

A double $O_2$ sensor system, in which an air-fuel ratio feedback control constant of the first air-fuel ratio feedback control by the upstream-side $O_2$ sensor is variable, will be explained with reference to FIGS. 15 and 16. Note, that feedback control parameters other than the delay time periods used in FIG. 11 are variable, and in this case, the skip amounts RAR and RSL are variable.

Figure 15A:
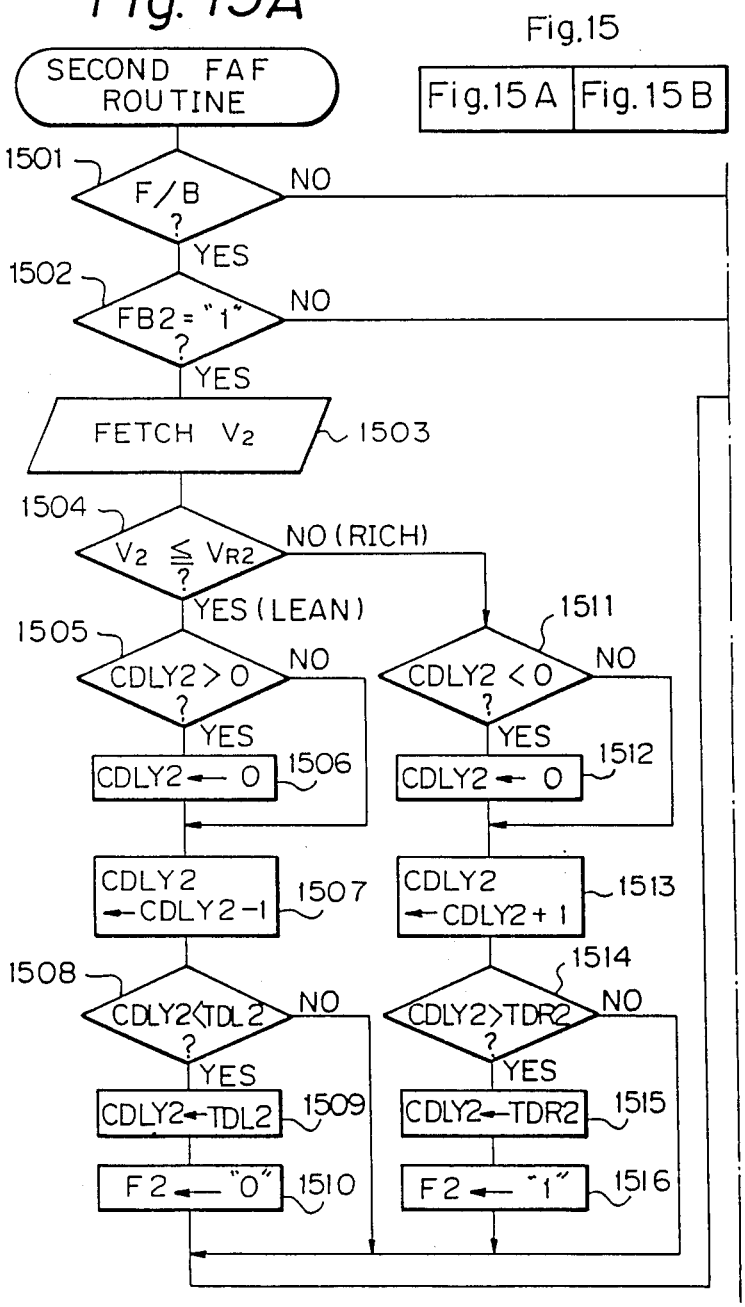
Figure 15B:
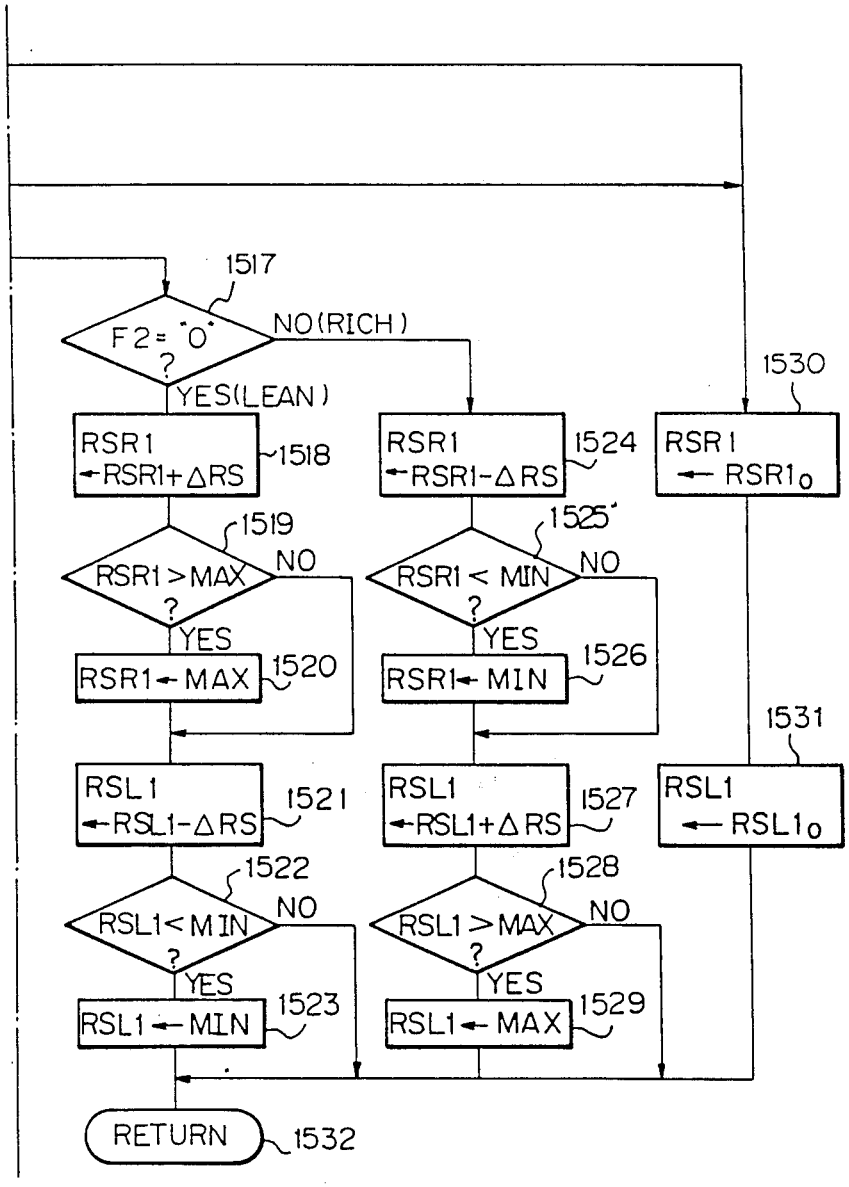

FIG. 15 is a routine for calculating the skip amounts RSR and RSL in accordance with the output of the downstream-side $O_2$ sesor 15 executed at every predetermined time period such as 1 s.

Steps 1501 through 1515 are the same as steps 1201 through 1215 of FIG. 12. That is, if one or more of the feedback control conditions is not satisfied, or if a lean air-fuel ratio request occurs (FB2="0"), the control proceeds to steps 1530 and 1531, thereby carrying out an open-loop control operation. For example, the rich skip amount RAR and the lean skip amount RSL are made definite values $RSR_0$ and $RSL_0$ which are, for example, 5%. Note that, in this case, the skip amounts RSR and RSL can be leaning values or values immediately before the feedback control by the downstream-side $O_2$ sensor 15 is stopped.

Contrary to the above, if all of the feedback control conditons are satisfied and a lean air-fuel ratio request occurs (FB2="1"), the second air-fuel ratio flag F2 is determined by the routine of steps 1503 through 1516.

At step 1517, it is determined whether or not the second air-fuel ratio F2 is "0". If F2="0", which means that the air-fuel ratio is lean, the control proceeds to steps 1518 through 1523, and if F2="1", which means that the air-fuel ratio is rich, the control proceeds to steps 1524 through 1529.

At step 1518, the rich skip amount RSR is increased by a definite value ΔRS which is, for example, 0.08, to move the air-fuel ratio to the rich side. At steps 1519 and 1520, the rich skip amount RSR is guarded by a maximum value MAX which is, for example, 6.2%. Further, at step 1521, the lean skip amount RSL1 is decreased by the definite value ΔRS to move the air-fuel ratio to the lean side. At steps 1522 and 1523, the lean skip amount RSL1 is guarded by a minimum value MIN which is, for example, 2.5%.

On the other hand, a step 1524, the rich skip amount RSR1 is decreased by the definite value ΔRS to move the air-fuel ratio to the lean side. At steps 1525 and 1526, the rich skip amount RSR1 is guarded by the minimum value MIN. Further, at step 1527, the lean skip amount RSL is decreased by the definite value ΔRS to move the air-fuel ratio to the rich side. At steps 1528 and 1529, the lean skip amount RSL1 is guarded by the maximum value MAX.

The skip amounts RSR1 and RSL1 are then stored in the RAM 105, thereby completing this routine of FIG. 15 at step 1529.

Thus, according to the routine of FIG. 15, when the delayed output of the downstream-side $O_2$ sensor 15 is lean, the rich skip amount RSR1 is gradually increased, and the lean skip amount RSL1 is gradually decreased, thereby moving the air-fuel ratio to the rich side. Contrary to this, when the delayed output of the downstream-side $O_2$ sensor 15 is rich, the rich skip amount RSR is gradually decreased, and the lean skip amount RSL1 is gradually increased, thereby moving the air-fuel ratio to the lean side.

Figure 16:
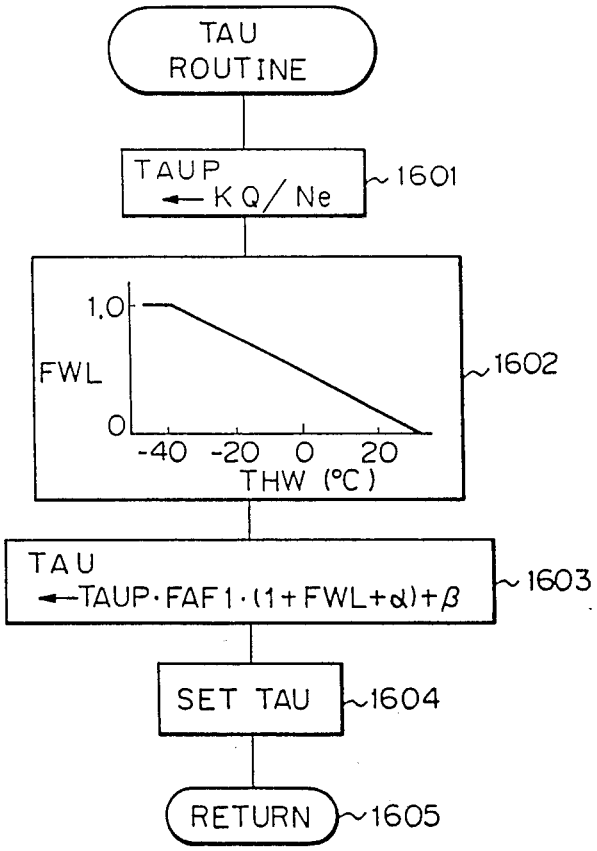

FIG. 16 is a routine for calculating a fuel injection amount TAU executed at every predetermined crank angle such as 360° CA. At step 1601, a base fuel injection amount TAUP is calculated by using the intake air amount data Q and the engine speed data Ne stored in the RAM 105. That is, $$TAUP \leftarrow KQ/Ne$$

where K is a constant. Then at step 1602, a warming-up incremental amount RWL is calculated from a one-dimensional map by using the coolant temperature data THW stored in the RAM 105. Note that the warming-up incremental amount FWL decreases when the coolant temperature THW increased. At step 1603, a final fuel injection amount TAU is calculated by $$TAU \leftarrow TAUP \cdot FAF1 \cdot (1+FWL+\alpha)+\beta$$

where $\alpha$ and $\beta$ are correction factors determined by other parameters such as the voltage of the battery and the temperature of the intake air. At step 1604, the final fuel injection amount TAU is set in the down counter 108, and in addition, the flip-flop 109 is set to initiate the activation of the fuel injection valve 7. Then, this routine is completed by step 1505. Note that, as explained above, when a time period corresponding to the amount TAU has passed, the flip-flop 109 is reset by the carry-out signal of the down counter 108 to stop the activation of the fuel injection valve 7.

Figures 17A, 17B, 17C, 17D, 17E, 17F, 17G, 17H, 17I:
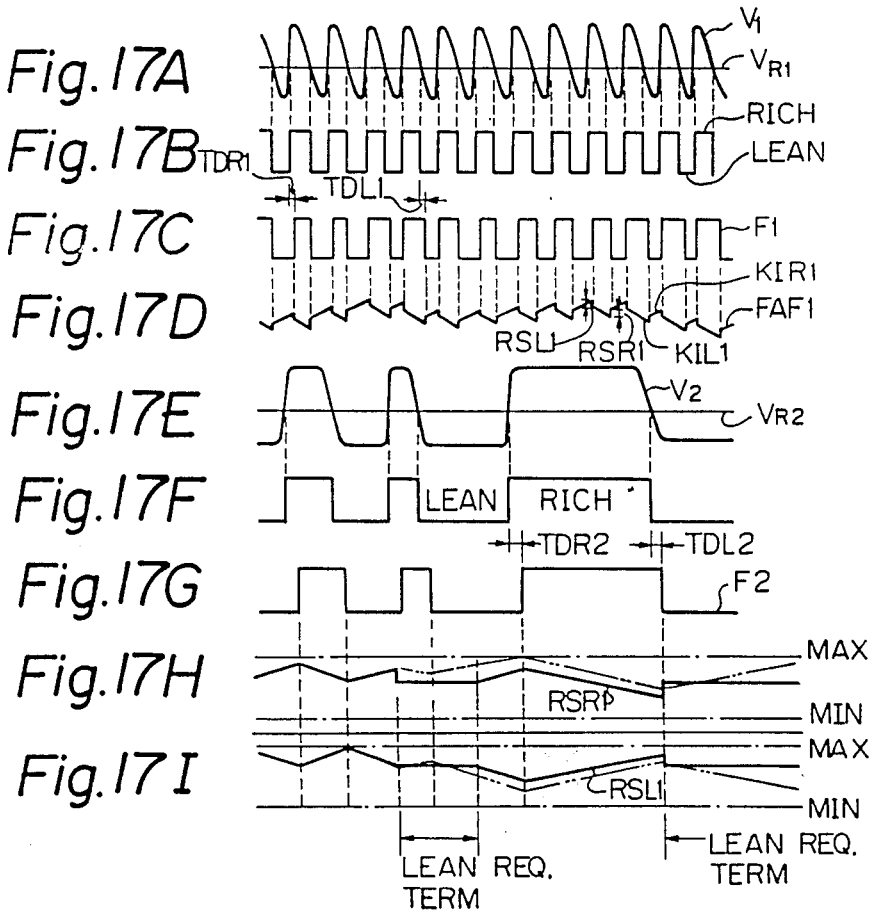
FIGS. 17A through 17I are timing diagrams explaining the flow chart of FIGS. 8, 11, 15, and 16.

FIGS. 17A through 17I are timing diagrams for explaining the air-fuel ratio correction amout FAF1 and the skip amounts RSR and RSL obtained by the flow charts of FIGS. 9, 11, 15, and 16. FIGS. 17A through 17G are the same as FIGS. 14A through 14G, respectively. As shown in FIGS. 17G, 17H, and 17I, when the delayed determination F2 is lean, the rich skip amount RSR1 is increased and the lean skip amount RSL1 is decreased, and when the delayed determination F2 is rich, the rich skip amount RSR1 is decreased and the lean skip amount RSL1 is increased. In this case, the skip amounts RSR1 and RSL1 are changed within a range from MAX to MIN. Also in this case, when a lean air-fuel ratio request occurs, the second air-fuel ratio feedback control by the downstream-side $O_2$ sensor 15 is suspended and the skip amounts RSR1 and RSL1 are caused to be a predetermined value such as 5%. Note that, if the second air-fuel ratio feedback control by the downstream-side $O_2$ sensor 15 is carried out even in a lean air-fuel requesting term, the skip amounts RSR1 and RSL1 are changed as indicated by solid-dot lines in FIG. 17H and 17I and accordingly, it is impossible to obtain a lean air-fuel ratio.

Figure 18:
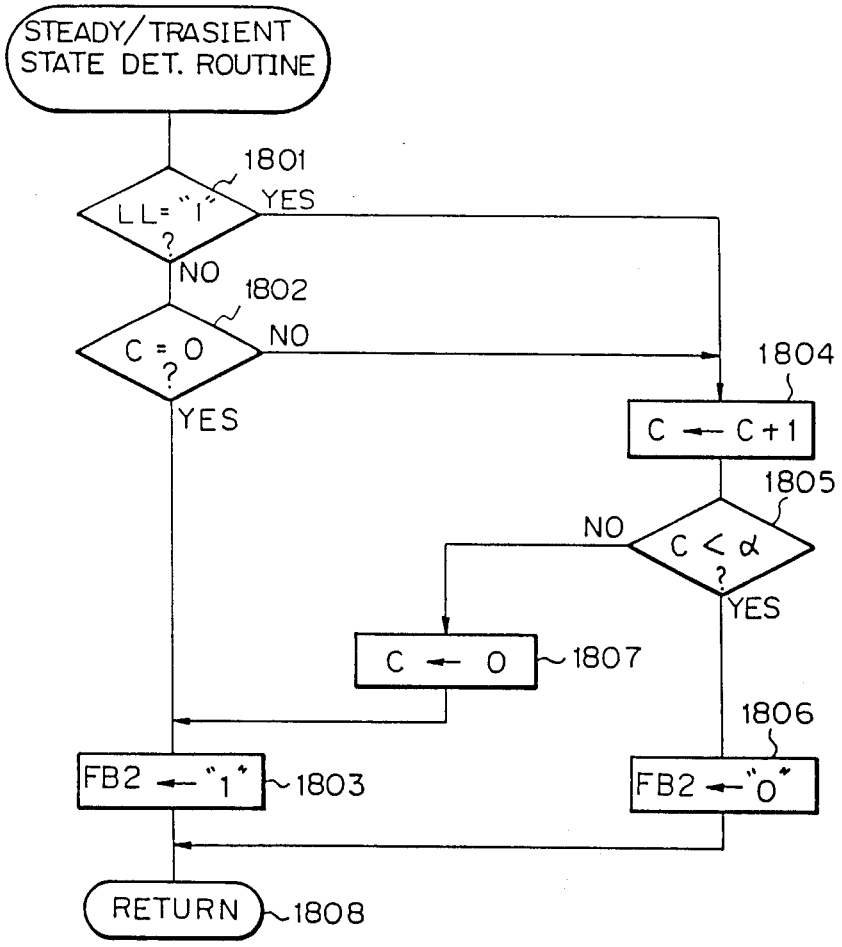

FIG. 18 is a routine for determining whether the engine is in a steady state or in a transient state, executed at every predetermined time period or crank angle. The routine of FIG. 18 is used instead of the routine of FIG. 11

First, assume that the engine is in a steady state, in which the throttle valve 16 is not completely closed (LL="0") and a counter C is cleared. At step 1801, output LL of the idle switch 17 is fetched, and it is determined whether or not the throttle valve 16 is completely closed. Therefore, in this case, since the throttle valve 16 is not completely closed (LL="0"), the control proceeds to step 1802, which determines whether or not the counter C is zero. Further, since C=0, the control proceeds to step 1803, which sets the air-fuel ratio feedback flag FB2, thereby carrying out the second air-fuel ratio feedback control by the downstream-side $O_2$ sensor 15 as illustrated in FIG. 12 or 15. Then, the air-fuel ratio feedback flag FB2 is stored in the RAM 105, and the routine of FIG. 18 is completed at step 1808.

Next, when the output LL of the idle switch 16 is turned ON, that is, when the engine is switched from a steady state to a transient state, the flow from step 1801 to step 1802 is switched to the flow from step 1801 to step 1804. As a result, the counter C is counted up by 1, and at step 1805, it is determined whether or not $$C<\alpha$$

where $\alpha$ is a definite value corresponding to about 2 to 5 s. That is, a change of the engine from a steady state to a transient state is detected, thereby initiating the duration $\alpha$.

At step 1805, when $C<\alpha$, the control proceeds to step 1806 which clears the air-fuel ratio feedback flag FB2, thus suspending the second air-fuel ratio feedback control by the downstream-side $O_2$ sensor 15.

Thus, once a change of the engine from a steady state to a transient state is detected, the count-up of the counter C continues until the counter C reaches the value $\alpha$, even when the idle switch 16 is turned OFF (LL="0"). That is, when the idle switch 16 is turned OFF, the control proceeds via step 1802 to step 1804, which continues the count-up of the counter C.

When the counter C reaches the value $\alpha$, the flow from step 1805 to 1806 is switched to the flow from step 1805 to 1807. As a result, the air-fuel ratio feedback flag FB2 is set, thereby carrying out the second air-fuel ratio feedback control by the downstream-side $O_2$ sensor 15 again.

As explained above, a change of the engine from a steady state to a transient state is detected by the output LL of the idle switch 16, and thereafter for a second air-fuel ratio feedback control by the downstream-side $O_2$ sensor 15 is suspended.

Figure 19:
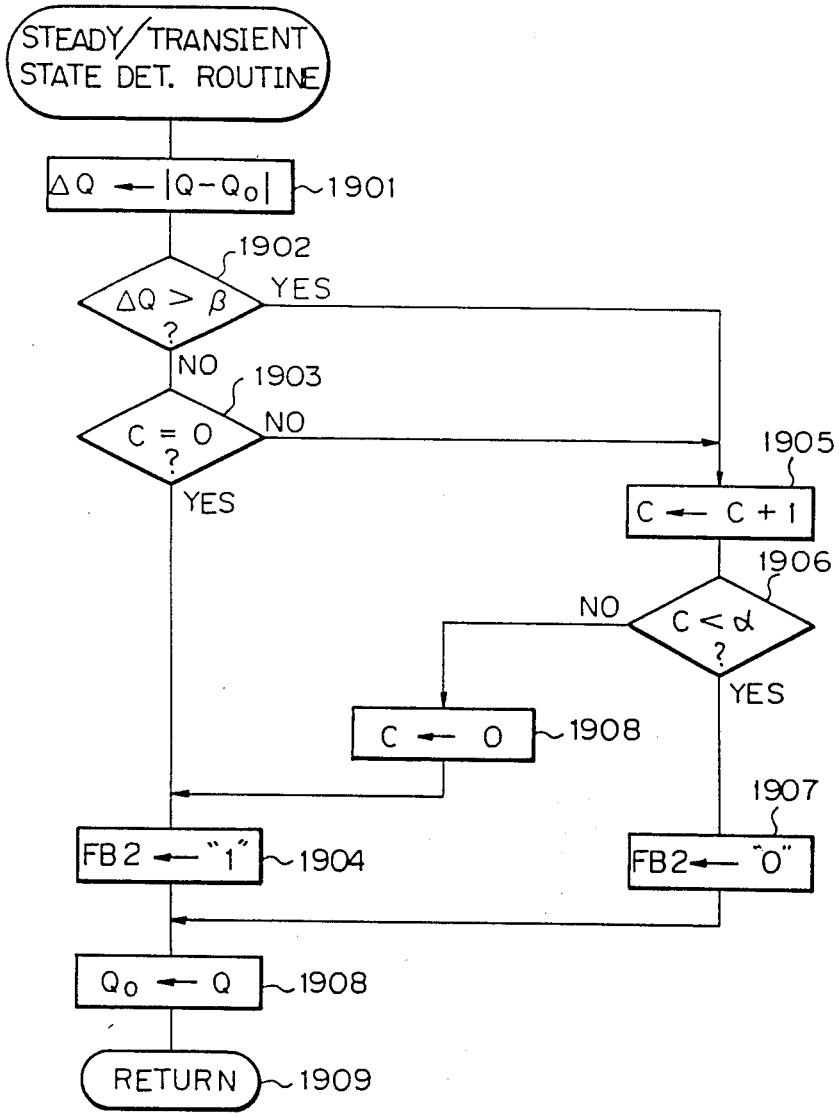

In FIG. 19, which is a modification of FIG. 18, steps 1902 through 1907 correspond to steps 1801 through 1806, respectively, of FIG. 18, and steps 1901 and 1908 are added thereto. That is, at step 1901, the intake air amount Q is read out of the RAM 105, and at step 1901, the difference $\Delta Q$ between the intake air amount Q and the previous intake air amount $Q_0$ is calculated by $$\Delta Q \leftarrow Q - Q_0.$$

Then at step 1902, a transient state of the engine is detected by determining whether or not $\Delta Q > \beta$ (definite valve). As a result, when the engine is switched from a steady state ($\Delta Q \leqq \beta$) to a transient state ($\Delta Q > \beta$), the counter C is imitiated to be counted up in the same way as in FIG. 18. Note that at step 1908, the previous intake air amount $Q_0$ is replaced by the current intake air amount Q, thereby preparing the next execution of the routine of FIG. 18.

As explained above, a change of the engine from a steady state to a transient state is detected by the change of the intake air amount Q, and thereafter, for a predetermined duration, the second air-fuel ratio feedback control by the downstream-side $O_2$ sensor 15 is suspended.

Figure 19A:
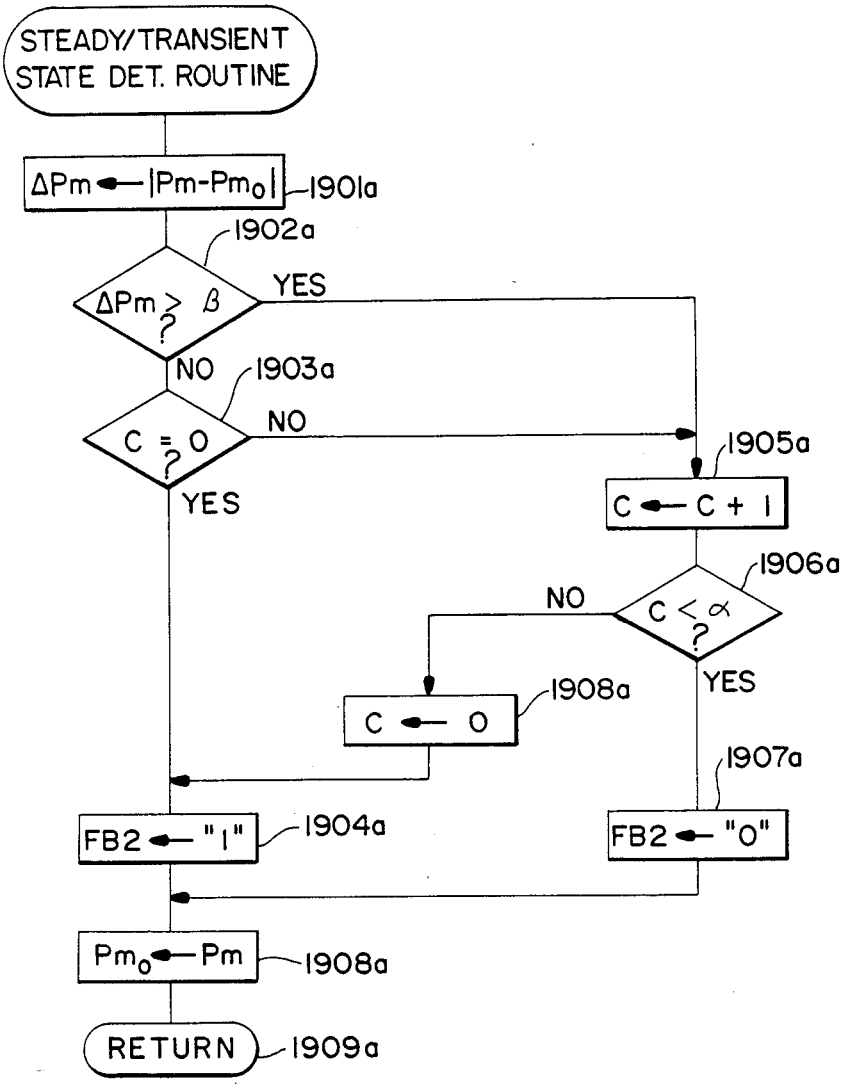
Figure 19B:
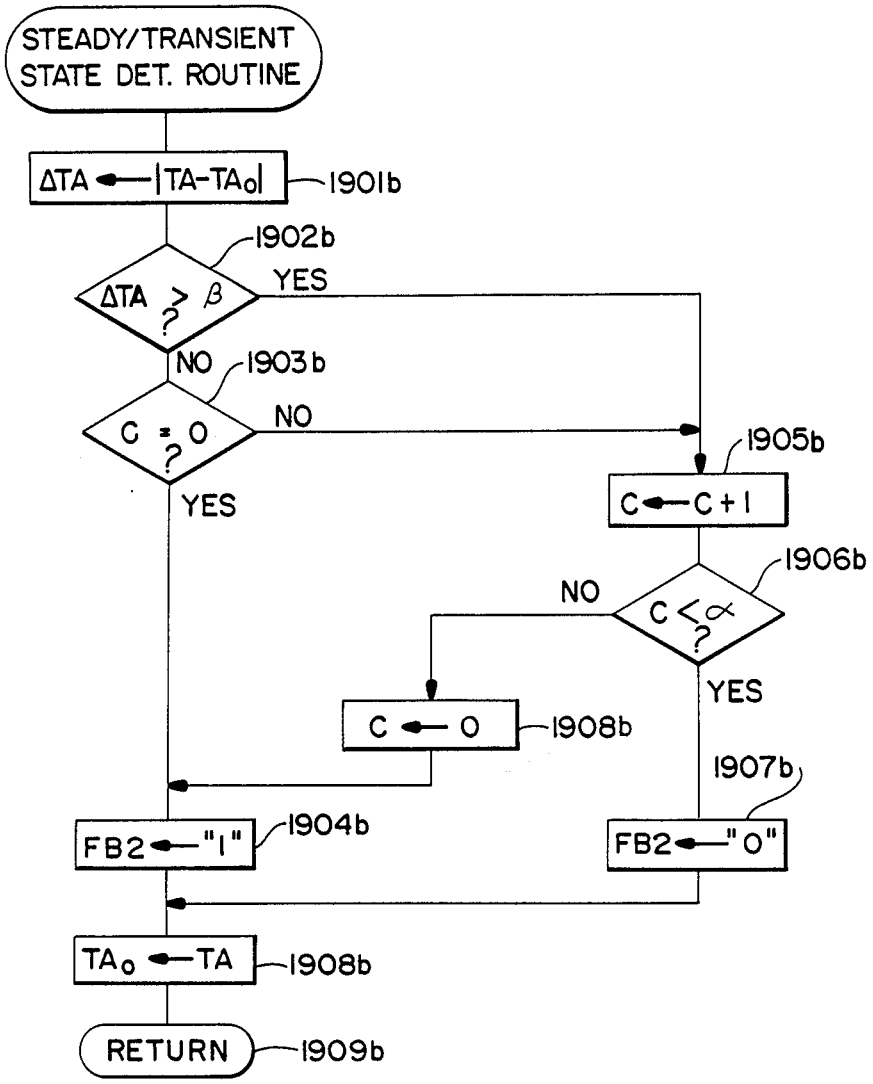
Figure 19C:
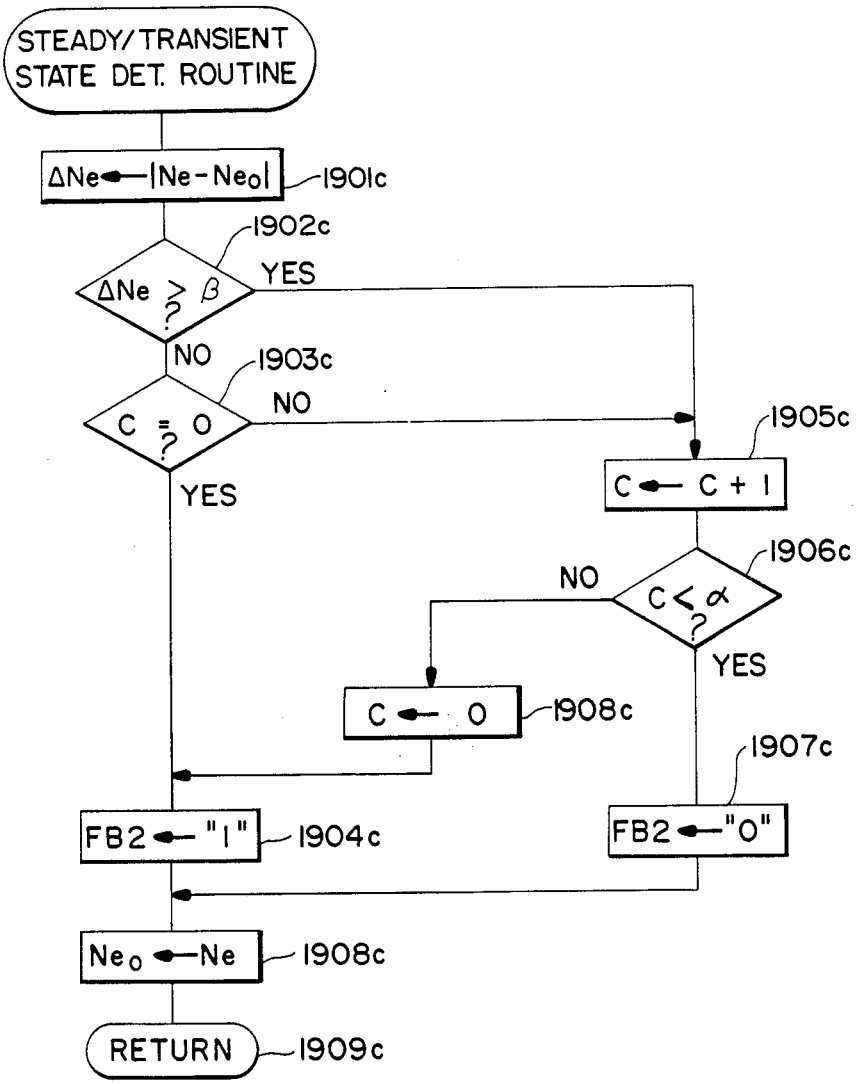
Figure 19D:
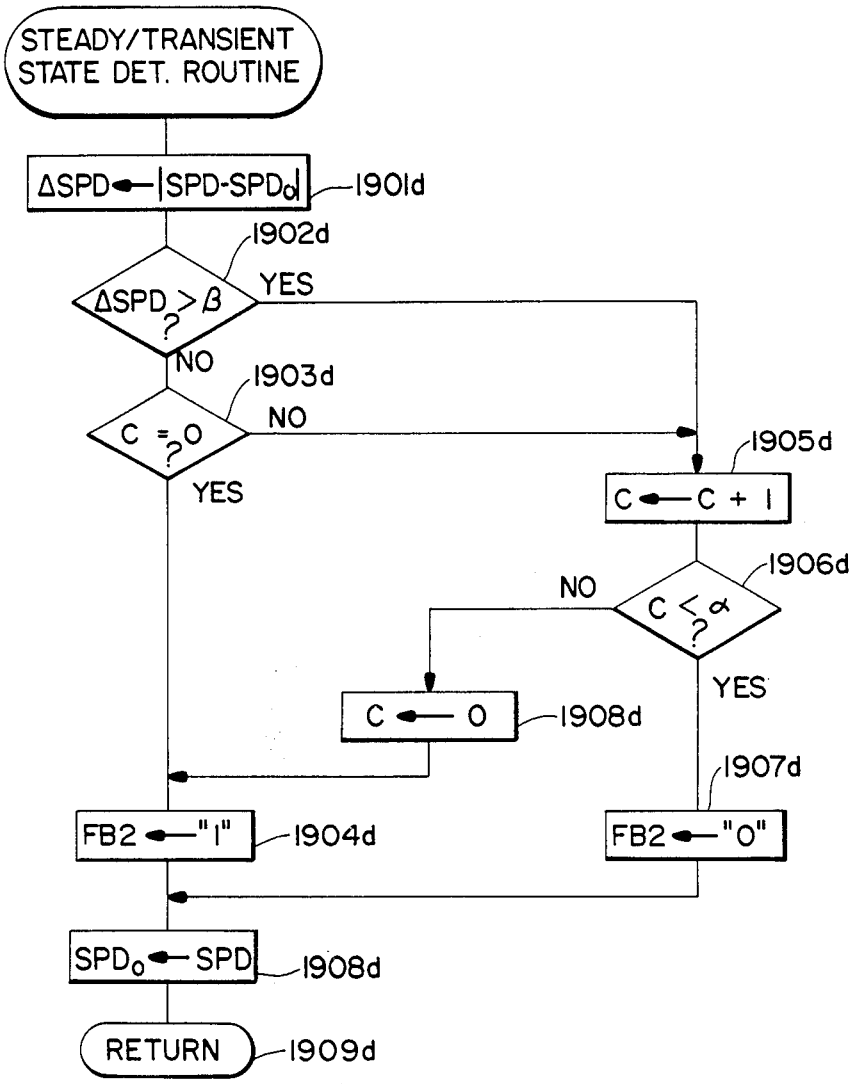

Note that, in FIG. 19, a change of the engine from a steady state to a transient state can be also detected by the change $\Delta PM$ of the intake air pressure Pm (FIG. 19A), the change $\Delta TA$ of an opening of the throttle valve 16 (FIG 19B), the change $\Delta Ne$ of the engine speed Ne (FIG. 19C), or the change $\Delta SPD$ of the vehicle speed SPD (FIG. 19D).

Figures 20A, 20B, 20C, 20D, 20E:
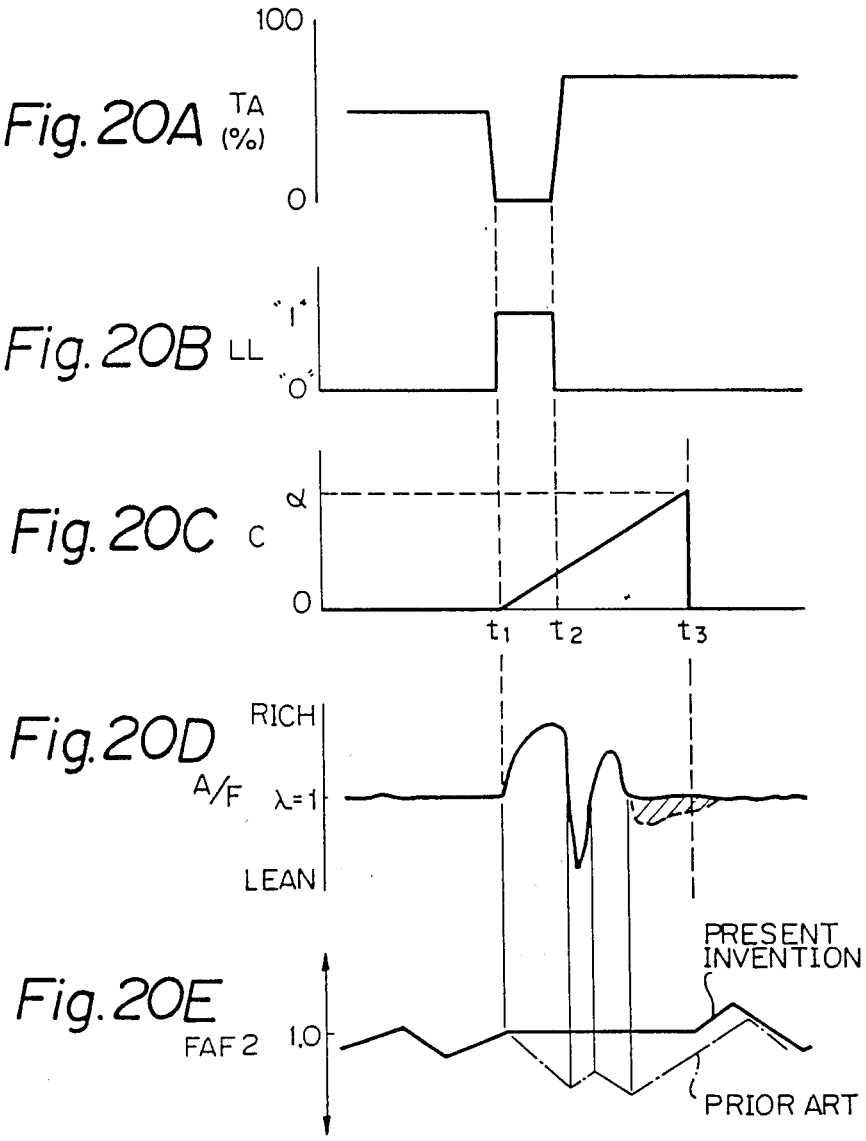
FIGS. 20A through 20E are timing diagrams explaining the flow charts of FIGS. 8, 12, 13, 18, 19 and 19A–19D.

FIGS. 20A through 20E are timing diagrams for explaining the effect obtained by the flow charts of FIGS. 8, 18 (or 19), 12, and 13. At time $t_1$, in order to change the gear, when the opening TA of the throttle valve 16 is reduced and the idle switch 17 is turned ON (LL="1") as shown in FIGS. 20A and 20B, a rich spike and a lean spike are generated at times $t_1$ and $t_2$, in the controlled air-fuel ratio as shown in FIG. 20D. As a result, the downstream-side $O_2$ sensor 15 generates a low-level lean signal. Therefore, in the prior art, the feedback control parameter, such as FAF2 controlled by the downstream-side $O_2$ sensor 15 follows the change of the air-fuel ratio, as indicated by a solid-dotted line in FIG. 20E. As a result, at time $t_3$ when the engine is taken out of the transient state, the feedback control parameter (in this case, FAF2) is deviated greatly from an optimum level such as 1.0, and accordingly, the air-fuel ratio is deviated greatly by the overcorrection during the transient state from an stoichiometric air-fuel ratio as indicated by a dotted line in FIG. 20D, thereby remarkably increasing the exhaust emissions such as HC, CO, or $NO_X$.

Contrary to this, in the present invention, at time $t_1$ when the engine is switched from a steady state to a transient state, the count-up of the counter C is initiated as shown in FIG. 20C, and the feedback control parameter FAF2 controlled by the downstream-side $O_2$ sensor 15 is caused to be a predetermined value, which is, in this case, a value of the value FAF2 immediately before the change of the engine state, as indicated by a solid line in FIG. 20E. Therefore, at time $t_3$ when the engine is taken out of the transient state, the air-fuel ratio is located at a suitable level, since no overcorrection is performed upon the air-fuel ratio as shown in FIG. 20D.

Figure 21:
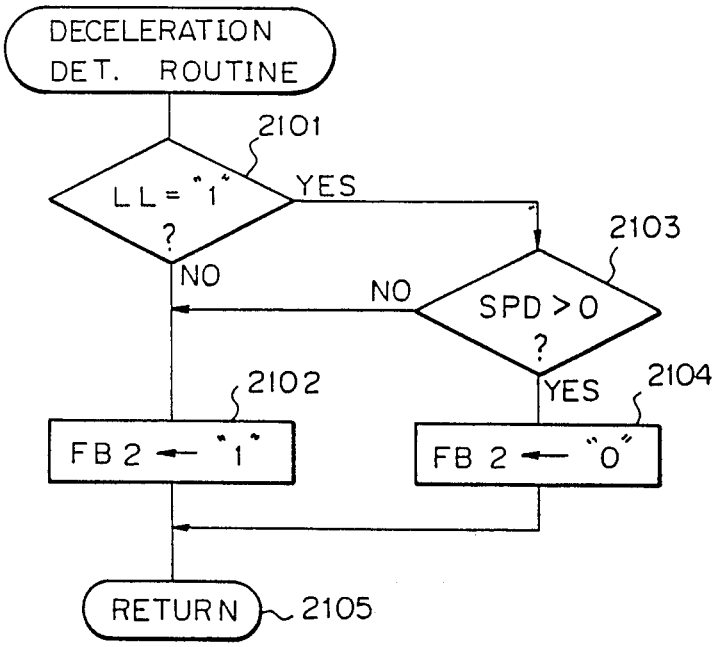

FIG. 21 is a routine for determining whether or not the engine is in a deceleration state, and is executed at every predetermined time period or crank angle. The routine of FIG. 21 is also used instead of the routine of FIG. 11.

At step 2101, the output LL of the idle switch 17 is fetched, and it is determined whether or not the throttle valve 16 is completely closed (LL="1"). Also, at step 2102, the vehicle speed SPD is fetched from the vehicle speed generating circuit 113, and it is determined whether or not the vehicle speed SPD is positive. As a result, it is determined that the engine is in a deceleration state only when the throttle valve 16 is completely closed (LL="1") and the vehicle speed SPD is positive. In this case, the control proceeds to step 2104, which sets the air-fuel ratio feedback flag FB2, thereby carrying out the second air-fuel ratio feedback control by the downstream-side $O_2$ sensor 15 as illustrated in FIG. 12 or 15. Otherwise, the control proceeds to step 2102, which clears the air-fuel ratio feedback flag FB2, so that the second air-fuel ratio feedback by the downstream-side $O_2$ sensor 15 is not carried out.

Then, the air-fuel ratio feedback flag FB2 is stored in the RAM 105, and the routine of FIG. 21 is completed at step 2105.

Note that the determination of a deceleration state can be also carried out by the following conditions:

(i) the intake air amount Q is smaller than a predetermined amount and the vehicle speed SPD is positive;

(ii) the intake air pressure PM is smaller than a predetermined pressure and the vehicle speed SPD is positive; or (iii) the opening of the throttle valve 16 is smaller than a predetermined opening and the vehicle speed SPD is positive.

Figures 22A, 22B, 22C, 22D, 22E, 22F, 22G:
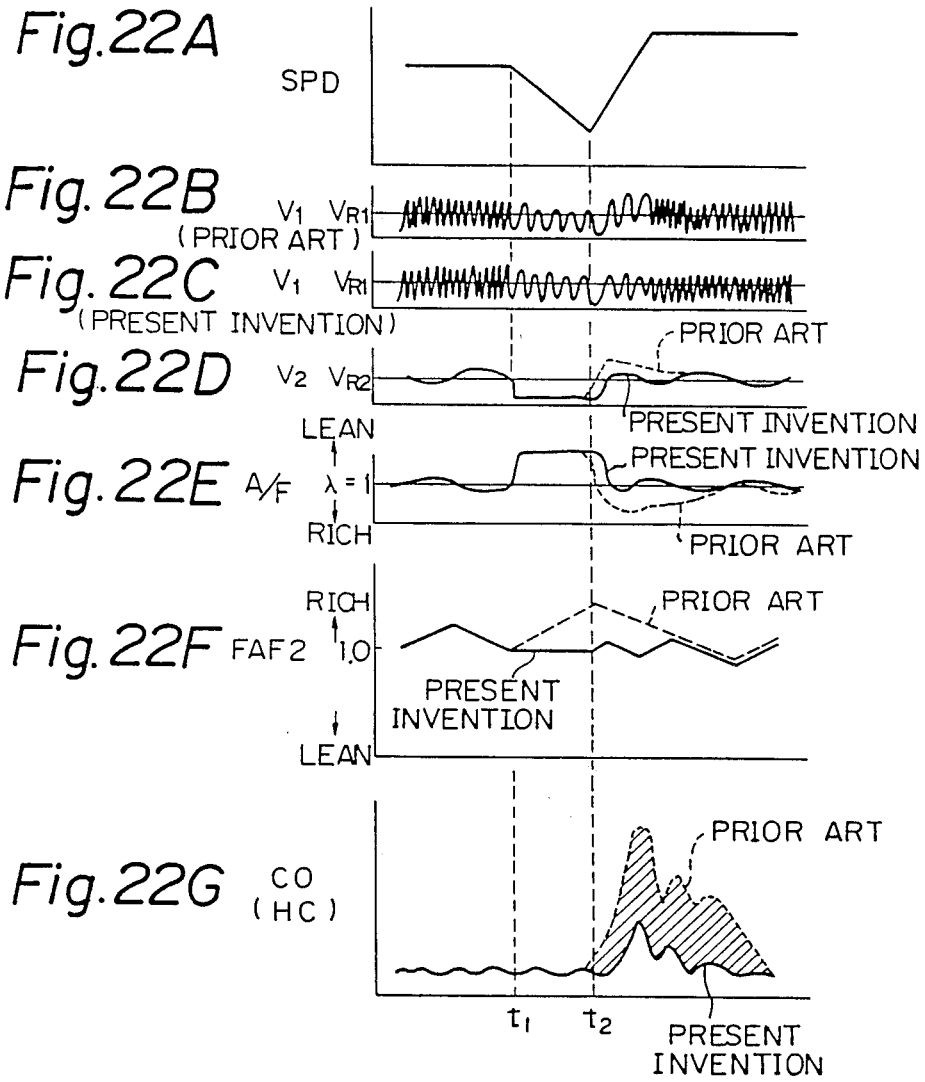
(PRIOR ART) Fig.22C
FIGS. 22A through 22G are timing diagrams explaining the flow chart of FIGS. 8, 12, 13, and 21.

FIGS. 22A through 22G are timing diagrams for explaining the effect obtained by the flow charts of FIGS. 8, 21, 12, and 13. That is, as shown in FIG. 22A, at time $t_1$, when the vehicle speed SPD is reduced, thereby entering a deceleration state, the air-fuel ratio in the vicinity of the downstream-side $O_2$ sensor 15 is rapidly changed toward the lean side as shown in FIG. 22E, and accordingly, the downstream-side $O_2$ sensor 15 generates a low-level lean signal as shown in FIG. 22D. As a result, in the prior art, the air-fuel ratio feedback parameter (which is, in this case, FAF2) controlled by the downstream-side $O_2$ sensor 15 is corrected toward the rich side as indicated by a dotted line in FIG. 22F. Therefore, at time $t_2$, when the engine is switched from a deceleration state to an acceleration state, th air-fuel feedback parameter FAF2 is greatly deviated from an optimum level, as shown in FIG. 22F, and as a result and as is apparent from the output $V_1$ of the upstream-side $O_2$ sensor 13 as shown in FIG. 22B, the output $V_2$ of the downstream-side $O_2$ sensor 15 as shown in FIG. 22D, and the air-fuel ratio is as shown in FIG. 22E. The air-fuel ratio is caused to remain at the rich side for a long time by the overcorrection of the air-fuel ratio during this deceleration state, thus remarkably increasing the exhaust emissions such as CO and HC.

Contrary to this, in the present invention, at time $t_1$, when the engine is switched to a deceleration state, the feedback control parameter FAF2 controlled by the downstream-side $O_2$ sensor 15 is caused to be a predetermined value, which is, in this case, a value of the value FAF2 immediately before the deceleration as indicated by a solid line in FIG. 22F. Therefore, at time $t_2$, when the engine is switched from a deceleration state to an acceleration state, as is apparent from the output $V_1$ of the upstream-side $O_2$ sensor 13 as shown in FIG. 22C, the output $V_2$ of the upstream-side $O_2$ sensor 15 as shown in FIG. 22D, and the air-fuel ratio is as shown in FIG. 22E. Accordingly, the air-fuel ratio is located at a suitable level, since no overcorrection is performed upon the air-fuel ratio, thus reducing the exhaust emissions such as CO and HC.

Figure 23:
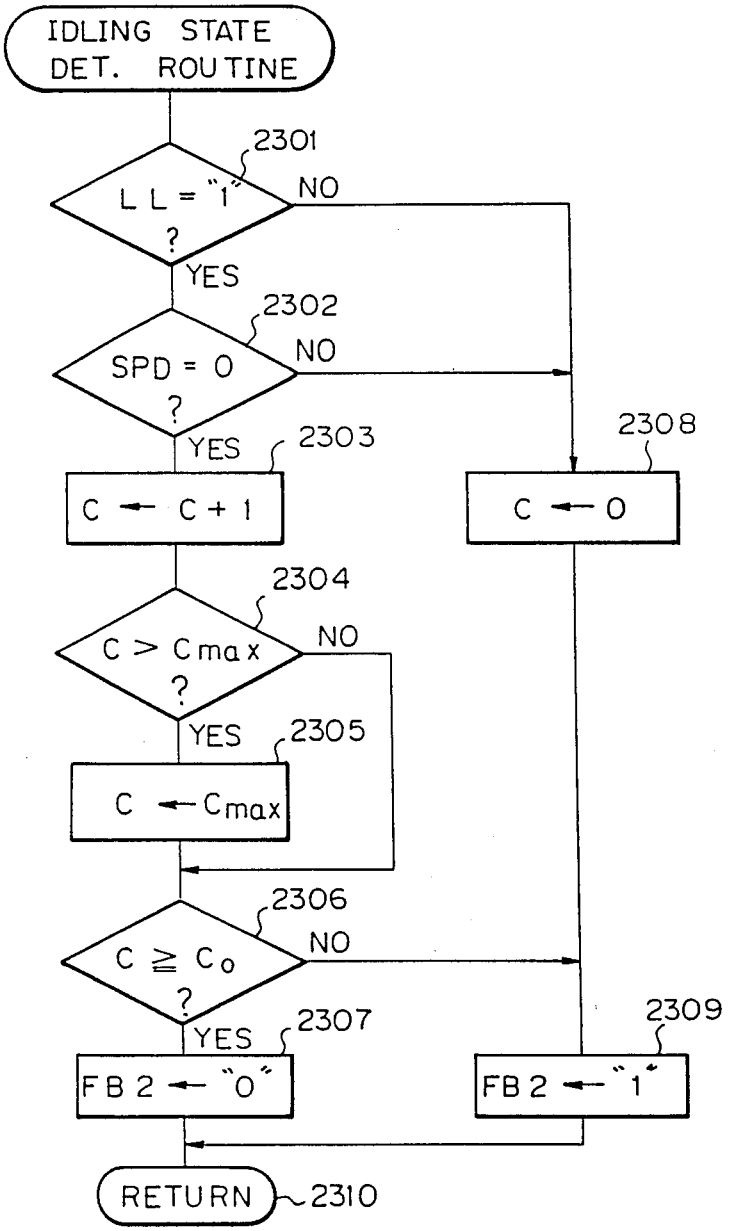

FIG. 23 is a routine for determining whether or not an idling state continues for a time period longer than a predetermined period, and is executed at every predetermined time period such as 4 ms. The routine of FIG. 18 is used instead of the routine of FIG. 11.

At step 2301, the output LL of the idle switch 17 is fetched, and it is determined whether or not the throttle valve 16 is completely closed (LL="1"). Also, at step 2302, the vehicle speed SPD is fetched from the vehicle speed generating circuit 113, and it is determined whether or not the vehicle speed SPD is zero. As a result, it is determined that the engine is in an idling state only when the throttle valve 16 is completely closed (LL="1") and the vehicle speed SPD is zero. In this case, the control proceeds to step 2303, which counts up a counter C by 1, and at steps 2304 and 2305, the counter C is guarded by a maximum value $C_{max}$. On the other hand, if LL="0", or if SPD>0, the control proceeds to step 2308 which clears the counter C.

At step 2306, it is determined whether or not the duration of an idling state designated by the counter C is longer than a predetermined duration designated by $C_0$. If $C \geqq C_0$, the control proceeds to step 2307 which sets the air-fuel ratio feedback flag FB2, thereby carrying out the second air-fuel ratio feedback control by the downstream-side $O_2$ sensor 15 as illustrated in FIGS. 12 or 15. Otherwise, the control proceeds to step 2102, which clears the air-fuel ratio feedback flag FB2, so that the second air-fuel ratio feedback by the downstream-side $O_2$ sensor 15 is not carried out. Also, the flow at step 2308 proceeds to step 2309.

Then, the air-fuel ratio feedback flag FB2 is stored in the RAM 105, and the routine of FIG. 23 is completed at step 2310.

Note that the determination at step 2301 of FIG. 23 can be carried out by determining whether or not the neutral switch is turned ON, in the case of an automatic transmission vehicle. Also, the determination of an idling state can be carried out by the following conditions:

(i) the engine speed Ne is lower than a predetermined speed such as 900 rpm and the intake air amount Q is smaller than a predetermined amount;

(ii) the engine speed Ne is lower than a predetermined speed such as 900 rpm and the intake air pressure PM is smaller than a predetermined pressure such as 260 mmHg; or (iii) the engine speed Ne is lower than a predetermined speed such as 900 rpm and the opening TA of the throttle valve 16 is smaller than a predetermined opening.

Further, the determination of the duration of an idling state can be carried out by determining whether or not the condition $Ne \leqq No$ (such as 900 rpm) or LL="1" continues for a time period longer than 10s under the following conditions:

(i) the exhaust gas temperature is lower than a predetermined temperature such as 500° C.;

(ii) the coolant temperature THW is lower than a predetermined temperature such as 80° C.; or (iii) the temperature of the downstream-side $O_2$ sensor 15 is lower than a predetermined temperature 400° C.

Figures 24A, 24B, 24C, 24D, 24E, 24F, 24G:
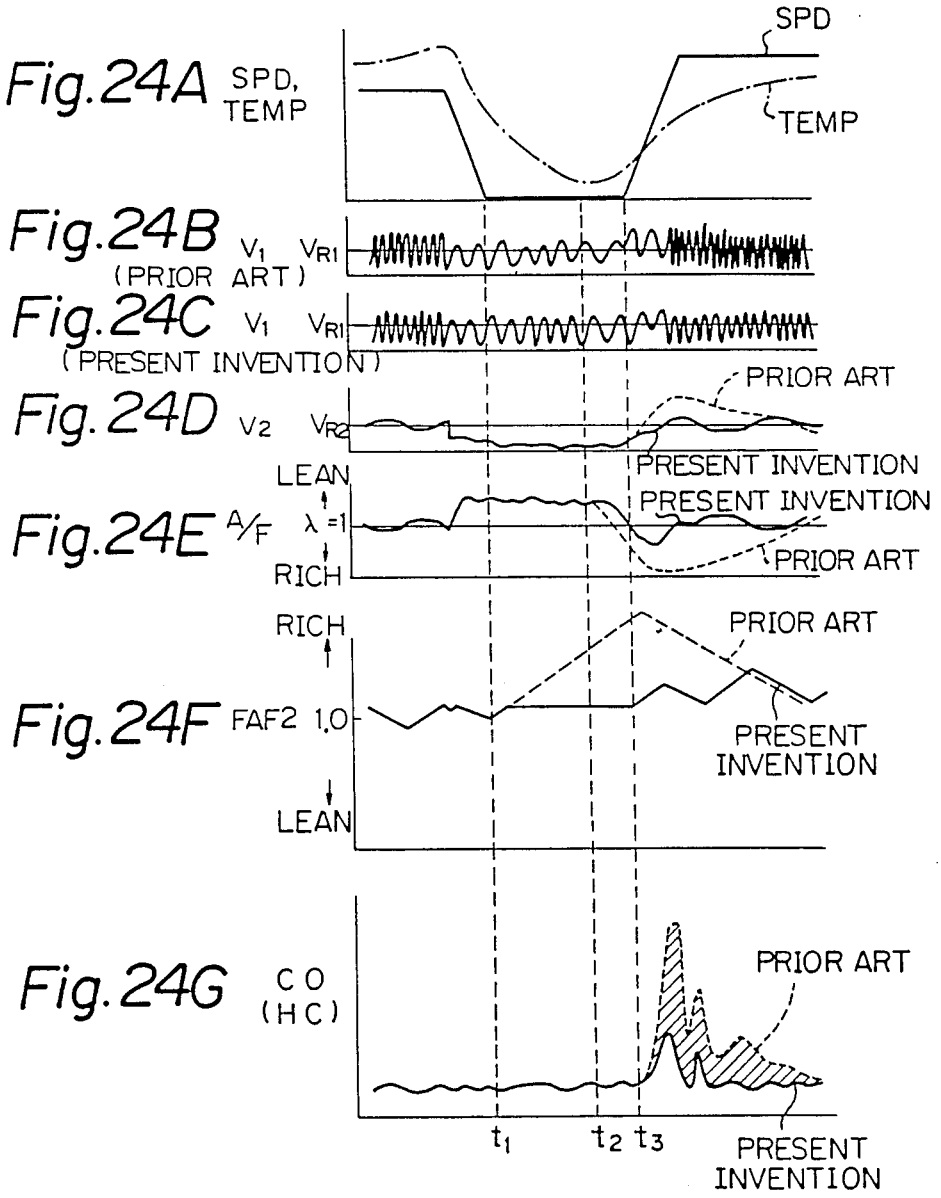
(PRIOR ART) Fig.24C
PRIOR ART Fig.24F
FIGS. 24A through 24G, 25A through 25G, 26A through 26G, and 27A through 27G are timing diagrams explaining the flow chart of FIGS. 8, 12, 13, and 23.

FIGS. 24A through 24G are diagrams for explaining the effect obtained by the flow charts of FIGS. 8, 23, 12, and 13. Here, it is assumed that the base air-fuel ratio is lean and that the signal processing circuits 111 and 112 are flow-out type (see: FIG. 3A). In this case, in the prior art, when the engine enters an idling state, the vehicle speed SPD is reduced, and the temperature TEMP of the downstream-side $O_2$ sensor 15 is reduced as shown in FIG. 24A. Then, also at time $t_1$, since the air-fuel ratio in the vicinity of the downstream-side $O_2$ sensor 15 is lean as shown in FIG. 24E, the downstream-side $O_2$ sensor 15 generates a low-level lean signal as shown in FIG. 24D. As a result, the air-fuel ratio feedback parameter (in this case, FAF2) controlled by the downstream-side $O_2$ sensor 15 is corrected toward the rich side as shown in FIG. 24F. In addition, at time $t_2$, when the temperature of the downstream-side $O_2$ sensor 15 is reduced, thereby deenergizing it, the flow-out type signal processing circuit 112 generates a lean signal regardless of the air-fuel ratio, thus further correcting the air-fuel ratio on the rich side. Therefore, at time $t_3$, when the engine is taken out of the idling state, the air-fuel feedback parameter FAF2 is greatly deviated from an optimum level as shown in FIG. 24F, and as a result, as is apparent from the output $V_1$ of the upstream-side $O_2$ sensor 13 as shown in FIG. 24B, the output $V_2$ of the downstream-side $O_2$ sensor 15 as shown in FIG. 24D, and the air-fuel ratio is as shown in FIG. 24E. The air-fuel ratio is caused to remain at the rich side for a long time by the overcorrection of the air-fuel ratio during this idling state, thus remarkably increasing the exhaust emissions such as CO and HC.

Contrary to this, in the present invention, at time $t_1$, when the duration of an idling state reaches a predetermined duration ($C=C_0$), the feedback control parameter FAF2 controlled by the downstream-side $O_2$ sensor 15 is caused to be a predetermined value, which is, in this case, a value of the value FAF2 immediately before time $t_1$ as indicated by a solid line in FIG. 24F. Therefore, at time $t_3$, when the engine is taken out of the idling state, as is apparent from the output $V_1$ of the upstream-side $O_2$ sensor 13 as shown in FIG. 24C, the output $V_2$ of the upstream-side $O_2$ sensor 15 as shown in FIG. 24D, and the air-fuel ratio is as shown in FIG. 24E. Accordingly, the air-fuel ratio is located at a suitable level, since no overcorrection is performed upon the air-fuel ratio, thus reducing the exhaust emissions such as CO and HC.

Figures 25A, 25B, 25C, 25D, 25E, 25F, 25G:
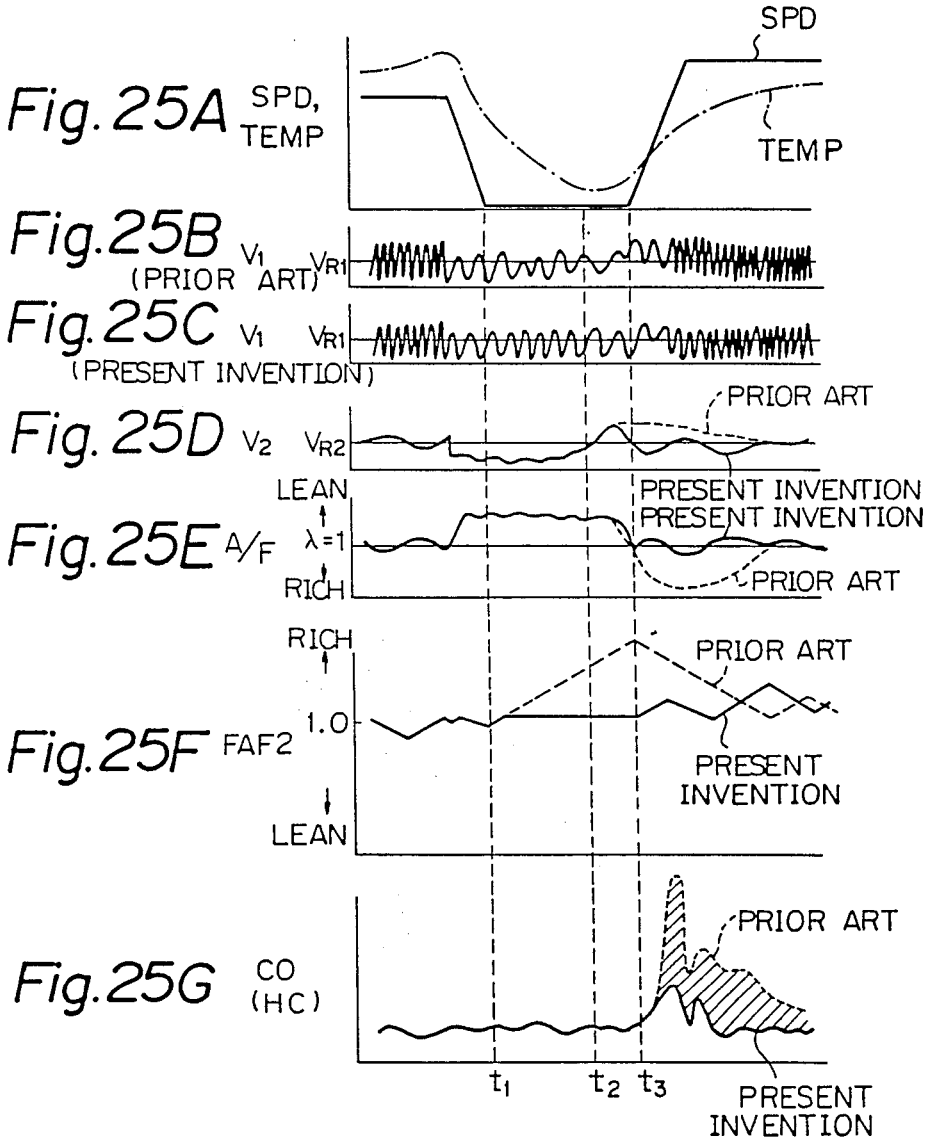
(PRIOR ART) Fig. 25C
PRIOR ART Fig. 25E
PRIOR ART Fig. 25F

FIGS. 25A through 25G are also timing diagrams for explaining the effect obtained by the flow charts of FIGS. 8, 23, 12, and 13. Here, it is assumed that the base air-fuel ratio is lean and the signal processing circuits 111 and 112 are flow-in type (see: FIG. 3B). In this case, in the prior art, when the temperature of the downstream-side $O_2$ sensor 15 is sufficiently reduced, thereby deenergizing it, the flow-in type signal processing circuit 112 generates a rich signal regardless of the air-fuel ratio, thus relaxing the overcorrection of the air-fuel ratio on the rich side. Further, when an idling state continues, the air-fuel ratio is corrected on the lean side, however, in the case as illustrated in FIG. 25F, the air-fuel ratio is overcorrected toward the rich side. In any case, at time $t_3$, when the engine is taken out of the idling state, the air-fuel feedback parameter FAF2 is greatly deviated from an optimum level as shown in FIG. 25F, and as a result, the air-fuel ratio is caused to remain at the rich side for a long time by the overcorrection of the air-fuel ratio during this idling state, thus remarkably increasing the exhaust emissions such as CO and HC.

Contrary to this, in the present invention, at time $t_1$, when the duration of an idling state reaches a predetermined duration ($C=C_0$), the feedback control parameter FAF2 controlled by the downstream-side $O_2$ sensor 15 is caused to be a predetermined value, which is, in this case, a value of the value FAF2 immediately before time $t_1$ as indicated by a solid line in FIG. 25F. Thus, the exhaust emissions such as CO and HC, or $NO_x$ can be reduced.

Figures 26A, 26B, 26C, 26D, 26E, 26F, 26G:
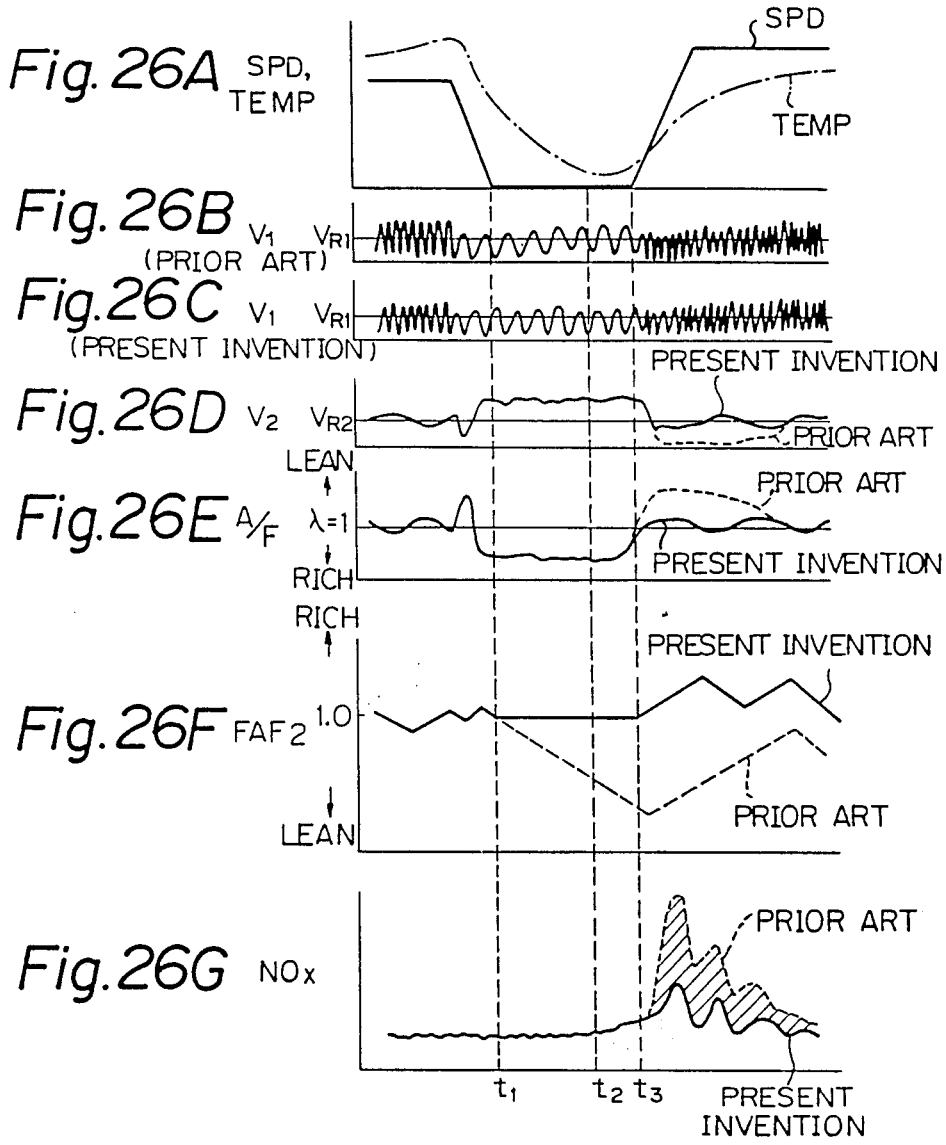
(PRIOR ART) Fig. 26C
PRIOR ART Fig. 26E
PRIOR ART Fig. 26G

FIGS. 26A through 26G are further timing diagrams for explaining the effect obtained by the flow charts of FIGS. 8, 23, 12, and 13. Here, it is assumed that the base air-fuel ratio is rich and the signal processing circuits 111 and 112 are flow-in type (see: FIG. 3B). In this case, in the prior art, when the engine enters an idling state, the vehicle speed SPD is reduced, and the temperature TEMP of the downstream-side $O_2$ sensor 15 is reduced as shown in FIG. 26A. Then, also at time $t_1$, since the air-fuel ratio in the vicinity of the downstream-side $O_2$ sensor 15 is rich as shown in FIG. 26E, the downstream-side $O_2$ sensor 15 generates a high-level rich signal as shown in FIG. 26D. As a result, the air-fuel ratio feedback parameter (in this case, FAF2) controlled by the downstream-side $O_2$ sensor 15 is corrected toward the lean side as shown in FIG. 26F. In addition, at time $t_2$, when the temperature of the downstream-side $O_2$ sensor 15 is reduced, thereby deenergizing it, the flow-in type signal processing circuit 112 generates a rich signal regardless of the air-fuel ratio, thus further correcting the air-fuel ratio on the lean side. Therefore, at time $t_3$, when the engine is taken off from the idling state, the air-fuel feedback parameter FAF2 is greatly deviated from an optimum level as shown in FIG. 26F, and as a result and as is apparent from the output $V_1$ of the upstream-side $O_2$ sensor 13 as shown in FIG. 26B, the output $V_2$ of the downstream-side $O_2$ sensor 15 as shown in FIG. 26D, and the air-fuel ratio is as shown in FIG. 26E. Accordingly, the air-fuel ratio is caused to remain at the lean side for a long time by the overcorrection of the air-fuel ratio during this idling state, thus remarkably increasing the exhaust emissions such as $NO_x$.

Contrary to this, in the present invention, at time $t_1$, when the duration of an idling state reaches a predetermined duration ($C=C_0$), the feedback control parameter FAF2 controlled by the downstream-side $O_2$ sensor 15 is caused to be a predetermined value, which is, in this case, a value of the value FAF2 immediately before time $t_1$ as indicated by a solid line in FIG. 26F. Therefore, at time $t_3$, when the engine is taken out of the idling state, as is apparent from the output $V_1$ of the upstream-side $O_2$ sensor 13 as shown in FIG. 26C, the output $V_2$ of the upstream-side $O_2$ sensor 15 is as shown in FIG. 26D, and the air-fuel ratio is as shown in FIG. 26E. Accordingly, the air-fuel ratio is located at a suitable level, since no overcorrection is performed upon the air-fuel ratio, thus reducing the exhaust emissions such as $NO_x$.

Figures 27A, 27B, 27C, 27D, 27E, 27F, 27G:
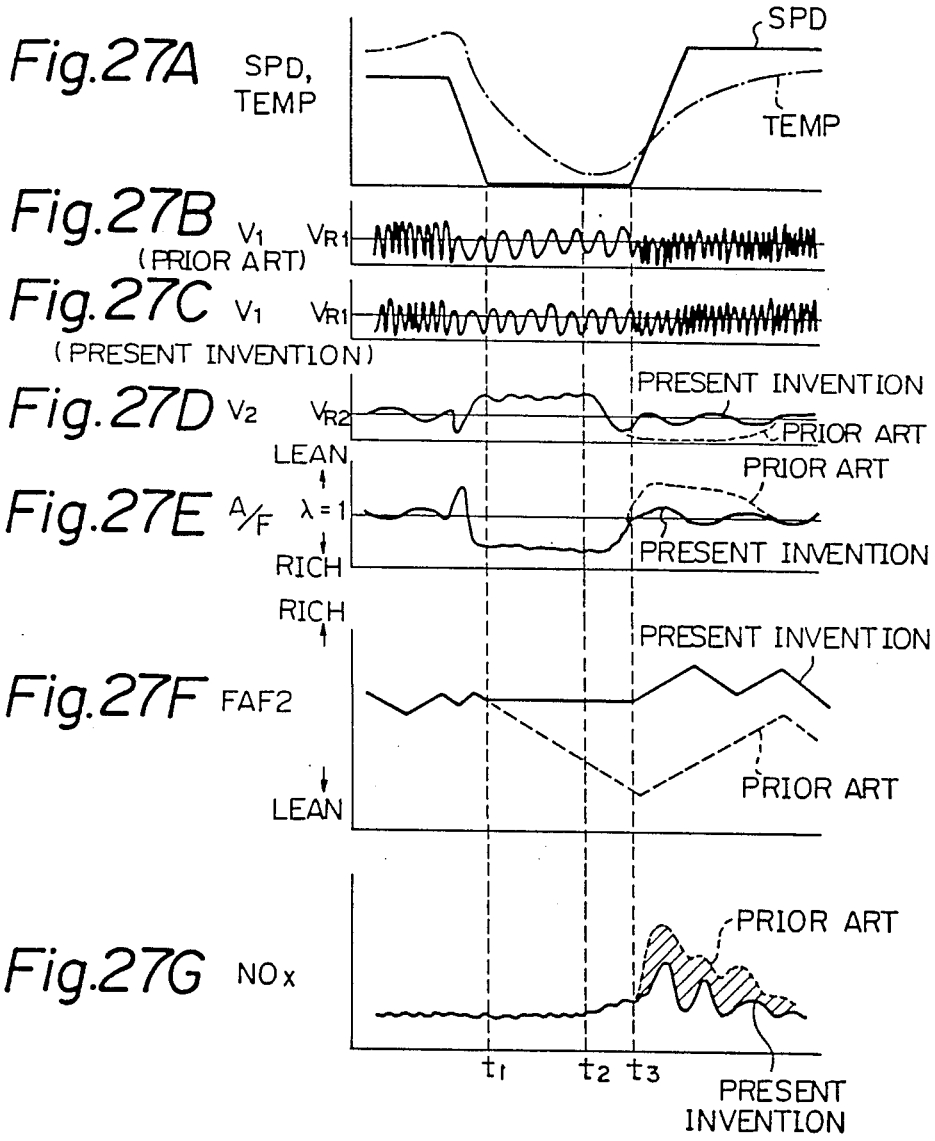
(PRIOR ART) Fig.27C
PRIOR ART Fig.27E
PRIOR ART Fig.27G

FIGS. 27A through 27G are still timing diagrams for explaining the effect obtained by the flow charts of FIGS. 8, 23, 12, and 13. Here, it is assumed that the base air-fuel ratio is rich and the siqnal processing circuits 111 and 112 are flow-out type (see: FIG. 3A). In this case, in the prior art, when the temperature of the downstream-side $O_2$ sensor 15 is sufficientlv reduced, thereby deenergizing it, the flow-out type signal processing circuit 112 generates a lean signal regardless of the air-fuel ratio, thus relaxing the overcorrection of the air-fuel ratio on the lean side. Further, when an idling state continues, the air-fuel ratio is corrected on the rich side, however, in the case as illustrated in FIG. 27F, the air-fuel ratio is overcorrected toward the lean side. In any case, at time $t_3$, when the engine is taken out of the idling state, the air-fuel feedback parameter FAF2 is greatly deviated from an optimum level as shown in FIG. 27F, and as a result, the air-fuel ratio is caused to remain at the rich side for a long time by the overcorrection of the air-fuel ratio during this idling state, thus remarkably increasing the exhaust emissions such as $NO_x$.

Contrary to this, in the present invention, at time $t_1$, when the duration of an idling state reaches a predetermined duration ($C=C_0$), the feedback control parameter FAF2 controlled by the downstream-side $O_2$ sensor 15 is caused to be a predetermined value, which is, in this case, a value of the value FAF2 immediately before time $t_1$ as indicated by a solid line in FIG. 27F. Thus, the exhaust emissions such as $NO_x$, or CO and HC can be reduced.

Figure 28:
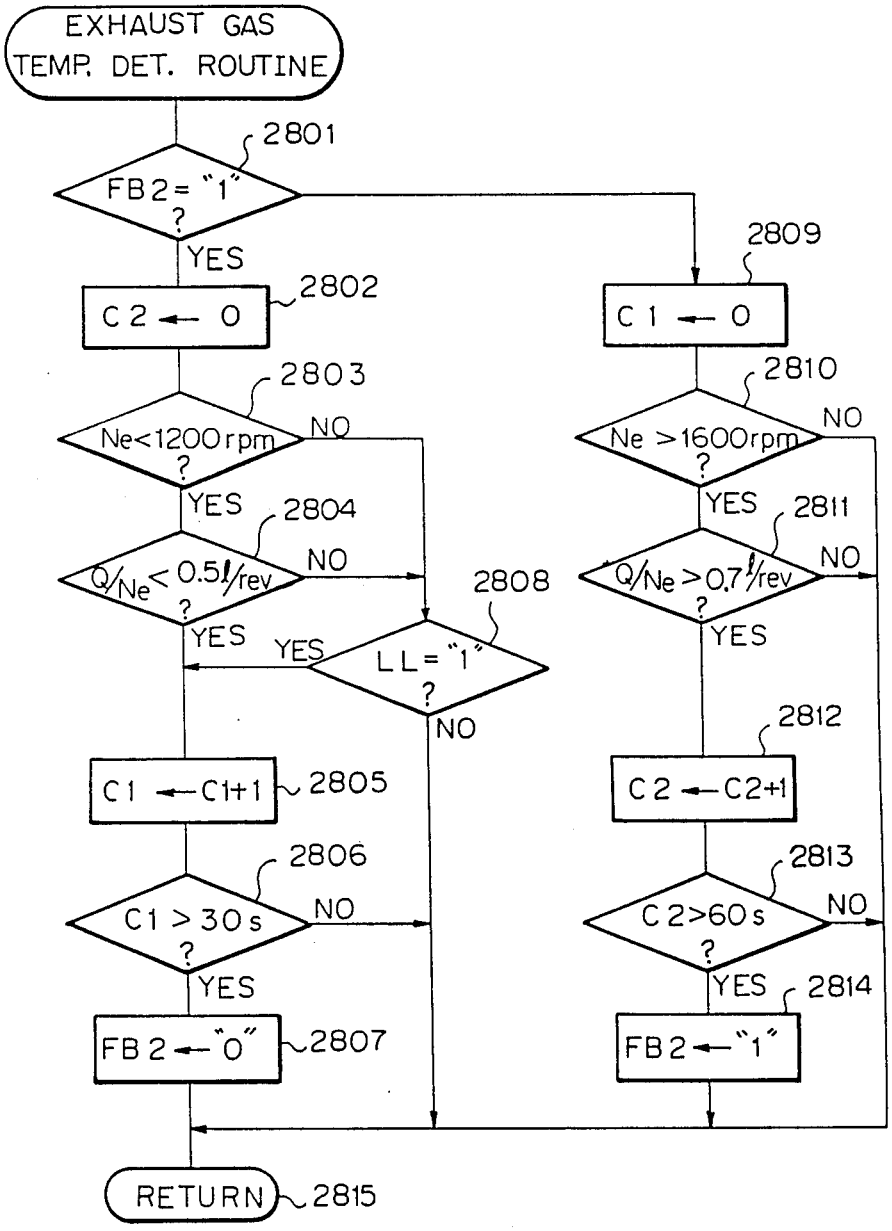

FIG. 28 is a routine for determining the exhaust gas temperature, executed at every predetermined time period or crank angle. The routine of FIG. 28 is used instead of the routine of FIG. 11.

In FIG. 28, it is assumed that the air-fuel ratio feedback flag FB2 is "0", i.e., the air-fuel ratio feedback control by the downstream-side $O_2$ sensor 15 is suspended. Then, the flow at steps 2802 through 2808 is carried out. That is, at step 2802, a counter C2 is cleared. Then, at step 2803, the engine speed Ne is read out of the RAM 105, and it is determined whether the engine speed Ne is lower than a predetermined speed such as 1200 rpm. At step 2804, an intake air amount per one engine revolution, i.e., Q/Ne, is calculated, and it is determined whether or not the value Q/Ne is smaller than a predetermined value such as 0.5 l When $Ne<1200$ rpm and $Q/Ne<0.5$ l/rev, the control proceeds to step 2805, which counts up a counter C1. Also, when the throttle valve 16 is completely closed (LL="1"), the control proceeds to step 2805. That is, when $Ne<1200$ rpm and $Q/Ne<0.5$ l/rev, or when LL="1", the temperature of the exhaust gas may be reduced, so that the duration of such a state is counted by the counter C1. Then, at step 2806, it is determined whether or not the duration designated by the counter C1 exceeds a predetermined period such as 30s. Only if $C1>30$s, does this mean that the temperature of the exhaust gas is sufficiently reduced thereby deenergizing the downstream-side $O_2$ sensor 15, and accordingly, at step 2807, the air-fuel ratio feedback flag FB2 is cleared, thus suspending the second air-fuel ratio feedback control by the downstream-side $O_2$ sensor 15.

On the other hand, when the air-fuel ratio feedback flag FB2 is "0", i.e., the air-fuel ratio feedback control by the downstream-side $O_2$ sensor 15 is suspended. Then, the flow at steps 2809 through 2814 is carried out. That is, at step 2809, the counter C2 is cleared. Then, at step 2810, the engine speed Ne is read out of the RAM 105, and it is determined whether the engine speed Ne is higher than a predetermined speed such as 1600 rpm. At step 2811, an intake air amount per one engine revolution, i.e., Q/Ne is calculated, and it is determined whether or not the value Q/Ne is larger than a predetermined value such as 0.7 l/rev. Only when $Ne>1600$ rpm and $Q/Ne>0.7$ l/rev, the control proceeds to step 2812, which counts up the counter C2. That is, when $Ne>1600$ rpm and $Q/Ne>0.7$ l/rev, the temperature of the exhaust gas may be increased, so that the duration of such a state is counted by the counter C2. Then, at step 2813, it is determined whether or not the duration designated by the counter C2 exceeds a predetermined period such as 60s. Only if $C2>60$s, does this mean that the temperature of the exhaust gas is sufficiently increased thereby energizing the downstream-side $O_2$ sensor 15, and accordingly, at step 2814, the air-fuel ratio feedback flag FB2 is set, thus restarting the second air-fuel ratio feedback control by the downstream-side $O_2$ sensor 15.

Thus, according to FIG. 28, when a predetermined state defined by Ne and Q/Ne (or LL="1") is established, the second air-fuel ratio feedback control by the downstream-side $O_2$ sensor 15 is carried out with a delay, while when such a predetermined state defined by Ne and Q/Ne (or LL="1") is reset, the second air-fuel ratio feedback control by the downstream-side $O_2$ sensor 15 is suspended with a delay. This will be also helpful in stabilizing the controlled air-fuel ratio.

Note that the calculated parameters FAF1 and FAF2, or FAF1, RSR, and RSL can be stored in the backup RAM 106, thereby improving drivability at the re-starting of the engine.

Figure 29:
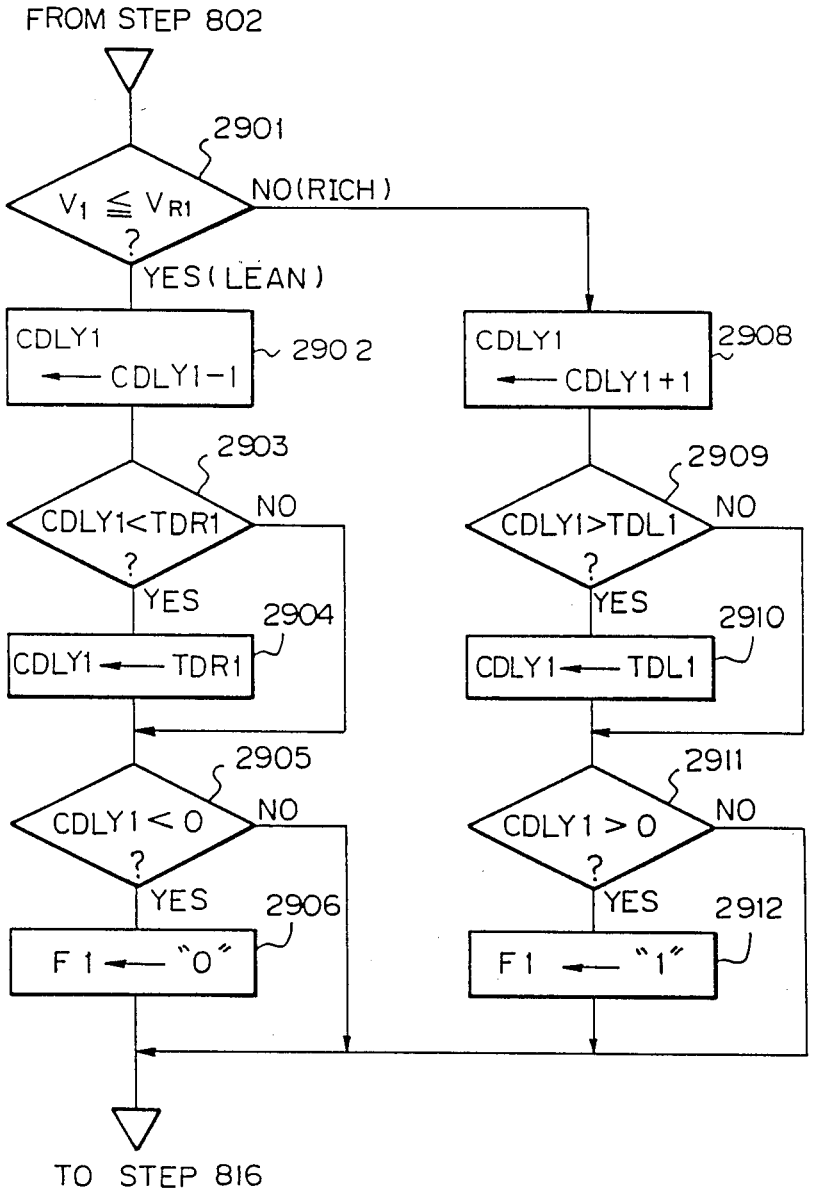

In FIG. 29, which is a modification of FIG. 8, a delay operation different from that of FIG. 8 is carried out. That is, at step 2901, if $V_1 \leqq V_{R1}$, which means that the current air-fuel ratio is lean, the control proceeds to step 2902 which decreases a first delay counter CDLY1 by 1. Then, at steps 2903 and 2904, the first delay counter CDLY1 is guarded by a minimum value TDR1. Note that TDR1 is a rich delay time period for which a lean state is maintained even after the output of the upstream-side $O_2$ sensor 13 is changed from the lean side to the rich side, and is defined by a negative value.

Note that, in this case, if CDLY1>0, this means that the delayed air-fuel ratio is rich, while, if CDLY1≦0, this means that the delayed air-fuel ratio is lean.

Therefore, at step 2905, it is determined whether or not CDLY<0 is satisfied. As a result, if CDLY1≦0, the first air-fuel ratio flag F1 is caused to be "0" (lean). Otherwise, the first air-fuel ratio flag F1 is unchanged, that is, the flag F1 remains at "1".

On the other hand, if $V_1 > V_{R1}$, which means that the current air-fuel ratio is rich, the control proceeds to step 2904 which increases the first delay counter CDLY1 by 1. Then, at steps 2909 and 2910, the first delay counter CDLY1 is guarded by a maximum value TDL1. Note that TDL1 is a lean delay time period for which a rich state is maintained even after the output of the upstream-side $O_2$ sensor 13 is changed from the rich side to the lean side, and is defined by a positive value.

Then, at stap 2911, it is determined whether or not CDLY>0 is satisfied. As a result, if CDLY>0, the first air-fuel ratio flag F1 is caused to be "1" (rich). Otherwise, the first air-fuel ratio flag F1 is unchanged, that is, the flag F1 remains at "0".

Figure 30:
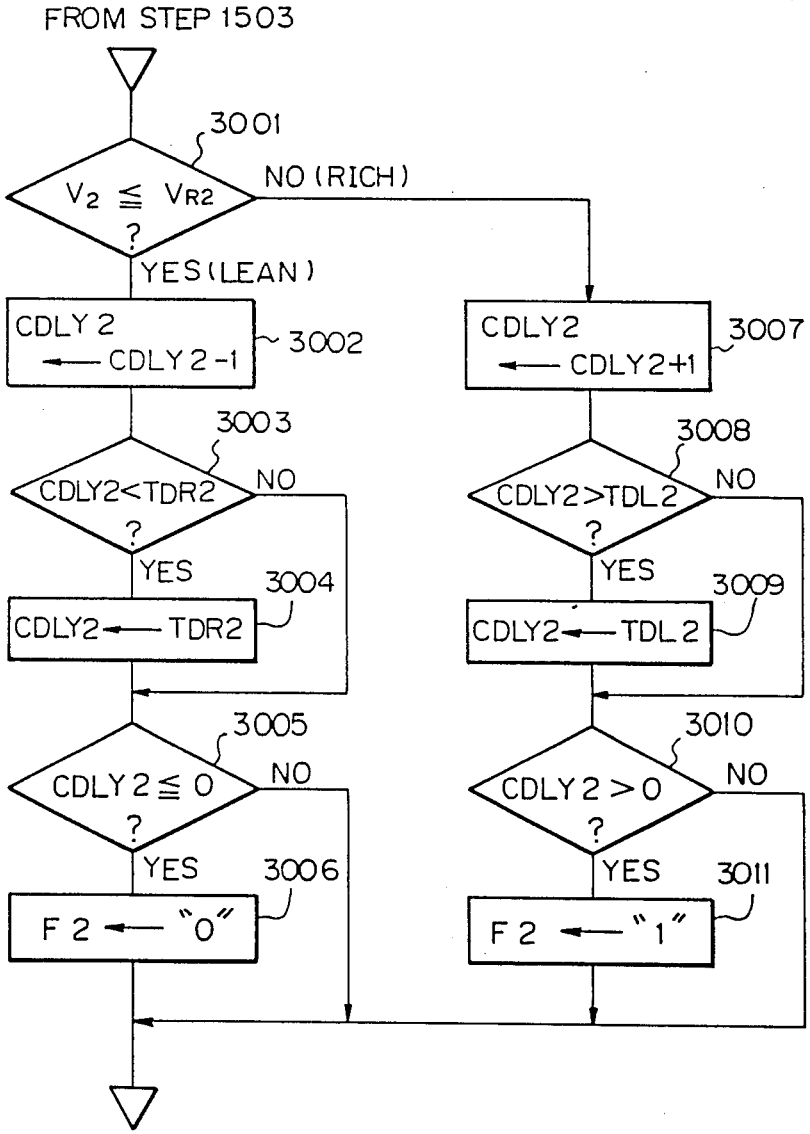

In FIG. 30, which is a modification of FIG. 15, the same delay operation as in FIG. 29 is carried out, and its detailed explanation is omitted.

Figures 31A, 31B, 31C, 31D:
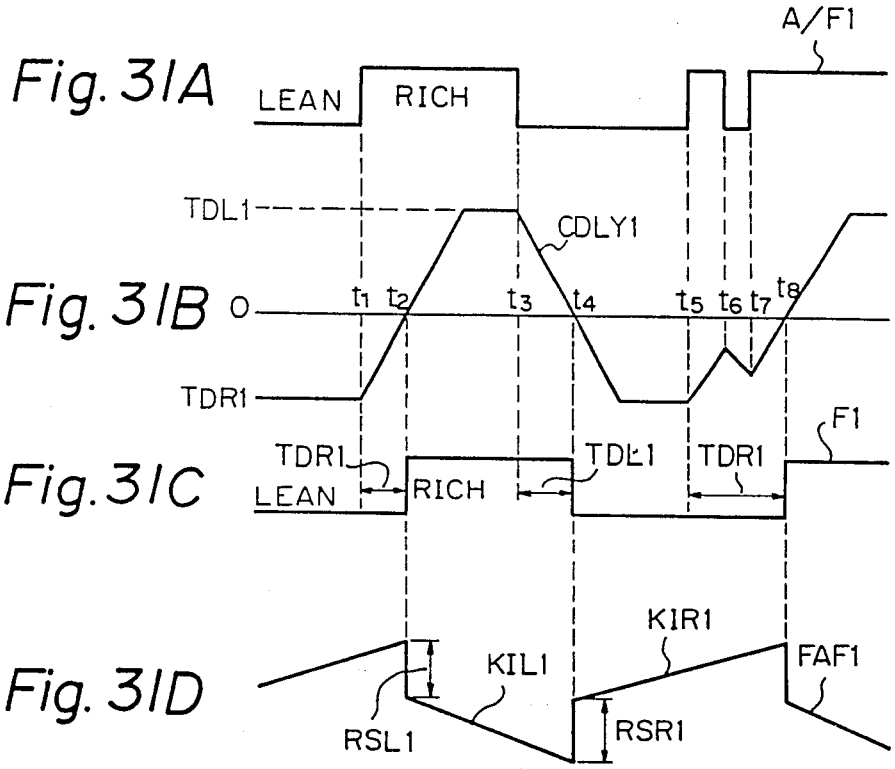

The operation by the flow chart of FIG. 29 will be further explained with reference to FIGS. 31A through 31D. As illustrated in FIG. 31A, when the air-fuel ratio A/F1 is obtained by the output of the upstream-side $O_2$ sensor 13, the first delay counter CDLY1 is counted up during a rich state, and is counted down during a lean state, as illustrated in FIG. 31B. As a result, the delayed air-fuel ratio A/F1' is obtained as illustrated in FIG. 31C. For example, at time $t_1$, even when the air-fuel ratio A/F1 is changed from the lean side to the rich side, the delayed air-fuel ratio A/F1 is changed at time $t_2$ after the rich delay time period TDR1. Similarly, at time $t_3$, even when the air-fuel ratio A/F1 is changed from the rich side to the lean side, the delayed air-fuel ratio A/F1' is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio A/F1' is reversed at time $t_8$. That is, the delayed air-fuel ratio A/F1' is stable when compared with the air-fuel ratio A/F1. Further, as illustrated in FIG. 31D, at every change of the delayed air-fuel ratio A/F1' from the rich side to the lean side, or vice versa, the correction amount FAF1 is skipped by the skip amount RSR1 or RSL1, and also, the correction amount FAF1 is gradually increased or decreased in accordance with the delayed air-fuel ratio A/F1'.

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. This is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the delay time periods TDR1 and TDL1, the integration amounts KIR and KIL, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 1301 of FIG. 13 or at step 1601 of FIG. 16 is determined by the carburetor itself, i.e., the intake air negative pressure and the engine speed, and the air amount corresponding to TAU at step 1303 of FIG. 13 or at step 1603 of FIG. 16.

Further, a CO sensor, a lean-mixture sensor or the like can be also used instead of the $O_2$ sensor.

As explained above, according to the present invention, the fuel consumption, the drivability, and the exhaust emission characteristics can be improved even when the downstream-side $O_2$ sensor is in a special state such as a lean air-fuel ratio requesting state, a transient state, a deceleration state, or an idling state.

We claim:

1. A method for controlling the air-fuel ratio of an internal combustion engine having a catalyst converter for removing pollutants in the exhaust gas thereof, and upstream-side and downstream-side air-fuel ratio sensors disposed upstream and downstream, respectively, of said catalyst converter for detecting a concentration of a specific component in an exhaust gas, comprising the steps of:

calculating a first air-fuel ratio correction amount in accordance with the output of said upstream-side air-fuel ratio sensor;

calculating a second air-fuel ratio correction amount in accordance with the output of asid downstream-side air-fuel ratio sensor;

adjusting the actual air-fuel ratio in accordance with said first and second air-fuel ratio correcton amounts;

determining whether or not said engine is in a predetermined state; and prohibiting the calculation of said second air-fuel ratio correction amount while carrying out the calculation of said first air-fuel ratio correction amount when said engine is in said predetermined state.

2. A method as set forth in claim 1, wherein said prohibiting step comprises a step of fixing said second air-fuel ratio correction amount at a predetermined value.

3. A method as set froth in claim 1, wherein said prohibiting step comprises a step of fixing said second air-fuel ratio correction amount at a value immediately before said engine enters said predetermined state.

4. A method as set forth in claim 1, wherein said prohibiting step comprises a step of fixing said second air-fuel ratio correction amount at a mean value when said engine is in said predetermined state.

5. A method as set forth in claim 1, wherein said engine state determining step comprises the steps of:

determining whether or not said engine is in a lean air-fuel ratio requesting state; and switching an air-fuel ratio feedback control parameter for the output of said upstream-side air-fuel ratio sensor from a stoichiometric air-fuel ratio to a lean air-fuel ratio when said engine enters said lean air-fuel ratio requesting state.

6. A method as set forth in claim 5, wherein said lean air-fuel ratio requesting step comprises a step of determining whether or not said engine is in a small load state.

7. A method as set forth in claim 6, wherein said small load determining step comprises the steps of:

determining whether or not a speed of said engine is smaller than a predetermined value; and determining whether or not the amount of fuel to be supplied to said engine is smaller than a predetermined amount, thereby determining that said engine is in a small load state when the speed of said engine is smaller than said predetermined value and the amount of fuel is smaller than said predetermined amount.

8. A method as set forth in claim 5, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

9. A method as set forth in claim 5, wherein said air-fuel ratio feedback control parameter is determined by a rich skip amount by which said first air-fuel ratio correction amount is remarkably increased when the output of said upstream-side air-fuel ratio sensor is switched from the rich side to the lean side, and a lean skip amount by which said first air-fuel ratio correction amount is remarkably decreased when the output of said upstream-side air-fuel ratio sensor is switched from the lean side to the rich side.

10. A method as set forth in claim 5, wherein said air-fuel ratio feedback control parameter is dtermined by a rich integration amount by which said first air-fuel ratio correction amount is gradually incrased when the output fo said upstream-side air-fuel ratio sensor is on the lean side, and a lean integration amount by which said first air-fuel ratio correction amount is gradually decreased when the output of said upstream-side air-fuel ratio sensor is on the rich side.

11. A method as set forth in claim 5, wherein said air-fuel ratio feedback control parameter is determined by a reference voltage with which the output of said upstream-side air-fuel ratio sensor is comprared, thereby determining whether the air-fuel ratio is on the rich side or on the lean side.

12. A method as set forth in claim 1, wherein said engine state determining step comprises the steps of:

detecting a change of said engine from a steady state to a transient state; and determining whether or not a predetermined duration has passed after said change is detected, thereby determining that said engine is in said predetermined state, before said predetermined duration has passed.

13. A method as set forth in claim 12, wherein said engine state-change detecting step comprises a step of determining whether or not a throttle valve of said engine is completely closed.

14. A method as set forth in claim 12, wherein said engine state-change detecting step comprises the steps of:

calculating a change of an intake air amount of said engine; and determining whether o not the change of said intake air amount is larger than a predetermined amount.

15. A method as set forth in claim 12, wherein said engine state-change detecting step comprises the steps of:

calculating a change of an intake air pressure of said engine; and determining whether or not the change of said intake air pressure is larger than a predetermined pressure.

16. A method as set forth in claim 12, wherein said engine state-change detecting step comprises the steps of:

calculating a change of a throttling opening of said engine; and determining whether or not the change of said throttling opening is larger than a predetermined opening.

17. A method as set forth in claim 12, wherein said engine state-change detecting step comprises the steps of:

calculating a change of a speed of said engine; and determining whether or not the change of said speed is larger than a predetermined value.

18. A method as set forth in claim 12, wherein said engine state-change detecting step comprises the steps of:

calculating a change of a speed of a vehicle in which said engine is mounted;

determining whether or not the change of said vehicle speed is larger than a predetermined value.

19. A method as set forth in claim 12, wherein said engine state determining step comprises a step of determining whether or not said engine is in a deceleration state.

20. A method as set forth in claim 19, wherein said deceleration state determining step comprises the steps of:

determining whether or not a throttle valve of said engine is completely closed;

determining whether or not a speed of a vehicle in which said engine is mounted is zero, thereby determining that said engine is in a deceleration state when said throttle valve is completely closed and said vehicle speed is not zero.

21. A method as set forth in claim 19, wherein said deceleration state determining step comprises the steps of:

determining whether or not an intake air amount of said engine is smaller than a predetermined amount;

determining whether or not a speed of a vehicle in which said engine is mounted is zero, thereby determining that said engine is in a deceleration state when said intake air amount is smaller than said predetermined amount and said vehicle speed is not zero.

22. A method as set forth in claim 19, wherein said deceleration state determining step comprises the steps of:

determining whether or not an intake air pressure of said engine is smaller than a predetermined pressure;

determining whether or not a speed of a vehicle in which said engine is mounted is zero, thereby determining that said engine is in a deceleration state when said intake air pressure is smaller than said predetermined pressure and said vehicle speed is not zero.

23. A method as set forth in claim 19, wherein said deceleration state determining step comprises the steps of:

determining whether or not a throttle valve opening of said engine is smaller than a predetermined;

determining whether or not a speed of a vehicle in which said engine is mounted is zero, thereby determining that said engine is in a deceleration state when said throttle valve opening is smaller than said predetermined opening and said vehicle speed is not zero.

24. A method as set forth in claim 1, wherein said engine state determining step comprises the steps of:

determining whether or not said engine is in an idling state;

determining whether or not a predetermined duration of said idling state has passed, thereby determining that said engine is in said predetermined state after said predetermined duration of said idling state has passed.

25. A method as set forth in claim 24, wherein said idling state determining step comprises the steps of:

determining whether or not a throttle valve of said engine is completely closed; and determining whether or not a speed of a vehicle in which said engine is mounted is zero, thereby determining that said engine is in an idling state when said throttle valve is completely closed and said vehicle speed is not zero.

26. A method as set for the in claim 24, wherein, in the case of an automatic transmission vehicle, said idling state determining step comprises the steps of:

determining whether or not a neutral switch of the automatic transmission is turned ON;

determining whether or not a speed of a vehicle in which said engine is mounted is zero, thereby determining that said engine is in an idling state when said neutral switch is turned ON and said vehicle speed is not zero.

27. A method as set forth in claim 24, wherein said idling state determining step comprises the steps of:

determining whether or not an intake air amount of said engine is smaller than a predetermined amount; and determining whether or not a speed of said engine is smaller than a predetermined speed, thereby determining that said engine is in an idling state when said intake air amount is smaller than said predetermined amount and said engine speed is smaller than said predetermined speed.

28. A method as set forth in claim 24, wherein said idling state determining step comprises the steps of:

determining whether or not an intake air pressure of said engine is smaller than a predetermined pressure; and determining whether or not a speed of said engine is smaller than a predetermined speed, thereby determining that said engine is in an idling state when said intake air pressure is smaller than said predetermined pressure and said engine speed is smaller than said predetermined speed.

29. A method as set forth in claim 24, wherein said idling state determining step comprises the steps of:

determining whether or not a throttle valve opening of said engine is smaller than a predetermined opening; and determining whether or not a speed of said engine is smaller than a predetrmined speed, thereby determining that said engine is in an idling state when said throttle valve opening is smaller than said predetermined opening and said engine speed is smaller than said predetermined speed.

30. A method as set forth in claim 24, wherein said idling state determining step comprises the steps of:

determining whether or not a speed of said engine is smaller than a predetermined speed; and determining whether or not an exhaust gas temperature of said engine is lower than a predetermined temperature, thereby determining that said engine is in an idling state when said engine speed is lower than said pedetermined speed and said exhaust gas temepratur is lower than said predetermined temperature.

31. A method as set forth in claim 24, wherein said idling state determining step comprises the steps of:

determining whether or not a speed of said engine is smaller than a predetermined speed; and determining whether or not a coolant temperature of said engine is lower than a predetermined temperature, thereby determining that said engine is an idling state when said engine speed is lower than said predetermined speed and said coolant temperature is lower than said predetermined temperature.

32. A method as set forth in claim 24, wherein said idling state determining step comprises the steps of:

determining whether or not a speed of said engine is smaller than a predetermined speed; and determining whether or not a temperature of said downstream-side air-fuel ratio sensor is lower than a predetermined temperature, thereby determining that said engine is in an idling state when said engine speed is lower than said predetermined speed and said temperature of said downstream-side air-fuel ratio sensor is lower than said predetermined temperature.

33. A method as set forth in claim 24, wherein said idling state determining step comprises the steps of:

determining whether or not a throttle valve of said engine is completely closed; and determining whether or not an exhaust gas temperature of said engine is lower than a predetermined temperature, thereby determining that said engine is in an idling state when said throttle valve is completely closed and said exhaust gas temperature is lower than said predetermined temperature.

34. A method is set forth in claim 24, wherein said idling state determining steps of:

determining whether or not a throttle valve of said engine is completely closed; and determining whether or not a coolant temperature of said engine is lower than a predetermined temperature, thereby determining that said engine is in an idling state when said throttle valve is completely closed and said coolant temperature is lower than said predetermined temperature.

35. A method as set forth in claim 24, wherein said idling state determining step comprises the steps of:

determining whether or not a throttle valve of said engine is completely closed; and determining whether or not a temperature of said downstream-side air-fuel ratio sensor is lower than a predetermined temperature, thereby determining that said engine is in an idling state when said throttle valve is completely closed and said temperature of said downstream-side air-fuel ratio sensor is lower than said predetermined temperature.

36. A method as set forth in claim 1, further comprising a step of delaying the restart of the calculation of said second air-fuel ratio correction amount for a predetermined duration after said engine leaves said predetermined state.

37. A method for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalysts converter for detecting a concentration of a specific component in an exhaust gas, comprising the steps of:

calculating an air-fuel ratio correction amount in accordance with the output of said upstream-side air-fuel ratio sensor;

calculating an air-fuel ratio feedback control parameter in accordance with the output of said downstream-side air-fuel ratio sensor;

adjusting the actual air-fuel ratio in accordance with said air-fuel ratio feedback control parameter and said air-fuel ratio correction amount;

determining whether or not said engine is in a predetermined state; and prohibiting the calculation of said air-fuel ratio feedback control parameter while carrying out the calculation of said air-fuel ratio correction amount when said engine is in said predetermined state.

38. A method as set forth in claim 37, wherein said prohibiting step comprises a step of fixing said air-fuel ratio feedback control parameter at a predetermined value.

39. A method as set forth in claim 37, wherein said prohibiting step comprises a step of fixing said air-fuel ratio feedback control parameter at a value immediately before said engine enters said predetermined state.

40. A method as set forth in claim 37, wherein said prohibiting step comprises a step of fixing said air-fuel ratio feedback control parameter at a mean value when said engine is in said predetermined state.

41. A method as set forth in claim 37, wherein said engine state determining step comprises the steps of:

determining whether or not said engine is in a lean air-fuel ratio requesting state; and switching another an other air-fuel ratio feedback control parameter, different from said air-fuel ratio feedback control parameter, for the output of siad upstream-side air-fuel ratio sensor from a stoichiometric air-fuel ratio to a lean air-fuel ratio when said engine enters said lean air-fuel ratio requesting state.

42. A method as set forth in claim 41, wherein said lean air-fuel ratio requesting step comprises a step of determining whether or not said engine is in a small load state.

43. A method as set forth in claim 42, wherein said small load determining step comprises the steps of:

determining whether or not a speed of said engine is smaller than a predetermined value; and determining whether or not the amount of fuel to be supplied to said engine is smaller than a predetermined amount, thereby determining that said engine is in a small load state when the speed of said engine is smaller than said predetermined value and the amount of fuel is smaller than said predetermined amount.

44. A method as set forth in claim 41, wherein one of said air-fuel ratio feedback control parameters is determined by a rich delay time period for delaying the output of said upstream-side airfuel ratio sensor switched from the lean side to the rich side and a lean delay time period for delaying the output of said upstream-side air-fuel ratio sensor switched from the rich side to the lean side.

45. A method as set forth in claim 41, wherein one of said air-fuel ratio feedback control parameters is determined by a rich skip amount by which said first air-fuel ratio correction amount is remarkably increased when the output of said upstreamside air-fuel ratio sensor is switched form the rich side to the lean side, and a lean amount by which said first air-fuel ratio correction amount is remarkably decreased when the output of said upstream-side air-fuel ratio sensor is switched from the lean side to the rich side.

46. A method as set forth in claim 41, wherein one of said air-fuel ratio feedback control parameters is determined by a rich integration amount by which said first air-fuel ratio correction amount is gradually increased when the output of said upstream-side air-fuel ratio sensor is on the lean side, and a lean integration amount by which said first air-fuel ratio correction amount is gradually decreased when the output of said upstream-side air-fuel ratio sensor is on the rich side.

47. A method as set forth in claim 41, wherein one of said air-fuel ratio feedback control parameters is determined by a reference voltage with which the output of said upstream-side air-fuel ratio sensor is compared, thereby determining whether the airfuel ratio is on the rich side or on the lean side.

48. A method as set forth in claim 37, wherein said engine state determining step comprises the steps of:

detecting a change of said engine from a steady state to a transient state; and determining whether or not a predetermined duration has passed after said change is detected, thereby determining that said engine is in said predetermined state, before said predetermined duration has passed.

49. A method as set forth in claim 48, wherein said engine state-change detecting step comprises a step of determining whether or not a throttle valve of said engine is completely closed.

50. A method as set forth in claim 48, wherein said engine state-change detecting step comprises the steps of:

calculating a change of an intake air amount of said engine; and determining whether or not the change of said intake air amount is larger than a predetermined amount.

51. A method as set forth in claim 48, wherein said engine state change detecting step comprises the steps of:

calculating a change of an intake air pressure of said engine; and determining whether or not the change of said intake air pressure is larger than a predetermined pressure.

52. A method as set forth in claim 48, wherein said engine state-change detecting step comprises the steps of:

calculating a change of a throttling opening of said engine; and determining whether or not the change of said throttling opening is larger than a predetermined opening.

53. A method as set forth in claim 48, wherein said engine state-change detecting step comprises the steps of:

calculating a change of a speed of said engine; and determining whether or not the change of said speed air amount is larger than a predetermined value.

54. A method as set forth in claim 48, wherein said engine state-change detecting step comprises the steps of:

calculating a change of a speed of a vehicle in which said engine is mounted;

determining whether or not the change of said vehicle speed is larger than a predetermined value.

55. A method as set forth in claim 37, wherein said engine state determining step comprises a step of determining whether or not said engine is in a deceleration state.

56. A method as set forth in claim 55, wherein said deceleration state determining step comprises the steps of:

determining whether or not a throttle valve of said engine is completely closed;

determining whether or not a speed of a vehicle in which said engine is mounted is zero, thereby determining that said engine is in a deceleration state when said throttle valve is completely closed and said vehicle speed is not zero.

57. A method as set forth in claim 55, wherein said deceleration state determining step comprises the steps of:

determining whether or not an intake air amount of said engine is smaller than a predetermined amount;

determining whether or not a speed of a vehicle in which said engine is mounted is zero, thereby determining that said engine is in a deceleration state when said intake air amount is smaller than said predetermined amount and said vehicle speed is not zero.

58. A method as set forth in claim 55, wherein said deceleration state determining step comprises the steps of:

determining whether or not an intake air pressure of said engine is smaller than a predetermined pressure;

determining whether or not a speed of a vehicle in which said engine is mounted is zero, thereby determining that said engine is in a deceleration state when said intake air pressure is smaller than said predetermined pressure and said vehicle speed is not zero.

59. A method as set forth in claim 55, wherein said deceleration state determining step comprises the steps of:

determining whether or not a throttle valve opening of said engine is smaller than a predetermined opening;

determining whether or not a speed vehicle in which said engine is mounted is zero, thereby determining that said engine is in a deceleration state when said throttle valve opening is smaller than said predetermined opening and said vehicle speed is not zero.

60. A method as set forth in claim 37, wherein said engine state determining step comprises the steps of:

determining whether or not said engine is in an idling state;

determining whether or not a predetermined duration of said idling state has passed, thereby determining that said engine is in said predetermined state after said predetermined duration of said idling state has passed.

61. A method as set forth in claim 60, wherein said idling state determining step comprises the steps of:

determining whether or not a throttle valve of said engine is completely closed; and determining whether or not a speed of a vehicle in which said engine is mounted is zero, thereby determining that said engine is in an idling state when said throttle valve is completely closed and said vehicle speed is not zero.

62. A method as set forth in claim 60, wherein, in the case of an automatic transmission vehicle, said idling state determining step comprises the steps of:

determining whether or not a neutral switch of the automatic transmission is turned ON;

determining whether or not a speed of a vehicle in which said engine is mounted is zero, thereby determining that said engine is in an idling state when said neutral switch is turned ON and said vehicle speed is not zero.

63. A method as set forth in claim 60, wherein said idling state determining step comprises the steps of:

determining whether or not an intake air amount of said engine is smaller than a predetermined amount; and determining whether or not a speed of said engine is smaller than a predetermined speed, thereby determining that said engine is in an idling state when said intake air amount is smaller than said predetermined amount and said engine speed is smaller than said predetermined speed.

64. A method as set forth in claim 60, wherein said idling state determining step comprises the steps of:

determining whether or not an intake air pressure of said engine is smaller than a predetermined pressure; and determining whether or not a speed of said engine is smaller than a predetermined speed, thereby determining that said engine is in an idling state when said intake air pressure is smaller than said predetermined pressure and said engine speed is smaller than said predetermined speed.

65. A method as set forth in claim 60, wherein said idling state determining step comprises the steps of:

determining whether or not a throttle valve opening of said engine is smaller than a predetermined opening; and determining whether or not a speed of said engine is smaller than a predetermined speed, thereby determining that said engine is in an idling state when said throttle valve opening is smaller than said predetermined opening and said engine speed is smaller than said predetermined speed.

66. A method as set forth in claim 60, wherein said idling state determining step comprises the steps of:

determining whether or not a speed of said engine is smaller than a predetermined speed; and determining whether or not an exhaust gas temperature of said engine is lower than a predetermined temperature, thereby determining that said engine is in an idling state when said engine speed is lower than said predetermined speed and said exhaust gas temperature is lower than said predetermined temperature.

67. A method as set forth in claim 60, wherein said idling state determining step comprises the steps of:

determining whether or not a speed of said engine is smaller than a predetermined speed; and determining whether or not a coolant temperature of said engine is lower than a predetermined temperature;

thereby determining that said engine is in an idling state when said engine speed is lower than said predetermined speed and said coolant temperature is lower than said predetermined temperature.

68. A method as set forth in claim 60, wherein said idling state determining step comprises the steps of:

determining whether or not a speed of said engine is smaller than a predetermined speed; and determining whether or not a temperature of said downstream-side air-fuel ratio sensor is lower than a predetermined temperature;

thereby determining that said engine is in an idling state when said speed is lower than said predetermined speed and said temperature of said downstream-side air-fuel ratio sensor is lower than said predetermined temperature.

69. A method as set forth in claim 60, wherein said idling state determining step comprises the steps of:

determining whether or not a throttle valve of said engine is completely closed; and determining whether or not an exhaust gas temperature of said engine is lower than a predetermined temperature;

thereby determining that said engine is in an idling state when said throttle valve is completely closed and said exhaust gas temperature is lower than said predetermined temperature.

70. A method as set forth in claim 60, wherein said idling state determining step comprises the steps of:

determining whether or not a throttle valve of said engine is completely closed; and determining whether or not a coolant temperature of said engine is lower than a predetermined temperature;

thereby determining that said engine is in an idling state when said throttle valve is completely closed and said coolant temperature is lower than said predetermined temperature.

71. A method as set forth in claim 60, wherein said idling state determining step comprises the steps of:

determining whether or not a throttle valve of said engine is completely closed; and determining whether or not a temperature of sasid downstream-sie air-fuel ratio sensor is lower than a predetermined temperature;

thereby determining that said engine is in an idling state when said throttle valve is completely closed and said temperature of said downstream-side air-fuel ratio sensor is lower than said predetermined temperature.

72. A method as set forth in claim 37, further comprising a step of delaying the restart of the calculation of said second air-fuel ratio correction amount for a predetermined duration after said engine leaves said predetermined state.

73. An apparatus for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting a concentration of a specific component in an exhaust gas, comprising:

means for calculating a first air-fuel ratio correction amount in accordance with the output of said upstream-side air-fuel ratio sensor;

means for calculating a second air-fuel ratio correction amount in accordance with the output of said downstream-side air-fuel ratio sensor;

means for adjusting the actual air-fuel ratio in accordance with said first and second air-fuel ratio correction amounts;

means for determining whether or not said engine is in a predetermined state; and means for prohibiting the calculation of said second air-fuel ratio correction amount while carrying out the calculation of said first air-fuel ratio correction amount when said engine is in said predetermined state.

74. An apparatus as set forth in claim 73, wherein said prohibiting means comprises means for fixing said second air-fuel ratio correction amount at a predetermined value.

75. An apparatus as set forth in claim 73, wherein said prohibiting means comprises means for fixing said second air-fuel ratio correction amount at a value immediately before said engine enters said predetermined state.

76. An apparatus as set forth in claim 73, wherein said prohibiting means comprises means for fixing said second air-fuel ratio correction amount at a mean value when said engine is in said predetermined state.

77. An apparatus as set forth in claim 73, wherein said engine state determining means comprises:

means for determining whether or not said engine is in a lean air-fuel ratio requesting state; and means for switching an air-fuel ratio feedback control parameter for the output of said upstream-side air-fuel ratio sensor from a stoichiometric air-fuel ratio to a lean air-fuel ratio when said engine enters said lean air-fuel ratio requesting state.

78. An apparatus as set forth in claim 77, wherein said lean air-fuel ratio requesting means comprises means for determining whether or not said engine is in a small load state.

79. An apparatus as set forth in claim 78, wherein said small load determining means comprises:

means for determining whether or not a speed of said engine is smaller than a predetermined value; and means for determining whether or not the amount of fuel to be supplied to said engine is smaller than a predetermined amount;

thereby determining that said engine is in a small load state when the speed of said engine is smaller than said predetermined value and the amount of fuel is smaller than said predetermined amount.

80. An apparatus as set forth in claim 77, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

81. An apparatus as set forth in claim 77, wherein said air-fuel ratio feedback control parameter is determined by a rich skip amount by which said first air-fuel ratio correction amount is remarkably increased when the output of said upstream-side air-fuel ratio sensor is switched from the rich side to the lean side, and a lean skip amount by which said first air-fuel ratio correction amount is remarkably decreased when the output of said upstream-side air-fuel ratio sensor is switched from the lean side to the rich side.

82. An apparatus as set forth in claim 77, wherein said air-fuel ratio feedback control parameter is determined by a rich integration amount by which said first air-fuel ratio correction amount is gradually increased when the output of said upstream-side air-fuel ratio sensor is on the lean side, and a lean integration amount by which said first air-fuel ratio correction amount is gradually decreased when the output of said upstream-side air-fuel ratio sensor is on the rich side.

83. An apparatus as set forth in claim 77, wherein said air-fuel ratio feedback control parameter is determined by a reference voltage with which the output of said upstream-side air-fuel ratio sensor is compared, thereby determining whether the air-fuel ratio is on the rich side or on the lean side.

84. An apparatus as set forth in claim 73, wherein said engine state determining step comprises:

means for detecting a change of said engine from a steady state to a transient state; and means for determining whether or not a predetermined duration has passed after said change is detected;

thereby determining that said engine is in said predetermined state, before said predetermined duration has passed.

85. An apparatus as set forth in claim 84, wherein said engine state-change detecting means comprises means for determining whether or not a throttle valve of said engine is completely closed.

86. An apparatus as set forth in claim 84, wherein said engine state-change detecting means comprises:

means for calculating a change of an intake our amount of said engine; and means for determining whether or not the change of said intake air amount is larger than a predetermined amount.

87. An apparatus as set forth in claim 84, wherein said engine state-change detecting means comprises:

means for calculating a change of an intake air pressure of said engine; and means for determining whether or not the change of said intake air pressure is larger than a predetermined pressure.

88. An apparatus as set forth in claim 84, wherein said engine state-change detecting means comprises:

means for calculating a change of a throttling opening of said engine; and means for determining whether or not the change of said throttling opening is larger than a predetermined opening.

89. An apparatus as set forth in claim 84, wherein said engine state-change detecting means comprises:

means for calculating a change of a speed of said engine; and means for determining whether or not the change of said speed is larger than a predetermined value.

90. An apparatus as set forth in claim 84, wherein said engine state-change detecting means comprises:

means for calculating a change of a speed of a vehicle on which said engine is mounted;

for determining whether not the change of said vehicle speed is larger than a predetermined value.

91. An apparatus as set forth in claim 73, wherein said engine state determining means comprises means for determining whether or not said engine is in a deceleration state.

92. An apparatus as set forth in claim 91, wherein said deceleration state determining means comprises:

means for determining whether or not a throttle valve of said engine is completely closed;

means for determining whether or not a speed of a vehicle in which said engine is mounted is zero;

thereby determining that said engine is in a deceleration state when said throttle valve is completely closed and said vehicle speed is not zero.

93. An apparatus as set forth in claim 91, wherein said deceleration state determining menas comprises:

means for determining whether or not an intake air amount of said engine is smaller than a predetermined amount;

means for determining whether or not a speed of a vehicle in which said engine is mounted is zero;

thereby determining that said engine is in a deceleration state when said intake air amount is smaller than said predetermined amount and said vehicle speed is not zero.

94. An apparatus as set forth in claim 91, wherein said deceleration state determining means comprises:

means for determining whether or not an intake air pressure of said engine is smaller than a predetermined pressure;

means for determining whether or not a speed of a vehicle in which said engine is mounted is zero;

thereby determining that said engine is in a deceleration state when said intake air pressure is smaller than said predetermined pressure and said vehicle speed is not zero.

95. An apparatus as set forth in claim 91, wherein said deceleration state determining means comprises:

means for determining whether or not a throttle valve opening of said engine is smaller than a predetermined;

means for determining whether or not a speed of a vehicle in which said engine is mounted is zero;

thereby determining that said engine is in a deceleration state when said throttle valve opening is smaller than said predetermined opening and said vehicle speed is not zero.

96. An apparatus as set forth in claim 73, wherein said engine state determining means comprises:

means for determining whether or not said engine is in an idling state;

means for determining whether or not a predetermined duration of said idling state has passed;

thereby determining that said engine is in said predetermined state after said predetermined duration of said idling state has passed.

97. An apparatus as set forth in claim 96, wherein said idling state determining means comprises:

means for determining whether or not a throttle valve of said engine is completely closed; and means for determining whether or not a speed of a vehicle in which said engine is mounted is zero;

thereby determining that said engine is in an idling state when said throttle valve is completely closed and said vehicle speed is not zero.

98. An apparatus as set forth in claim 96, wherein said idling state determining means comprises:

means for determining whether or not a neutral switch of the automatic transmission is turned ON in the case of an automatic transmission vehicle;

means for determining whether or not a speed of a vehicle in which said engine is mounted is zero;

thereby determining that said engine is in an idling state when said neutral switch is turned ON and said vehicle speed is not zero.

99. An apparatus as set forth in claim 96, wherein said idling state determining means comprises the steps of:

means for determining whether or not an intake air amount of said engine is smaller than a predetermined amount; and means for determining whether or not a speed of said engine is smaller than a predetermined speed, thereby determining that said engine is in an idling state when said intake air amount is smaller than said predetermined amount and said engine speed is smaller than said predetermined speed.

100. An apparatus as set forth in claim 96, wherein said idling state determining means comprises:

means for determining whether or not an intake air pressure of said engine is smaller than a predetermined pressure; and means for determining whether or not a speed of said engine is smaller than a predetermined speed;

thereby determining that said engine is in an idling state when said intake air pressure is smaller than said predetermined pressure and said engine speed is smaller than said predetermined speed.

101. An apparatus as set forth in claim 96, wherein said idling state determining means comprises:

means for determining whether or not a throttle valve opening of said engine is smaller than a predetermined opening; and means for determining whether or not a speed of said engine is smaller than a predetermined speed;

thereby determining that said engine is in a idling state when said throttle valve opening is smaller than said predetermined opening and said engine speed is smaller than said predetermined speed.

102. An apparatus as set forth in claim 96, wherein said idling state determining means comprises:

means for determining whether or not a speed of said engine is smaller than a predetermined speed; and means for determining whether or not an exhaust gas temperature of said engine is lower than a predetermined temperature;

thereby determining that said engine is in an idling state when said engine speed is lower than said predetermined speed and said exhaust gas temperature is lower than said predetermined temperature.

103. An apparatus as set forth in claim 96, wherein said idling state determining means comprises:

means for determining whether or not a speed of said engine is smaller than a predetermined speed; and means for determining whether or not a coolant temperature of said engine is lower than a predetermined temperature;

thereby determining that said engine is in an idling state when said engine speed is lower than said predetermined speed and said coolant temperature is lower than said predetermined temperature.

104. An apparatus as set forth in claim 96, wherein said idling state determining means comprises:

means for determining whether or not a speed of said engine is smaller than a predetermined speed; and means for determining whether or not a temperature of said downstream-side air-fuel ratio sensor is lower than a predetermined temperature;

thereby determining that said engine is in an idling state when said engine speed is lower than said predetermined speed and said temperature of said downstream-side air-fuel ratio sensor is lower than said predetermined temperature.

105. An apparatus as set forth in claim 96, wherein said idling state determining means comprises:

means for determining whether or not a throttle valve of said engine is completely closed; and means for determining whether or not an exhaust gas temperature of said engine is lower than a predetermined temperature;

thereby determining that said engine is in an idling state when said throttle valve is completely closed and said exhaust gas temperature is lower than said predetermined temperature.

106. An apparatus as set forth in claim 96, wherein said idling state determining means comprises:

means for determining whether or not a throttle valve of said engine is completely closed; and means for determining whether or not a coolant temperature of said engine is lower than a predetermined temperature;

thereby determining that said engine is in an idling state when said throttle valve is completely closed and said coolant temperature is lower than said predetermined temperature.

107. An apparatus as set forth in claim 96, wherein said idling state determining means comprises:

means for determining whether or not a throttle valve of said engine is completely closed; and means for determining whether or not a temperature of said downstream-side air-fuel ratio sensor is lower than a predetermined temperature;

thereby determining that said engine is in an idling state when said throttle valve is completely closed and said temperature of said downstream-side air-fuel ratio sensor is lower than said predetermined temperature.

108. An apparatus as set forth in claim 73, further comprising a means for delaying the restart of the calculation of said second air-fuel ratio correction amount for a predetermined duration after said engine leaves said predetermined state.

109. A method for controlling the air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter for detecting a concentration of a specific component in an exhaust gas, comprising:

means for calculating an air-fuel ratio correction amount in accordance with the output of said upstream-side air-fuel ratio sensor;

means for calculating an air-fuel ratio feedback control parameter in accordance with the output of said downstream-side air-fuel ratio sensor;

means for adjusting the actual air-fuel ratio in accordance with said air-fuel ratio feedback control parameter and said air-fuel ratio correction amount;

means for determining whether or not said engine is in a predetermined state; and means for prohibiting the calcualtion of said air-fuel ratio feedback control parameter while carrying out the calculation of said air-fuel ratio correction amount when said engine is in said predetermined state.

110. An apparatus as set forth in claim 109, wherein said prohibiting means comprises means for fixing said air-fuel ratio feedback control parameter at a predetermined value.

111. An apparatus as set forth in claim 109, wherein said prohibiting means comprises means for fixing said air-fuel ratio feedback control parameter at a value immediately before said engine esters said predetermined state.

112. An apparatus as set forth in claim 109, wherein said prohibiting means comprises means for fixing said air-fuel ratio feedback control parameter at a mean value when said engine is in said predetermined state.

113. An apparatus as set forth in claim 109, wherein said engine state determining means comprises:

means for determining whether or not said engine is in a lean air-fuel ratio requesting state; and means for switching other air-fuel ratio feedback control parameters, different from said air-fuel ratio feedback control parameter, for the output of said upstream-side air-fuel ratio sensor from a stoichiometric air-fuel ratio to a lean air-fuel ratio when said engine enters said lean air-fuel ratio requesting state.

114. An apparatus as set forth in claim 113, wherein said lean air-fuel ratio requesting means comprises means for determining whether or not said engine is in a small load state.

115. An apparatus as set forth in claim 114, wherein said small load determining means comprises:

means for determining whether or not a speed of said engine is smaller than a predetermined value; and means for determining whether or not the amount of fuel to be supplied to said engine is smaller than a predetermined amount, thereby determining that said engine is in a small load state when the speed of said engine is smaller than said predetermined value and the amount of fuel is smaller than said predetermined amount.

116. An apparatus as set forth in claim 113, wherein one of said air-fuel ratio feedback control parameters is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

117. An apparatus as set forth in claim 113, wherein one of said air-fuel ratio feedback control parameters is determined by a rich skip amount by which said first air-fuel ratio correction amount is remarkably increased when the output of said upstream-side air-fuel ratio sensor is switched from the rich side to the leam side, and a lean skip amount by which said first air-fuel ratio correction amount is remarkably decreased when the output of said upstream-side air-fuel ratio sensor is switched from the lean side to the rich side.

118. An apparatus as set forth in claim 113, wherein one of said air-fuel ratio feedback control parameters is determined by a rich integration amount by which said first air-fuel ratio correction amount is gradually increased when the output of said upstream-side air-fuel ratio sensor is on the leam side, and a lean integration amount by which said first air-fuel ratio correction amount is gradually decreased when the output of said upstream-side air-fuel ratio sensor is on the rich side.

119. An apparatus as set forth in claim 113, wherein one of said air-fuel ratio feedback control parameters is determined by a reference voltage with which the output of said upstream-side air-fuel ratio sensor is compared, thereby determining whether the air-fuel ratio is on the rich side or on the lean side.

120. An apparatus as set forth in claim 109, wherein said engine state determining means comprises:

means for detecting a change of said engine from a steady state to a transient state; and means for determining whether or not a predetermined duration has passed after said change is detected, thereby determining that said engine is in said predetermined state, before said predetermined duration has passed.

121. An apparatus as set forth in claim 120, wherein said engine state-change detecting means comprises means for determining whether or not a throttle valve of said engine is completely closed.

122. An apparatus as set forth in claim 120, wherein said engine state-change detecting means comprises:

means for calculating a change of an intake air amount of said engine; and means for determining whether or not the change of said intake air amount is larger than a predetermined amount.

123. An apparatus as set forth in claim 120, wherein said engine state-change detecting means comprises:

means for calculating a change of an intake pressure of said engine; and means for determining whether or not the change of said intake air pressure is larger than a predetermined pressure.

124. An apparatus as set forth in claim 120, wherein said engine state-change detecting means comprises:

means for calculating a change of a throttling opening of said engine; and means for determining whether or not the change of said throttling opening is larger than a predetermined opening.

125. An apparatus as set forth in claim 120, wherein said engine state-change detecting means comprises:

means for calculating a change of an speed of said engine; and means for determining whether or not the change of said speed air amount is larger than a predetermined value.

126. An apparatus as set forth in claim 120, wherein said engine state-change detecting means comprises:

means for calculating a change of a speed of a vehicle in which said engine is mounted;

means for determining whether or not the change of said vehicle speed is larger than a predetermined value.

127. An apparatus as set forth in claim 109, wherein said engine state determining means comprises means for determining whether or not said engine is in a deceleration state.

128. An apparatus as set forth in claim 127, wherein said deceleration state determining means comprises:

means for determining whether or not a throttle valve of said engine is completely closed;

means for determining whether or not a speed of a vehicle in which said engine is mounted is zero, thereby determining that said engine is in a deceleration state when said throttle valve is completely closed and said vehicle speed is not zero.

129. An apparatus as set forth in claim 127, wherein said deceleration state determining means comprises:

means for determining whether of not an intake air amount of said engine is smaller than a predetermined amount;

means for determining whether or not a speed of a vehicle in which said engine is mounted is zero, thereby determining that said engine is in a deceleration state when said intake air amount is smaller than said predetermined amount and said vehicle speed is not zero,

130. A method as set forth in claim 127, wherein said deceleration state determining means comprises:

means for determining whether or not an intake air pressure of said engine is smaller than a predetermined pressure;

means for determining whether or not a speed of a vehicle in which said engine is mounted is zero, thereby determining that said engine is in a deceleration state when said intake air pressure is smaller than said predetermined pressure and said vehicle speed is not zero.

131. An apparatus as set forth in claim 127, wherein said deceleration state determining means comprises:

means for determining whether or not a throttle valve opening of said engine is smaller than a predetermined opening;

means for determining whether or not a speed of a vehicle in which said engine is mounted is zero, thereby determining that said engine is in a deceleration state when said throttle valve opening is smaller than said predetermined opening and said vehicle speed is not zero.

132. An apparatus as set forth in claim 109, wherein said engine state determining means comprises:

means for determining whether or not said engine is in an idling state;

means for determining whether or not a predetermined duration of said idling state has passed, thereby determining that said engine is in said predetermined state after said predetermined duration of said idling state has passed.

133. An apparatus as set forth in claim 132, wherein said idling state determining means comprises:

means for determining whether or not a throttle valve of said engine is completely closed; and means for determining whether or not a speed of a vehicle in which said engine is mounted is zero, thereby determining that said engine is in an idling state when said throttle valve is completely closed and said vehicle speed is not zero.

134. An apparatus as set forth in claim 132, wherein said idling state determining means comprises:

means for determining whether or not a neutral switch of the automatic transmission is turned ON, in the case of an automatic transmission vehicle;

means for determining whether or not a speed of a vehicle in which said engine is mounted is zero, thereby determining that said engine is in an idling state when said newtral switch is turned ON and said vehicle speed is not zero.

135. An apparatus as set forth in claim 132, wherein said idling state determining means comprises:

means for determining whether or not an intake air amount of said engine is smaller than a predetermined amount; and means for determining whether or not a speed of said engine is smaller than a predetermined speed, thereby determining that said engine is in an idling state when said intake air amount is smaller than said predetermined amount and said engine speed is smaller than said predetermined speed.

136. An apparatus as set forth in claim 132, wherein said idling state determining means comprises:

means for determining whether or not an intake air pressure of said engine is smaller than a predetermined pressure; and means for determining whether or not a speed of said engine is smaller than a predetermined speed, thereby determining that said engine is in an idling state when said intake air pressure is smaller than said predetermined pressure and said engine speed is smaller than said predetermined speed.

137. An apparatus as set forth in claim 132, wherein said idling state determining means comprises:

means for determining whether or not a throttle valve opening of said engine is smaller than a predetermined opening; and means for determining whether or not a speed of said engine is smaller than a predetermined speed, thereby determining that said engine is in an idling state when said throttle valve opening is smaller than said predetermined opening and said engine speed is smaller than said predetermined speed.

138. An apparatus as set forth in claim 132, wherein said idling state determining means comprises:

means for determining whether or not a speed of said engine is smaller than a predetermined speed; and means for determining whether or not an exhaust gas temperature of said engine is lower than a predetermined temperature, thereby determining that said engine is in an idling state when said engine speed is lower than said predetermined speed and said exhaust gas temperature is lower than said predetermined temperature.

139. An apparatus as set forth in claim 132, wherein said idling state determining means comprises:

means for determining whether or not a speed of said engine is smaller than a predetermined speed; and means for determining whether or not a coolant temperature of said engine is lower than a predetermined temperature, thereby determining that said engine is in an idling state when said engine speed is lower than said predetermined speed and said coolant temperature is lower than said predetermined temperature.

140. An apparatus as set forth in claim 132, wherein said idling state determining means comprises:

means for determining whether or not a speed of said engine is smaller than a predetermined speed; and means for determining whether or not a temperature of said downstream-side air-fuel ratio sensor is lower than a predetermined temperature, thereby determining that said engine is in an idling state when said engine speed is lower than said predetermined speed and said temperature of said downstream-side air-fuel ratio sensor is lower than said predetermined temperature.

141. An apparatus as set forth in claim 132, wherein said idling state determining means comprises:

means for determining whether or not a throttle valve of said engine is comletely closed; and means for determining whether or not an exhaust gas temperature of said engine is lower than a predetermined temperature, thereby determining that said engine is in an idling state when said throttle valve is completely closed and said exhaust gas temperature is lower than said predetermined temperature.

142. An apparatus as set forth in claim 132, wherein said idling state determining means comprises:

means for determining whether or not a throttle valve of said engine is completely closed; and means for determining whether or not a coolant temperature of said engine is lower than a predetermined temperature, thereby determining that said engine is in an idling state when said throttle valve is completely closed and said coolant temperature is lower than said predetermined temperature.

143. An apparatus as set forth in claim 132, wherein said idling state determining means comprises the steps of:

means for determining whether or not a throttle valve of said engine is completely closed; and means for determining whether or not a temperature of said downstream-side air-fuel ratio sensor is lower than a predetermined temperature, thereby determining that said engine is in an idling state when said throttle valve is completely closed and said temperature of said downstream-side air-fuel ratio sensor is lower than said predetermined temperature.

144. An apparatus as set forth in claim 109, further comprising means for delaying the restart of the calculation of said second air-fuel ratio correction amount for a predetermined duration after said engine leaves said predetermined state.

* * * * *